US008482494B2

(12) United States Patent
Ozaki

(10) Patent No.: US 8,482,494 B2
(45) Date of Patent: Jul. 9, 2013

(54) DISPLAY DRIVE APPARATUS, AND DISPLAY APPARATUS AND DISPLAY DRIVE METHOD THEREOF

(75) Inventor: Tsuyoshi Ozaki, Fuchu (JP)

(73) Assignee: Casio Computer Co., Ltd., Tokyo (JP)

( * ) Notice: Subject to any disclaimer, the term of this patent is extended or adjusted under 35 U.S.C. 154(b) by 1189 days.

(21) Appl. No.: 12/365,258

(22) Filed: Feb. 4, 2009

(65) Prior Publication Data

US 2009/0195530 A1 Aug. 6, 2009

(30) Foreign Application Priority Data

Feb. 5, 2008 (JP) ..... 2008-024759
Mar. 4, 2008 (JP) ..... 2008-052926

(51) Int. Cl.
*G09G 3/20* (2006.01)

(52) U.S. Cl.
USPC ..... 345/77; 345/76; 345/78; 345/211; 345/213

(58) Field of Classification Search
None
See application file for complete search history.

(56) References Cited

U.S. PATENT DOCUMENTS

| | | | | |
|---|---|---|---|---|
| 7,528,812 | B2 * | 5/2009 | Tsuge et al. | 345/78 |
| 2005/0041002 | A1 | 2/2005 | Takahara et al. | |
| 2006/0267886 | A1 * | 11/2006 | Ozaki et al. | 345/76 |

FOREIGN PATENT DOCUMENTS

| | | | |
|---|---|---|---|
| JP | 2004-264481 | A | 9/2004 |
| JP | 2006-330138 | A | 12/2006 |
| JP | 2006-330323 | A | 12/2006 |
| JP | 2007-248800 | A | 9/2007 |
| WO | WO 03/023750 | A1 | 3/2003 |

OTHER PUBLICATIONS

Japanese Office Action dated Mar. 9, 2010 and English translation thereof in counterpart Japanese Application No. 2008-024759.

* cited by examiner

*Primary Examiner* — William L Boddie
*Assistant Examiner* — Christopher Thompson
(74) *Attorney, Agent, or Firm* — Holtz, Holtz, Goodman & Chick, P.C.

(57) ABSTRACT

A display drive apparatus performs a display drive of a display panel on the basis of display data and comprises a selection drive section for applying a selection signal to each of display pixels arranged in each row of the display panel, a data drive section for generating a drive signal based on the display data, and a power source drive section for setting at least a row as a writing region and at least a region as a designated region separated from the writing region by the number of one or more rows and sequentially moving correspondingly to moving of the writing region, and the power source drive section supplies a power source voltage for operating each display pixel to make each display pixel corresponding to the row of the writing region and each display pixel corresponding to the row of the designated region perform non-display operation.

5 Claims, 33 Drawing Sheets

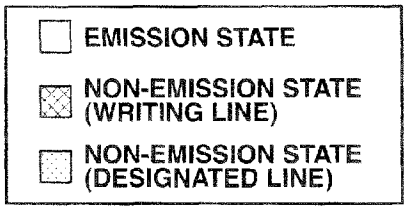
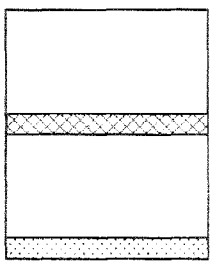
FIG.10A
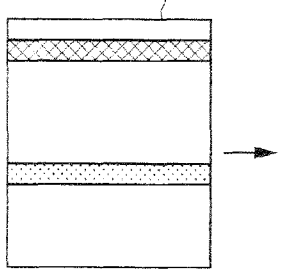
FIG.10B
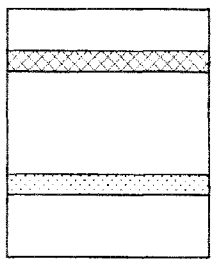
FIG.10C
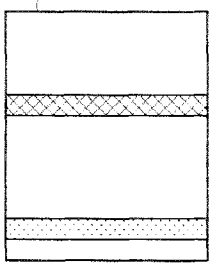
FIG.10D
FIG.10E
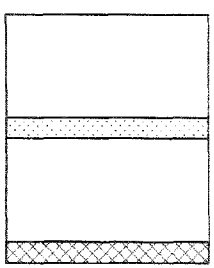
FIG.10F
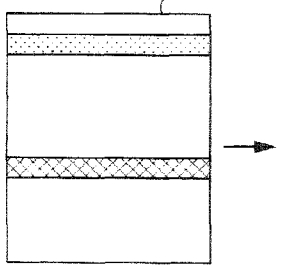
FIG.10G
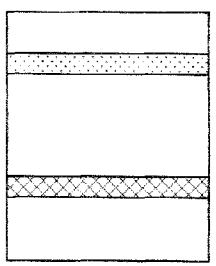
FIG.10H
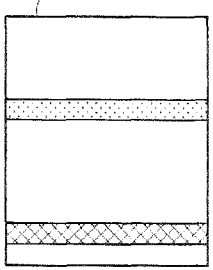
FIG.10I
FIG.10J EMISSION STATE
NON-EMISSION STATE (WRITING GROUP)
NON-EMISSION STATE (DESIGNATED GROUP)
110
110
110
110

EMISSION STATE
NON-EMISSION STATE (WRITING LINE)
NON-EMISSION STATE (DESIGNATED LINE)
110

EMISSION STATE
NON-EMISSION STATE (WRITING GROUP)
NON-EMISSION STATE (DESIGNATED GROUP)
110

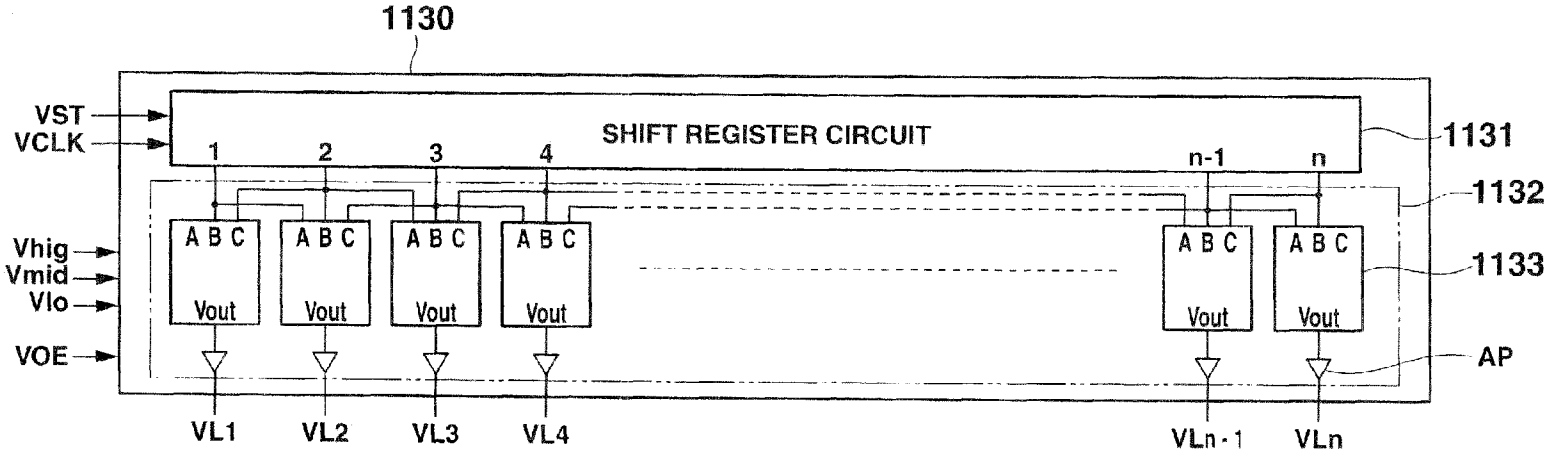
FIG.22A
| INPUT SIGNAL | | | OUTPUT SIGNAL |
|---|---|---|---|
| A | B | C | Vout |
| H | L | L | VM |
| L | H | L | VL |
| L | L | H | VM |
| L | L | L | VH |
FIG.22C
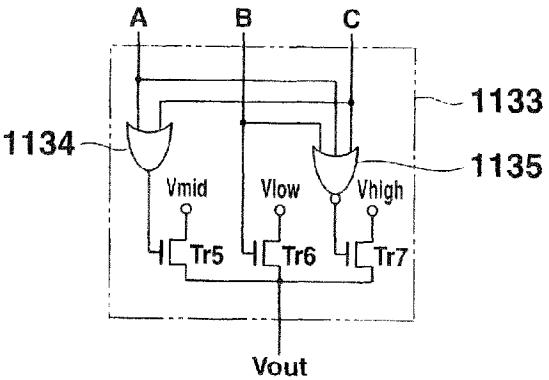
FIG.22B EMISSION STATE
NON-EMISSION STATE (WRITING LINE)
INTERMEDIATE EMISSION STATE (DESIGNATED LINE)

EMISSION STATE
NON-EMISSION STATE (WRITING LINE)
INTERMEDIATE EMISSION STATE (DESIGNATED LINE)

DISPLAY DRIVE APPARATUS, AND DISPLAY APPARATUS AND DISPLAY DRIVE METHOD THEREOF

CROSS-REFERENCE TO RELATED APPLICATIONS

This application is based upon and claims the benefit of priorities from the prior Japanese Patent Application No. 2008-024759, filed Feb. 5, 2008, and No. 2008-052926 filed on Mar. 4, 2008, the entire contents of which are incorporated herein by reference.

BACKGROUND OF THE INVENTION

1Field of the Invention

The present invention relates to a display drive apparatus, and a display apparatus and display drive method thereof, and more particularly to a display drive apparatus for driving a display panel dealing with an active matrix type drive method, a display apparatus equipped with the display drive apparatus, and a display drive method thereof.

2Related Art

In recent years, a display apparatus (emission element type display apparatus), equipped with a liquid crystal display device (LCD) or a display panel in which self-emission elements, such as organic electroluminescence elements (organic EL elements), are two-dimensionally arranged, has been widely applied as a monitor or display of a personal computer and video equipment, and as a display device of portable equipment (mobile equipment), such as a portable telephone, a digital audio player, a digital camera, and an electric dictionary.

In particular, an emission element type display apparatus, to which an active matrix type drive method is applied, has such prominent display characteristics as a display response speed is faster and view angle dependency is also smaller in comparison with those of a liquid crystal display device, and the emission element type display apparatus has a feature in the construction thereof that does not require any back lights and light guide plate unlike the liquid crystal display device. Accordingly, the emission element type display apparatus is expected to be applied to various pieces of electronic equipment in the future as the next generation display device.

Generally, the drive control method of an active matrix type display apparatus, such as a liquid crystal display device and an emission element type display apparatus, performs gradation control on the basis of a voltage component held in each display pixel by setting the display pixels in each row to be in their selected states sequentially to apply a gradation voltages according to display data (to write display data) in synchronization with the selection timing. That is, desired image information according to display data is displayed on a display panel by the control of the orientated states of liquid crystal molecules in a liquid crystal display device, or by the control of the luminance of emission elements in an emission element type display apparatus.

If the display operation is continuously executed until the next display data has been written in the display pixels in each row, for example, during one frame period (hold type display drive control) here, then the display operation (emission operation) according to the display data continues in almost the whole of one frame period. Consequently, the display operation of a still image has a characteristic in which flickers are difficult to arise, but the display operation of a moving image has a problem in which the image information displayed in the preceding frame period is easily sighted as a residual image and the blurring and bleeding of the image information are caused to cause the deterioration of a display image quality.

Accordingly, as a display drive method of improving a display image quality by suppressing the aforementioned blurring and bleeding of a moving image in its display operation in a liquid crystal display device and an emission element type display apparatus, for example, a technique (false impulse type display drive method) is known that improves the display quality of a moving image by executing a black display operation (non-emission operation period) of setting the display pixels in each row into a non-display or low gradation display state in addition to the display operation (emission operation period) according to display data in one frame period. Such a drive control method of a display apparatus is further minutely described in, for example, Japanese Patent Application Laid-Open Publication No. 2004-264481.

If driving is performed by a relatively low frame frequency, for example, about 30 Hz by the aforesaid false impulse type display drive method, black display (non-emission) regions inserted into display (emission) regions are recognized as flickers by human visual sensation. A technique of drive at a comparatively high frame frequency of 60 Hz or more is consequently applied generally.

However, even if the frame frequency (that is, the drive frequency of a display apparatus) is set to be higher, there is a problem in which flickers and the boundaries of display regions (boundaries between emission regions and non-emission regions) are sometimes recognized when a human visual line quickly moves. Moreover, there are also the problems of causing the rise of a driver cost and the restriction of the specifications of a display panel.

SUMMARY OF THE INVENTION

In view of the problems mentioned above, the present invention accordingly has the advantage of providing a display drive apparatus capable of making it difficult to recognize flickers and the boundaries of display regions of a display panel dealing with an active matrix type drive method, and capable of suppressing a production cost of the display panel, and the advantage of providing a display apparatus equipped with the display drive apparatus and a display drive method thereof.

An aspect of the present invention relates to a display drive apparatus performing a display drive of a display panel on the basis of display data, the display panel including a plurality of display pixels arranged along a plurality of rows and a plurality of columns, the apparatus comprising: a selection drive section for sequentially applying a selection signal to each of the display pixels arranged in each of the rows to sequentially set each of the display pixels in each of the rows into a selected state; a data drive section for generating a drive signal based on the display data to supply the generated drive signal to each of the display pixels in each of the rows set to be in the selected state; and a power source drive section for setting at least a row of region as a writing region, the writing region including at least a row set to be in the selected state by the selection drive section, the writing region sequentially moving according to an application operation (applying operation) for applying the selection signal to each of the display pixels in each of the rows by the selection drive section, the power source drive section setting at least a region as a designated region, the designated region separated from the writing region by the number of one or more rows, the designated region including at least a row, the designated region sequentially moving correspondingly to the moving of the writing region, the power source drive section supplying a power source voltage for operating each of the display pixels to make each of the display pixels corresponding to the row of the writing region and each of the display pixels corresponding to the row of the designated region perform a non-display operation at the same time.

In the present aspect, the power source drive section may include: a shift register circuit for sequentially outputting shift signals the number of which is less than the number of rows of the display pixels arranged in the display panel; and an output circuit for converting the shift signals into voltage levels according to the power source voltage for making the display pixels perform non-display operations to simultaneously apply the converted voltage levels to the respective display pixels corresponding to the rows in the writing region and the designated region in synchronization with application timing of the selection signal.

In the present aspect, the power source drive section may apply the power source voltage of a display level from the output circuit to each of the display pixels in the rows other than the writing region and the designated region in synchronization with application timing of the selection signal.

In the present aspect, the writing region includes one row region and the designated region includes another row region, and when the number of rows of the display panel is set to be n, the writing region and the designated region may be separated from each other by the number of rows of n/2−1.

In the present aspect, the writing region includes one row region and the designated region includes a plurality of row regions, and when the number of rows of the display panel is set to be n and the total number of the writing region and the designated regions is set to be q, each of the designated regions may be separated from the writing region by the number of rows of n/q−1 and may be separated from one another by the number of rows of n/q−1.

In the present aspect, the power source drive section may divide the plurality of rows of the display panel into a plurality of groups each including the predetermined number of rows, which is two or more rows, may set a region comprising one of the plurality of groups including the rows set to be in the selected state as the writing region, the writing region moving according to the application operation for applying the selection signal, may set at least one region separated from the group corresponding to the writing region by the number of groups, which is one or more, as the designated region, the designated region including one group, the designated region moving correspondingly to the movement of the writing region, may applies the power source voltage for making each of the display pixels perform the non-display operation to each of the display pixels at the same time, the display pixels corresponding to the group set as the writing region and to the group set as the designated region, and may apply the power source voltage of a display level to the display pixels corresponding to groups other than the groups set as the writing region and the designated region in the plurality of groups.

In the present aspect, the designated region includes a plurality of sub-regions, each of the sub-regions may be separated from the writing region by the predetermined number of groups, and each of the sub-regions may be separated from one another by the predetermined number of groups.

Another aspect of the present invention is a display apparatus including a display panel in which a plurality of display pixels are arranged along a plurality of rows and a plurality of columns, the display apparatus displaying image information based on display data in the display panel, the apparatus comprising: a selection drive section for sequentially applying a selection signal to each of the display pixels arranged in each of the rows in the display panel to sequentially set each of the display pixels in each of the rows into a selected state; a data drive section for generating a drive signal based on the display data to supply the generated drive signal to each of the display pixels in each of the rows set to be in the selected state; and a power source drive section for setting at least a row of region in the display panel as a writing region, the writing region including at least a row set to be in the selected state by the selection drive section, the writing region sequentially moving according to an application operation for applying the selection signal to each of the display pixels in each of the rows by the selection drive section, the power source drive section setting at least a region as a designated region, the designated region separated from the writing region by the number of one or more rows, the designated region including at least a row, the designated region sequentially moving correspondingly to the moving of the writing region, the power source drive section supplying a power source voltage for operating each of the display pixels to make each of the display pixels corresponding to the row of the writing region and each of the display pixels corresponding to the row of the designated region perform a non-display operation at the same time.

In the present aspect, the power source drive section may apply the power source voltage of a non-display level to each of the display pixels corresponding to the rows in the writing region and the designated region and may apply the power source voltage of a display level to each of the display pixels in the rows other than the writing region and the designated region in synchronization with application timing of the selection signal.

In the present aspect, the writing region includes one row region and the designated region includes another row region, and when the number of rows of the display panel is set to be n, the writing region and the designated region may be separated from each other by the number of rows of n/2−1.

In the present aspect, the writing region includes one row region and the designated region includes a plurality of row regions, and when the number of rows of the display panel is set to be n and the total number of the writing region and the designated regions is set to be q, each of the designated regions may be separated from the writing region by the number of rows of n/q−1 and may be separated from one another by the number of rows of n/q−1.

In the present aspect, the power source drive section may divide the plurality of rows of the display panel into a plurality of groups each including the predetermined number of rows, which is two or more rows, may set a region comprising one of the plurality of groups including the rows set to be in the selected state as the writing region, the writing region moving correspondingly to the application operation for applying the selection signal, may set at least one region separated from the group corresponding to the writing region by the number of groups, which is one or more, as the designated region, the designated region including one group, the designated region moving correspondingly to the moving of the writing region, may apply the power source voltage for making each of the display pixels perform the non-display operation to each of the display pixels at the same time, the display pixels corresponding to the group set as the writing region and to the group set as the designated region, and may apply the power source voltage of a display level to each of the display pixels corresponding to groups other than the groups set as the writing region and the designated region in the plurality of groups.

In the present aspect, the designated region includes a plurality of sub-regions, each of the sub-regions may be separated from the writing region by the predetermined number of groups, and each of the designated regions may be separated from one another by the predetermined number of groups.

In the present aspect, each of the display pixels in the display panel may include an emission element and a drive circuit for controlling an emission operation of the emission element, and the drive circuit may include an emission control element to generate an emission drive current of a predetermined current value on the basis of the drive signal supplied from the data drive section and to supply the generated emission drive current to the emission element, the emission control element connected between a power source line through which the power source voltage is applied at least from the power source drive section and the emission element.

In the present aspect, the emission element may be an organic electroluminescence element.

A further aspect of the present invention is a display drive method of a display apparatus including a display panel in which a plurality of display pixels are arranged along a plurality of rows and a plurality of columns, the display apparatus displaying image information based on display data in the display panel, the method comprising the steps of: applying a selection signal to each of the display pixels arranged in each of the rows in the display panel sequentially, to set each of the display pixels in each of the rows into a selected state sequentially; supplying a drive signal based on the display data to each of the display pixels in each of the rows set to be in the selected state; setting at least a row of region as a writing region, the writing region including at least a row set to be in the selected state in the display panel; setting a region of at least a row as a designated region, the designated region separated from the writing region by the number of rows of one or more rows; moving the writing region and the designated region sequentially correspondingly to a supply operation of the selection signal to each of the display pixels in each of the rows; and setting each of the display pixels corresponding to the rows of the writing region and the designated region, which are moving sequentially, into a non-display operation state at the same time, and setting each of the display pixels corresponding to the rows other than the writing region and the designated region into a display operation state.

In the present aspect, the writing region and the designated region are severally composed of one row region, the number of the designated region is one, and when the number of rows of the display panel is set to be n, the writing region and the designated region may be set in rows separated from each other by the number of rows of $n/2-1$.

In the present aspect, the writing region and the designated region are severally composed of one row, the designated region is a plurality of regions, and when the number of rows of the display panel is set to be n and the total number of the writing region and the designated regions is set to be q, each of the designated regions may be set in regions separated from the writing region by the number of rows of $n/q-1$ and separated from one another by the number of rows of $n/q-1$.

In the present aspect, the steps of setting the writing region and the designated region include an operation of: dividing the plurality of rows of the display panel into a plurality of groups each composed of the predetermined number of rows, which is two or more rows; setting a region composed of a group including the rows set to be in the selected state in the plurality of groups as the writing region, the writing region moving correspondingly to an application operation for applying the selection signal; and setting at least one region separated from the group corresponding to the writing region by the number of groups, which is one or more, as the designated region, the designated region composed of one group, the designated region moving correspondingly to the moving of the writing region, wherein the step of the non-display operation and applying a power source voltage of a display level to each of the display pixels may include an operation of: applying the power source voltage for making each of the display pixels perform the non-display operation to each of the display pixels at the same time, the display pixels corresponding to the group set as the writing region and to the group set as the designated region; and applying the power source voltage of the display level to each of the display pixels corresponding to groups other than the groups set as the writing region and the designated region in the plurality of groups.

In the present aspect, the designated region is a plurality of regions; and each of the designated regions is set in regions separated from the writing region by the predetermined number of groups and separated from one another by the predetermined number of groups.

A still further aspect of the present invention is a display drive apparatus to perform a display drive of a display panel in which a plurality of display pixels are arranged along a plurality of rows and columns, the apparatus comprising a power source drive section to perform: setting a region in the display panel as a writing region, the writing region including a row that is set to be in a selected state in which a drive signal based on display data is written into the row; supplying a first power source voltage to the display pixels in the writing region, the first power source voltage making the display pixels to be in a non-display operation state; setting a region in the display panel to a designated region, the designated region including a row adjoining the writing region; supplying a second power source voltage to the display pixels in the designated region, the second power source voltage making display luminance of the display pixels lower than that according to the written drive signal; and supplying a third power source voltage to the display pixels of regions other than the writing region and the designated region in the plurality of rows of the display panel, the third power source voltage making the display luminance of the display pixels equal to that according to the written drive signal.

In the present aspect, the display drive apparatus may further comprise: a selection drive section for applying a selection signal to the display pixels of each of the rows in the display panel sequentially to set the plurality of display pixels to be in the selected state by the row; and a data drive section for generating the drive signal on the basis of the display data to supply the generated drive signal to the display pixels in the row set as the selected state.

In the present aspect, each of the display pixels in the display panel may include an emission element and a drive circuit including a drive control transistor to control a current to be supplied to the emission element, the drive control transistor including both ends of a current path, to one end of which at least any one of the first, second, and third power source voltages supplied from the power source drive section is applied, the other end of which is connected to one end of the emission element, the first power source voltage may be set at potential making the emission element be in a state in which no currents flows therethrough, the second power source voltage may be set at potential making the drive control transistor operate in its linear region, and the third power source voltage may be set at potential making the drive control transistor operate in its saturated region.

In the present aspect, each of the rows of the display panel is sequentially made to be in the selected state by the adjoining row, and the power source drive section may set at least either of the following regions as the designated region: a region adjoining the writing region and including a row that has been made to be in the selected state before a row included in the writing region is made to be in the selected state, and a region adjoining the writing region and including a row that is to be made to be in the selected state after the row included in the writing region has been made to be in the selected state.

In the present aspect, when the number of rows of the display panel is set to n, and when the region set as the writing region does not include the first row or n-th row of the display panel, the power source drive section may set the following regions as the designated region: the designated region including a row adjoining the writing region and having been made to be in the selected state before a row included in the writing region is made to be in the selected state, and the designated region including a row adjoining the writing region and being to be made to be in the selected state after the row included in the writing region has been made to be in the selected state. The power source drive section may set only the region including the row that is to be made to be in the selected state after the row included in the writing region has been made to be in the selected state as the designated region when the region set as the writing region includes the first row of the display panel. The power source drive section may set only the region including the row adjoining the writing region and having been made to be in the selected state before the row included in the writing region is made to be in the selected state as the designated region when the region set as the writing region includes the n-th row of the display panel.

In the present aspect, the power source drive section may set the one row region made to be in the selected state in the display panel as the writing region.

In the present aspect, the power source drive section may set at least either of the following regions in the display panel as the designated region: a region adjoining the writing region and including a row that has been made to be in the selected state before a row included in the writing region is made to be in the selected state, and a region including a row that is to be made to be in the selected state after the row included in the writing region has been made to be in the selected state.

In the present aspect, the power source drive section may divide the plurality of rows of the display panel into a plurality of groups each including the predetermined number of rows, which is two or more rows, may set one of the plurality of groups including a row set to be in the selected state as the writing region, and may set at least either of the following groups as the designated region: at least one of the groups including a row adjoining the group set as the writing region, the adjoining row having been made to be in the selected state before the rows included in the group set as the writing region are made to be in the selected state, and at least another of the groups including another row adjoining the group set as the writing region, the another adjoining row being to be made in the selected state after the rows included in the group set as the writing region have been made to be in the selected state.

In the present aspect, when the number of rows of the display panel is set to n, and when the group set as the writing region does not include the first row or n-th row of the display panel, the power source drive section may set the following groups as the designated regions: at least one of the groups including a row adjoining the group set as the writing region and having been made to be in the selected state before a row included in the group set as the writing region is made to be in the selected state, and at least one of the groups including a row being to be made to be in the selected state after the row included in the group set as the writing region has been made to be in the selected state. The power source drive section may set only the at least one of the groups as the designated region, the group including the row being to be made to be in the selected state after the row included in the group set as the writing region has been made to be in the selected state, when the group set as the writing region includes the first row of the display panel. The power source drive section may set only the at least one of the groups as the designated region, the group including the row having been made to be in the selected state before the row included in the group set as the writing region is made to be in the selected state, when the group set as the writing region includes the n-th row of the display panel.

A still further aspect of the present invention is a display apparatus to display image information based on display data, comprising: a display panel including a plurality of display pixels arranged along a plurality of rows and columns to display the image information; a selection drive section for applying a selection signal to the display pixels in each of the rows of the display panel sequentially to set the plurality of display pixels to be in a selected state sequentially by the row; a data drive section for generating a drive signal on the basis of the display data to supply the generated drive signal to the display pixels in the row set in the selected state; and a power source drive section for setting a region in the display panel as a writing region, the writing region including a row to be made to be in the selected state in which the drive signal based on the display data is written into the row, the power source drive section supplying a first power source voltage to the display pixels in the writing region, the first power source voltage making the display pixels be in a non-display operation state, the power source drive section setting a region in the display panel as a designated region, the designated region including a row adjoining the writing region, the power source drive section supplying a second power source voltage to the display pixels in the designated region, the second power source voltage making display luminance of the display pixels lower than that according to the written drive signal, the power source drive section supplying a third power source voltage to the display pixels in regions other than those in the writing region and the designated region in the plurality of rows in the display panel, the third power source voltage making the display luminance of the display pixels equal to that according to the written drive signal.

In the present aspect, each of the display pixels in the display panel may include an emission element and a drive circuit including a drive control transistor to control a current to be supplied to the emission element, the drive control transistor including both ends of a current path, to one end of which at least any one of the first, second, and third power source voltages supplied from the power source drive section is applied, the other end of which is connected to one end of the emission element, the first power source voltage may be set at potential making the emission element be in a state in which no currents flows therethrough, the second power source voltage may be set at potential making the drive control transistor operate in its linear region; and the third power source voltage may be set at potential making the drive control transistor operate in its saturated region.

In the present aspect, the power source drive section may set at least either of the following regions as the designated region: a region adjoining the writing region and including a row that has been made to be in the selected state before a row included in the writing region is made to be in the selected state, and a region adjoining the writing region and including a row that is to be made to be in the selected state after the row included in the writing region has been made to be in the selected state.

In the present aspect, the power source drive section may divide the plurality of rows of the display panel into a plurality of groups each including the predetermined number of rows, which is two or more rows, may set one of the plurality of groups including a row set to be in the selected state as the writing region, and sets at least either of the following groups as the designated region: at least one of the groups including a row adjoining the group set as the writing region, the adjoining row having been made to be in the selected state before the rows included in the group set as the writing region are made to be in the selected state, and at least another of the groups including another row adjoining the group set as the writing region, the another adjoining row being to be made in the selected state after the rows included in the group set as the writing region have been made to be in the selected state.

A still further aspect of the present invention is a display drive method of a display apparatus including a display panel in which a plurality of display pixels is arranged along a plurality of rows and columns, the display apparatus displaying image information based on display data, the method comprising the steps of: applying a selection signal to the display pixels in each of the rows of the display panel sequentially, to set the plurality of display pixels in each of the rows into a selected state sequentially; generating a drive signal on the basis of the display data to supply the generated drive signal to the display pixels in the row set to be in the selected state; setting a region in the display panel as a writing region by a power source drive section, the region including a row to be made to be in a selected state in which the drive signal based on the display data is written into the row; supplying a first power source voltage to the display pixels in the writing region, the first power source voltage making the display pixels be in a non-display operation state; setting a region in the display panel as a designated region, the designated region including a row adjoining the writing region; supplying a second power source voltage to the display pixels in the designated region, the second power source voltage making display luminance of the display pixels lower than that according to the written drive signal; and supplying a third power source voltage to the display pixels in a region other than the writing region and the designated region in the plurality of rows of the display panel, the third power source voltage making the display luminance of the display pixels equal to that according to the written drive signal.

In the present aspect, each of the display pixels in the display panel may include an emission element and a drive circuit including a drive control transistor to control a current to be supplied to the emission element, the drive control transistor including both ends of a current path, to one end of which at least any one of the first, second, and third power source voltages supplied from the power source drive section is applied, the other end of which is connected to one end of the emission element, wherein the power source drive section may set the first power source voltage at potential making the emission element be in a state in which no currents flows therethrough, may set the second power source voltage at potential making the drive control transistor operate in its linear region, and may set the third power source voltage at potential making the drive control transistor operate in its saturated region.

In the present aspect, the power source drive section may set at least either of the following regions as the designated region: a region including a row adjoining the writing region and having been made to be in the selected state before a row included in the writing region is made to be in the selected state, and a region including a row that is to be made to be in the selected state after the row included in the writing region has been made to be in the selected state.

In the present aspect, the power source drive section may divide the plurality of rows of the display panel into a plurality of groups each composed of the predetermined number of rows, which is two or more rows, may set one of the plurality of groups including the rows set to be in the selected state as the writing region, and may set at least either of the following groups as the designated region: at least one of the groups including rows adjoining the group set as the writing region, the rows having been made to be in the selected state before the rows included in the group set as the writing region are made to be in the selected state, and at least another of the groups including rows being to be made in the selected state after the rows included in the group set as the writing region have been made to be in the selected state.

A still further aspect of the present invention is a display drive apparatus to perform a display drive of a display panel including a plurality of display pixels arranged along a plurality of rows and columns, the apparatus comprising a power source drive section for supplying a power source voltage to the plurality of display pixels, wherein the power source drive section sets a region in the display panel as a designated region, the designated region including a row adjoining a writing region including a row to be made to be in a selected state, in which a drive signal based on display data is written, supplies the power source voltage for the designated region to the display pixels in the designated region, the power source voltage making display luminance of the display pixels be different from that according to the written drive signal, and supplies the power source voltage for a display operation to the display pixels in the display panel, the display pixels being in a region other than the writing region and the designated region, the power source voltage making the display luminance of the display pixels equal to that according to the written drive signal.

A still further aspect of the present invention is a display drive apparatus to perform a display drive of a display panel including a plurality of display pixels arranged in a plurality of rows and columns, the apparatus comprising a power source drive section for supplying a power source voltage to the plurality of display pixels, wherein the power source drive section sets a region in the display panel as a writing region, the writing region including a row to be made to be in a selected state, in which a drive signal based on display data is written, supplies the power source voltage for a non-display operation to the display pixels in the writing region, the power source voltage making the display pixels be in a non-display operation state, sets a region in the display panel as a designated region, the designated region including a row adjoining the writing region, and supplies the power source voltage for the designated region to the display pixels in the designated region, the power source voltage making display luminance of the display pixels be different from that according to the written drive signal.

BRIEF DESCRIPTION OF THE DRAWINGS

FIGS. 10A, 10B, 10C, 10D, 10E, 10F, 10G, 10H, 10I, and 10J are operational conceptual diagrams for illustrating the display drive method of the display apparatus according to the first embodiment;

FIGS. 22A, 22B, and 22C are schematic configuration diagrams showing an example of a power source driver applied to the display apparatus according to the fifth embodiment;

DETAILED DESCRIPTION OF THE PREFERRED EMBODIMENTS

In the following, display drive apparatus, and display apparatus and their display drive methods according to the present invention will be minutely described by exemplifying embodiments.

<First Embodiment>

<Display Apparatus>

First, a schematic configuration of a display apparatus according to the present invention will be described with reference to the attached drawings.

Figure 1:
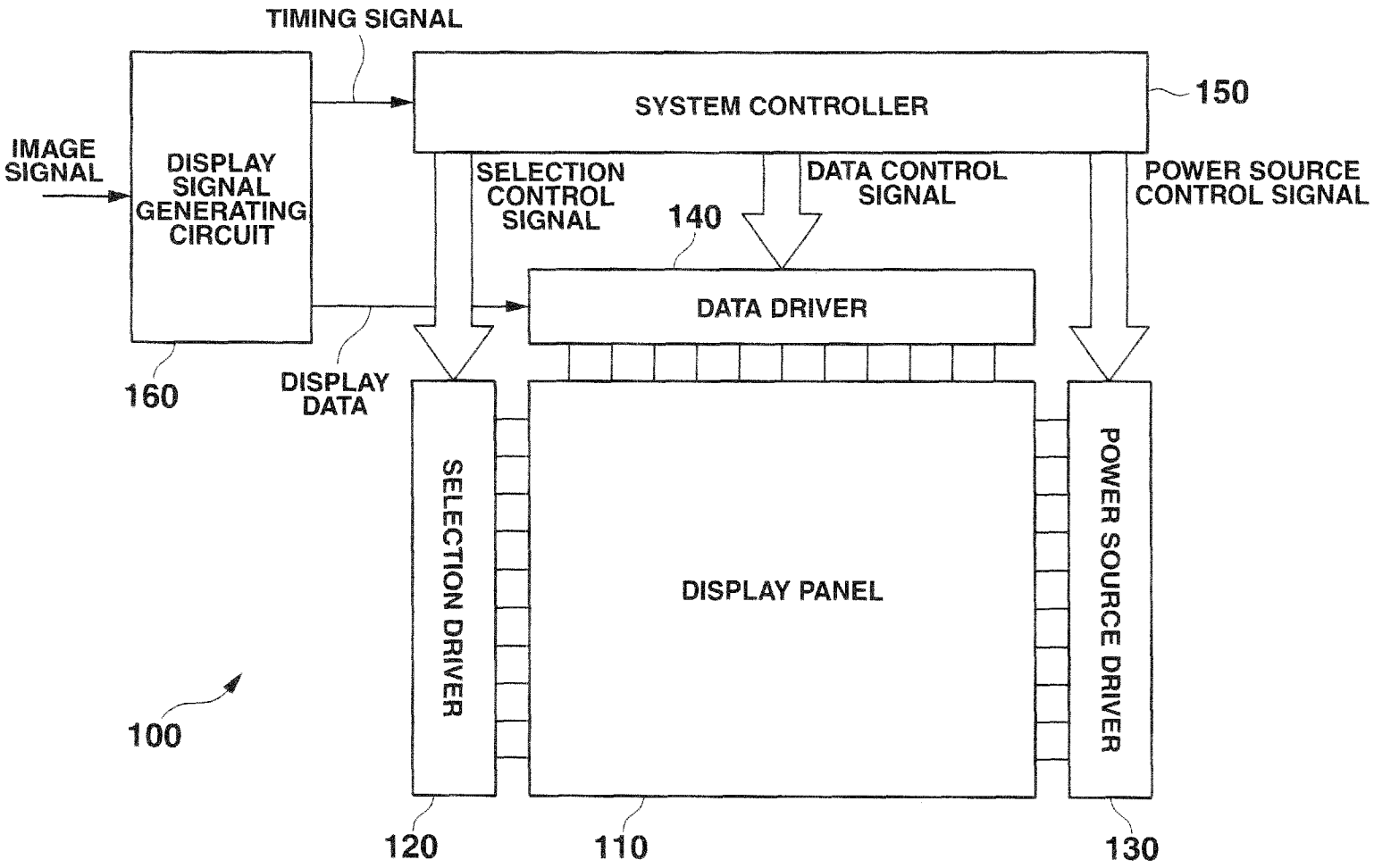
FIG. 1 is a schematic block diagram showing an example of the whole configuration of a display apparatus according to a first embodiment of the present invention.
Figure 2:
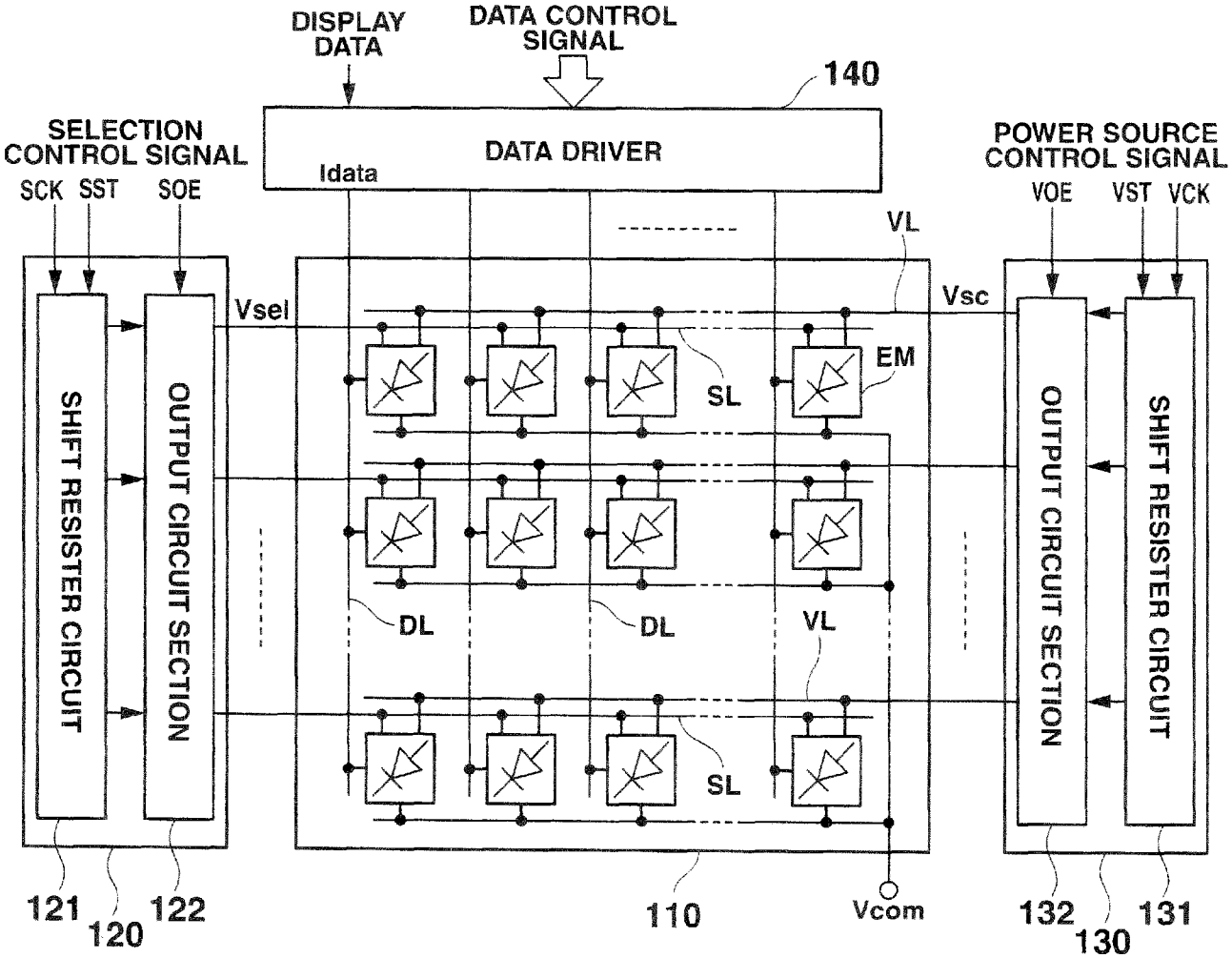
FIG. 2 is a diagram of the configuration of the principal part showing examples of a display panel and the peripheral circuitry thereof (a selection driver, a data driver, and a power source driver), which are applied to the display apparatus according to the first embodiment.

FIG. 1 is a schematic block diagram showing an example of the whole configuration of a display apparatus according to the present invention, and FIG. 2 is a diagram of the configuration of the principal part showing the examples of a display panel and the peripheral circuitry thereof (a selection driver, a data driver, and a power source driver) applied to a display apparatus according to a first embodiment.

Incidentally, an emission element type display apparatus will be described in the embodiments shown in the following. Each of the emission element type display apparatus has a configuration in which a plurality of display pixels is two-dimensionally arranged as a display panel. Each display pixel includes an emission element, and each display pixel performs an emission operation with a luminous gradation according to display data (image data). Thereby the display apparatus displays image information. But, the present invention is not limited to such an emission element type display apparatus, but may be a display apparatus that performs a gradation display (display operation) of desired image information by means of a transmitted light or a reflected light. In such a display apparatus, each display pixel is subjected to gradation control (set into a gradation state) according to display data as in a liquid crystal display device.

As shown in FIGS. 1 and 2, a display apparatus 100 according to the present embodiment schematically includes a display panel 110, a selection driver (selection drive section) 120, a power source driver (power source drive section) 130, a data driver (data drive section) 140, a system controller 150, and a display signal generating circuit 160. The display panel 110 includes a plurality of selection lines SL and a plurality of data lines DL, which are arranged so as to be perpendicular to each other in row and column directions, and a plurality of display pixels EM arranged in the neighborhood of respective intersection points. Each of the display pixels EM is equipped with a pixel drive circuit DC and an emission element (organic EL element OLED), which will be described later. The selection driver 120 is connected to the respective selection lines SL of the display panel 110, and sequentially applies a selection signal Vsel of a selection level (high level) to each of the selection lines SL at predetermined timing, thereby setting the display pixels EM in each row to be in their selected states. The power source driver 130 is connected to a plurality of power source lines VL arranged in parallel with the selection lines SL in the respective rows, and applies a power source voltage Vsc to each of the power source lines VL at predetermined timing. The data driver 140 is connected to each of the data lines DL of the display panel 110, and supplies a gradation signal (a gradation current Idata; a drive signal) according to display data to the display pixels EM through each of the data lines DL. The system controller 150 controls the operation states of at least the selection driver 120, the power source driver 130, and the data driver 140 on the basis of timing signals supplied from the display signal generating circuit 160, which will be described later, to generate a selection control signal, a power source control signal, and a data control signal for executing a predetermined display drive control of the display panel 110 and to output the generated signals. The display signal generating circuit 160 generates display data (luminous gradation data) on the basis of, for example, an image signal supplied from the outside of the display apparatus 100 and supplies the generated display data to the data driver 140. The display signal generating circuit 160 further extracts or generates a timing signal (system clock and the like) for displaying predetermined image information on the display panel 110 on the basis of display data and supplies the extracted or generated timing signal to the system controller 150.

In the following, each of the components mentioned above will be concretely described.

(Display Panel and Display Pixel)

Figure 3:
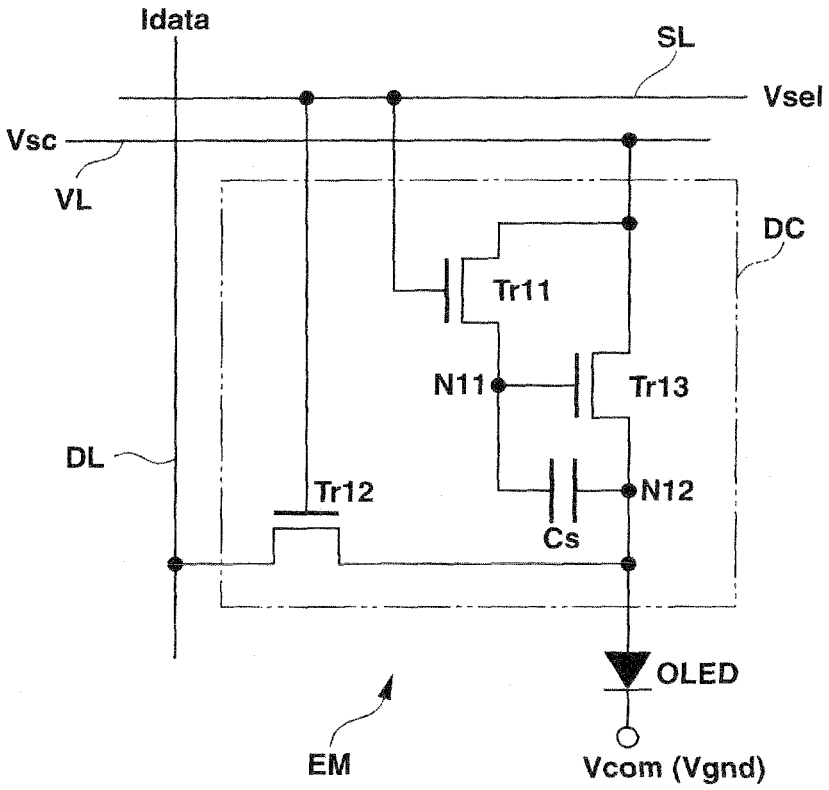
FIG. 3 is a circuit configuration diagram showing an embodiment of a display pixel (including a pixel drive circuit and an emission element) to be applied to the display apparatus according to the first embodiment.

FIG. 3 is a circuit configuration diagram showing an embodiment of a display pixel (including a pixel drive circuit and an emission element) applied to the display apparatus 100 according to the present embodiment. Incidentally, although a display pixel having a circuit configuration (pixel drive circuit) corresponding to a current designating type gradation control system will be described in the present embodiment, the present invention is not restricted to such a display pixel. The current designating type gradation control system supplies a gradation current of a current value according to display data to an emission element provided in each display pixel to make the emission element perform an emission operation (display operation) with a desired luminous gradation by making an emission drive current of the current value according to the display data flow through the emission element. The present invention may be applied to a display pixel having, for example, a circuit configuration corresponding to a voltage designating type gradation control system, which makes an emission drive current of a current value according to display data flow through the emission element of each display pixel by applying a gradation voltage of a voltage value according to the display data to the emission element, thereby making the emission element perform an emission operation with a desired luminous gradation.

The display panel 110 applied to the display apparatus 100 according to the present embodiment is controlled so that the plurality of display pixels EM, which are two-dimensionally arranged (n rows×m columns where n and m are positive integers) may be driven as shown in a display drive method, which will be described later. That is, a writing operation of display data is sequentially executed to the display pixels EM in each row set to be in its selected state in a non-display state (non-emission state), and the following operations are performed in synchronization with the writing operation: the display pixels EM in a row (hereinafter referred to as a "designated line" for descriptive purposes: designated row) separated from the row (hereinafter referred to as a "writing line" for descriptive purposes: writing row) into which the writing operation is executed by the predetermined number of rows are made to be in the non-display state (non-emission state), and the display pixels EM in the other rows (into which the writing operation has been already completed) are set to be in a display state (emission state). The display states (emission states) or non-display states (non- emission states) of the display pixels EM are set by switching the power source voltage Vsc supplied to the display pixels EM in each row between a predetermined display level or a non-display level, or by performing the turning-on (supplying) or turning-off (breaking) control of the display pixels EM here.

Moreover, for example, a configuration schematically equipped with the pixel drive circuit DC and a well-known organic EL element (current control type emission element) OLED as shown in FIG. 3 can be applied to each of the display pixels EM arranged in the display panel 110 according to the present embodiment. The pixel drive circuit DC sets the display pixel EM in its selected state on the basis of the selection signal Vsel applied from the selection driver 120, and takes in the gradation current Idata supplied from the data driver 140 in the selected state to generate an emission drive current in accordance with the gradation signal. The organic EL element OLED performs an emission operation with predetermined luminous gradation on the basis of the emission drive current supplied from the pixel drive circuit DC.

The pixel drive circuit DC according to the present embodiment includes, for example, transistors Tr11, Tr12, and Tr13, and a capacitor Cs as shown in FIG. 3. The gate terminal, drain terminal, and source terminal of the transistor Tr11 are connected to a selection line SL, a power source line VL, and a node N11, respectively. The gate terminal, source terminal, and drain terminal of the transistor Tr12 are connected to the selection line SL, the data line DL, and a node N12, respectively. The gate terminal, the drain terminal, and the source terminal of the transistor (emission control element) Tr13 are connected to the node N11, the power source voltage line (power source line) VL, and the node N12, respectively. The capacitor Cs is connected between the nodes N11 and N12 (between the gate and source of the transistor Tr13).

The anode terminal (anode electrode) of the organic EL element OLED is connected to the node N12 of the pixel drive circuit DC, and a common voltage Vcom of predetermined low potential is applied to the cathode terminal (cathode electrode) thereof. The common voltage Vcom is set to the potential equal to the power source voltage Vsc (=Vs) or arbitrary potential (for example, the ground potential Vgnd), which is higher than the power source voltage Vsc and lower than the power source voltage Vsc (=Ve) (Vs≦Vcom<Ve) in accordance with display data here. The power source voltage Vsc is set to a low level Vs in a writing operation period, during which a gradation signal (gradation current Idata) is supplied to the display pixel EM (pixel drive circuit DC). The power source voltage Vsc is set to the high level Ve in an emission operation period, during which an emission drive current is supplied to the organic EL element (emission element) OLED, which performs an emission operation with the predetermined luminous gradation during the emission operation period. Moreover, the common voltage Vcom is commonly applied to the plurality of display pixels EM arranged in a matrix in the display panel 110.

Incidentally, although the transistors Tr11-Tr13 are not especially restricted in FIG. 3, for example, field-effect type transistors, each having the same channel type in a well-known thin film transistor structure, can be applied as the transistors Tr11-Tr13. The transistors Tr11-Tr13 may be either amorphous silicon thin film transistors or polysilicon thin film transistors.

As shown in FIG. 3, by configuring the transistors Tr11-Tr13 of n-channel type amorphous silicon thin film transistors, already established amorphous silicon manufacturing techniques can be applied to manufacture a pixel drive circuit composed of transistors having uniform and stable operating characteristics (electron mobility and the like) by a comparatively simple manufacturing process here. Moreover, the capacitor Cs may be parasitic capacitance formed between the gate and source of the transistor Tr13, or may be the capacitance composed of a capacitor element additionally connected between the nodes N11 and N12 in addition to the parasitic capacitance.

Moreover, although the circuit configuration including three transistors Tr11-Tr13 has been shown as the pixel drive circuit DC in the display pixel EM described above, the present invention is not restricted to the embodiment, but may be the one including other circuit configurations including two or more transistors. Moreover, although the case where the organic EL element OLED is applied as the emission element luminously driven by the pixel drive circuit DC has been shown, but the present invention is not restricted to such a case. Any current control type emission element, for example, other emission elements, such as a light emitting diode, may be used. Furthermore, although the case where the current control type emission element is luminously driven by the pixel drive circuit DC has been described in the present embodiment, the configuration of generating a voltage component in accordance with display data to luminously drive a voltage control type emission element or the configuration of having the circuit configuration of changing the oriented states of liquid crystal molecules may be used.

(Selection Driver)

The selection driver 120 applies one of the selection signals Vsel of the selection level (the high level in the display pixels EM mentioned above) to each of the selection lines SL on the basis of a selection control signal supplied from the system controller 150 to set the display pixels EM in each row in their selected states. To put it concretely, the selection driver 120 sequentially shifts the execution of the operation of applying the selection signal Vsel to the selection line SL of each row at predetermined timing, thereby setting the display pixels EM in each row arranged in the display panel 110 to be in their selected states sequentially.

The selection driver 120 includes a well-known shift register 121 and an output circuit section (output buffer) 122, for example, as shown in FIG. 2, here. The shift register 121 sequentially outputs shift signals corresponding to the selection lines SL of the respective rows on the basis of a scanning clock signal SCK and a scanning starting signal SST, both supplied from the system controller 150, described below, as selection control signals. The output circuit section 122 converts the shift signals output from the shift register 121 into the signals having predetermined signal levels (selection levels), and outputs the converted signals to the respective selection lines SL as the selection signals Vsel on the basis of an output control signal SOE supplied from the system controller 150 as the selection control signal.

(Power Source Driver)

Figure 4:
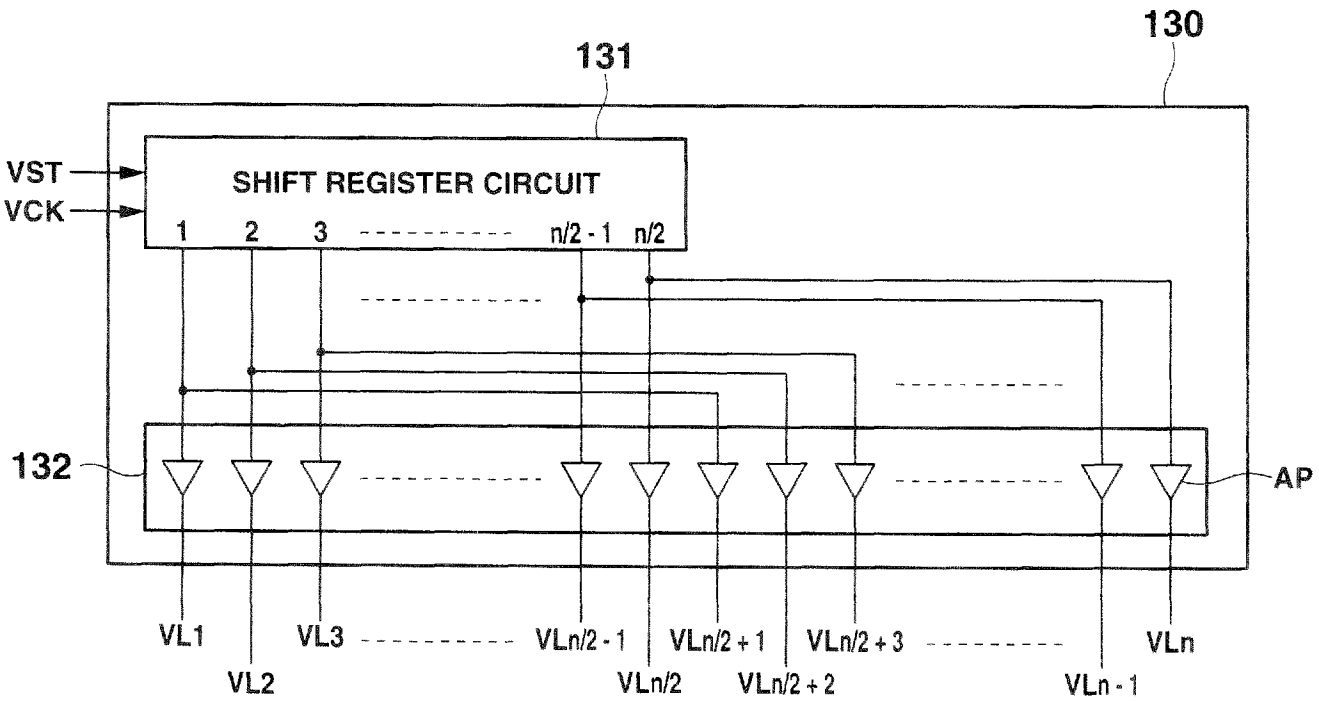
FIG. 4 is a schematic configuration diagram showing an example of a power source driver applied to the display apparatus according to the first embodiment.

FIG. 4 is a schematic configuration diagram showing an example of the power source driver 130 applied to the display apparatus 100 according to the present embodiment.

The power source driver 130 applies the high level power source voltage Vsc (=Ve) to the power source lines VL of the display pixels EM in the respective rows on the basis of the power source control signal supplied from the system controller 150 only at the time of an emission operation (at the time of a display operation), and applies the low level power source voltage Vsc (=Vs) to the power source lines VL at the time of a non-emission operation (at the time of a non-display operation).

That is, the display apparatus according to the present embodiment sequentially executes the following operation to all of the rows of the display panel 110: applying the low level power source voltage Vsc (=Vs) to the display pixels EM in the following regions among the plurality of display pixels EM two-dimensionally arranged in the display panel 110 at the same time through the power source lines VL of the respective rows: the region (writing region) corresponding to the row (writing line) set to be in the selected state by the selecting driver 120 for a writing operation of display data and the region (designated region) corresponding to the row (designated line) separated from the row to which the writing operation is executed by the predetermined number of rows. Hereby, the display pixels EM in the writing line, into which the writing operation of the display data is executed, and the display pixels EM in the designated line, separated from the former row by the predetermined number of rows, are set to be in the non-emission state (non-display state) during the writing operation period, and the high level power source voltage Vsc (=Ve) is applied to the display pixels EM in all the rows (the writing operation to which has been completed) other than the aforesaid two rows through the power source lines VL of the respective rows. Thereby the display pixels EM in all the other rows are set to be in their emission states (gradation display states).

The power source driver 130 includes a well-known shift register circuit 131 and an output circuit section (output buffer) 132 similarly to the aforesaid selection driver 120, for example, as shown in FIG. 2, here. The shift register circuit 131 sequentially outputs a sift signal corresponding to the power source line VL in each row on the basis of a clock signal VCK and a start signal VST, both supplied from the system controller 150 as power source control signals. The output circuit section 132 converts the shift signals into signals of predetermined voltage levels (voltage values Ve and Vs), and the output circuit section 132 outputs the converted signals to the respective power source lines VL as the power source voltage Vsc on the basis of an output control signal VOE supplied from the system controller 150 as the power source control signal.

In particular, as described above, in the present embodiment, in order that the low level power source voltage Vsc (=Vs) may be simultaneously applied to the display pixels EM in a row (writing line) in which a writing operation of display data is executed and the display pixels EM in a row (designated line) separated from the former row by the predetermined number of rows, for example, as shown in FIG. 4, the shift register circuit 131 includes a number (n/2) of output terminals of shift signals, which number is equal to a half of the number of the power source lines VL arranged in the display panel 110 (equal to the number n of rows), and moreover, the output circuit section 132 includes n amplifiers AP correspondingly to the power source lines VL in the respective rows, and further the output circuit section 132 is configured so that each shift signal output from the shift register circuit 131 may be input into the respective amplifiers AP in an x-th row and an (n/2+x)th row, which are separated from each other by (n/2−1) rows, through branched signal lines, and so that the input signals maybe amplified to predetermined voltage values (may be converted into the voltage levels) to be applied to the power source lines VL in the x-th row and the (n/2+x)th row. The letter x indicates an integer within a range from 1 to n/2 here. Moreover, the output circuit section 132 is provided with switching sections to output the output voltage (power source voltage Vsc) of each of the amplifiers AP to the power source line VL in each row on the basis of the output control signal VOE, although the illustration of the switching sections is omitted.

That is, a first sift signal output from the shift register circuit 131 is input into the amplifiers AP corresponding to first and (n/2+1)th rows; a second shift signal is input into the amplifiers AP corresponding to second and (n/2+2)th rows; a third shift signal is input into the amplifiers AP corresponding to third and (n/2+3)th rows; . . . ; an x-th shift signal is input into the amplifiers AP corresponding to x-th and (n/2+x)th rows; . . . ; and an n/2th shift signal is input into the amplifiers AP corresponding to n/2th and n (=n/2+n/2)th rows.

Incidentally, FIG. 4 shows the configuration of the power source driver 130 in the case where the low level power source voltage Vsc (=Vs) is applied to the display pixels EM in a row ((n/2+x)th row) separated by (n/2−1) rows from the display pixels EM in a row (for example, x-th row) into which a writing operation of display data is executed in order to set the display pixels EM to be in the non-emission state, but the present invention is not restricted to the configuration, but the configuration of applying the low level power source voltage Vsc to the display pixels EM in a row separated by the number of rows, which number is different from n/2−1 and is approximate to n/2−1, may be used.

(Data Driver)

Figure 5:
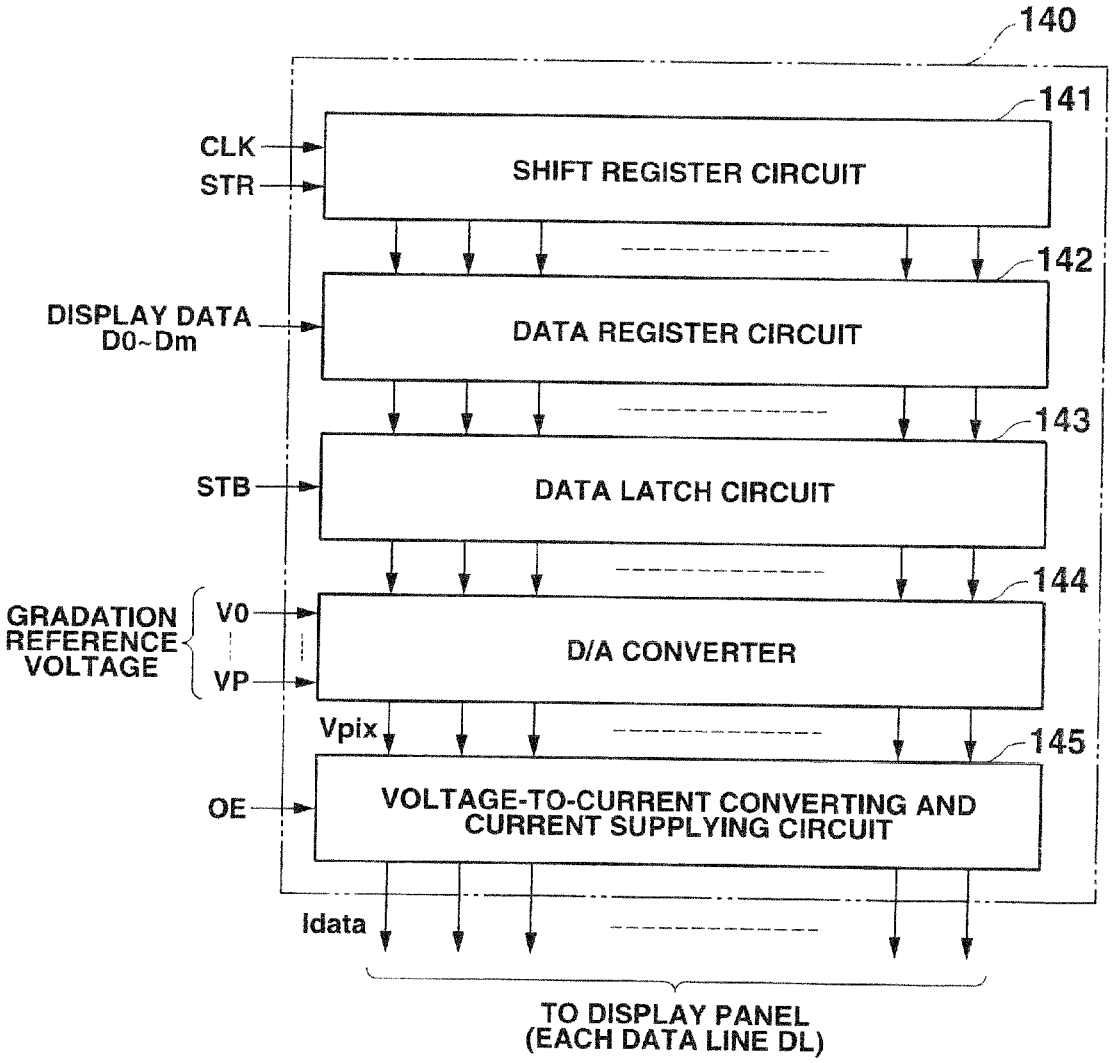
FIG. 5 is a schematic block diagram showing an example of a data driver applicable to the display apparatus according to the first embodiment.

FIG. 5 is a schematic block diagram showing an example of the data driver 140 applicable to the display apparatus 100 according to the present embodiment. Incidentally, the internal configuration of the data driver 140 shown in FIG. 5 shows only an example capable of generating a gradation current of a current value in accordance with display data, and the present invention is not restricted to the internal configuration.

As shown in FIGS. 1 and 2, schematically, the data driver 140 sequentially takes in display data (luminous gradation data) composed of a digital signal, which is supplied from the display signal generating circuit 160, described below, for every row at predetermined timing on the basis of a data control signal supplied from the system controller 150 to hold the taken display data therein, and generates the gradation current Idata of a current value corresponding to the gradation value of the display data to simultaneously supply the generated gradation current Idata to the display pixels EM in the row set to be in the selected state in a writing operation period through the data lines DL of respective columns.

For example, as shown in FIG. 5, the data driver 140 includes a shift register circuit 141, a data register circuit 142, a data latch circuit 143, a D/A converter 144, and a voltage-to-current converting & gradation current supplying circuit 145. The shift register circuit 141 sequentially outputs shift signals on the basis of data control signals (shift clock signal CLK and sampling starting signal STR) supplied from the system controller 150. The data register circuit 142 sequentially takes in display data D0-Dm for a row, which display data D0-Dm is supplied from the display signal generating circuit 160, on the basis of the input timing of the shift signals. The data latch circuit 143 holds the display data D0-Dm for a row, which display data D-Dm taken in by the data register circuit 142, on the basis of the data control signal (data latching signal STB). The D/A converter 144 converts the held display data D0-Dm into predetermined analog signal voltages (gradation voltages Vpix) on the basis of gradation reference voltages V0-VP supplied from a not-shown power supplying section. The voltage-to-current converting & gradation current supplying circuit 145 generates the gradation current Idata corresponding to the display data converted into the analog signal voltages and simultaneously outputs the generated gradation current Idata to the data lines DL of the columns corresponding to the display data at the timing based on a data control signal (output enabling signal OE) supplied from the system controller 150.

(System Controller)

The system controller 150 generates and outputs at least a selection control signal, a power source control signal, and a data control signal to each of the selection driver 120, the power source driver 130, and the data driver 140, respectively, as timing control signals for controlling their operation states. The system controller 150 thereby operates each of the drivers 120, 130, and 140 at predetermined timing to make each of the drivers 120, 130, and 140 generate and output the selection signal Vsel and power source voltage Vsc, both having predetermined voltage levels, and the gradation current Idata in accordance with display data, respectively. The system control 150 then makes each of the driver 120, 130, and 140 continuously execute the drive control operations (a writing operation and a holding operation, both being non-emission operations, and an emission operation) of each of the display pixels EM (pixel drive circuits DC), and the system controller 150 thereby performs the control (the display drive control, which will be described later, of the display apparatus 100) to make the display panel 110 display predetermined image information based on an image signal.

(Display Signal Generating Circuit)

The display signal generating circuit 160 extracts a luminous gradation signal component from, for example, an image signal supplied from the outside of the display apparatus 100, and supplies the extracted luminous gradation signal component to the data register circuit 142 of the data driver 140 as display data (luminous gradation data) composed of a digital signal for every row of the display panel 110. If the image signal includes a timing signal component prescribing the display timing of image information like a television broadcasting signal (composite image signal), then the display signal generating circuit 160 may be the one including the function of extracting the timing signal component to supply the extracted timing signal component to the system controller 150 in addition to the function of extracting the luminous gradation signal component here. In this case, the system controller 150 generates each control signal to be severally supplied to the selection driver 120, the power source driver 130, and the data driver 140 on the basis of the timing signals supplied from the display signal generating circuit 160.

<Drive Method of Display Pixel>

Next, the basic operation of a display pixel (see FIG. 3) to be applied to the aforesaid display panel 110 in the present embodiment will be described.

Figure 6A:
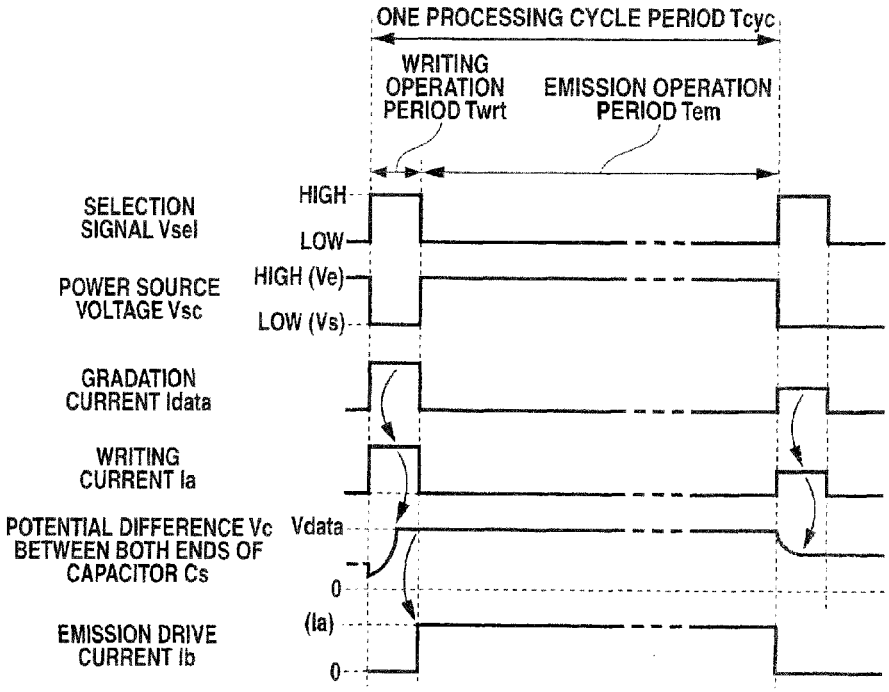
FIGS. 6A and 6B are timing charts showing basic operations in display pixels applied to the display apparatus according to the first embodiment.
Figure 6B:
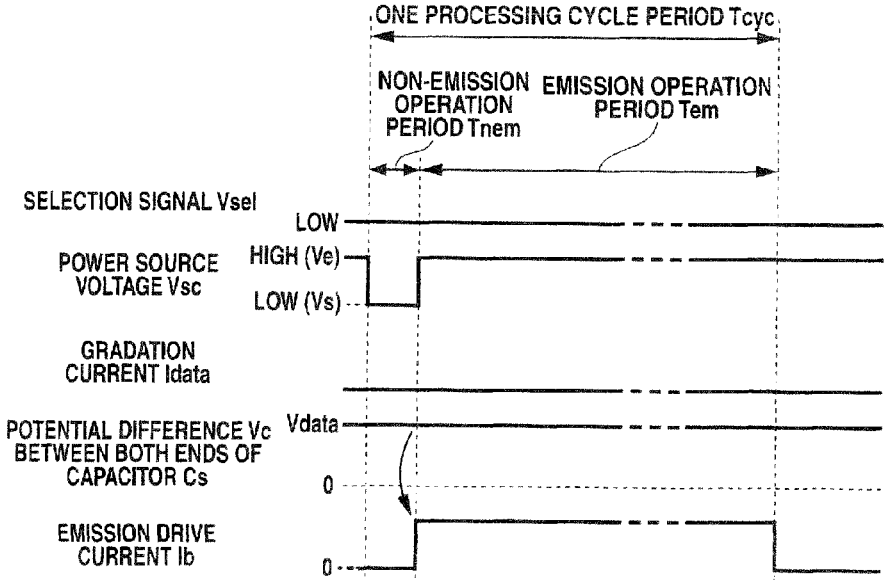
Figure 7A:
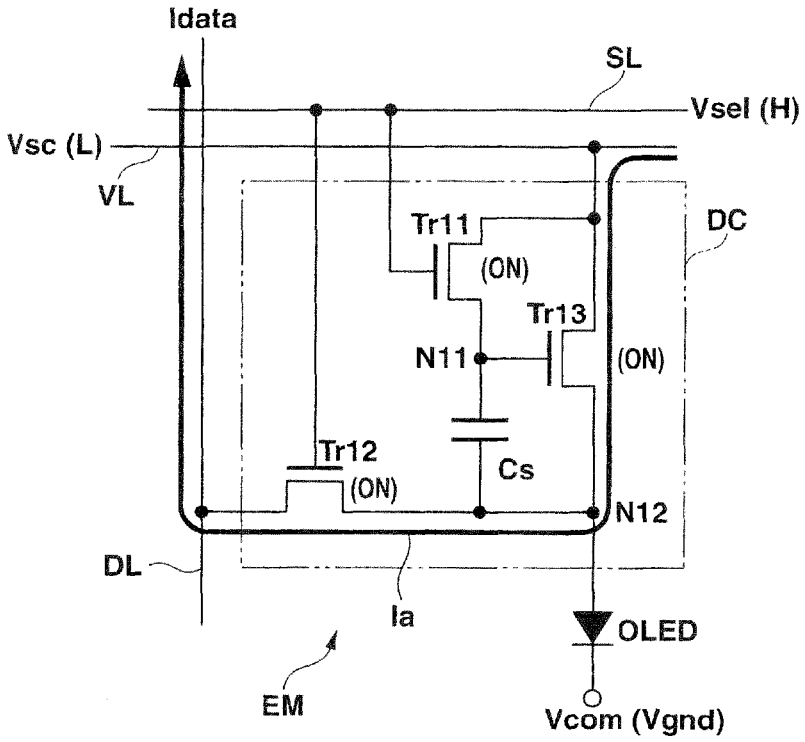
FIGS. 7A and 7B are conceptual diagrams showing a writing operation and an emission operation, respectively, of a display pixel according to the first embodiment.
Figure 7B:
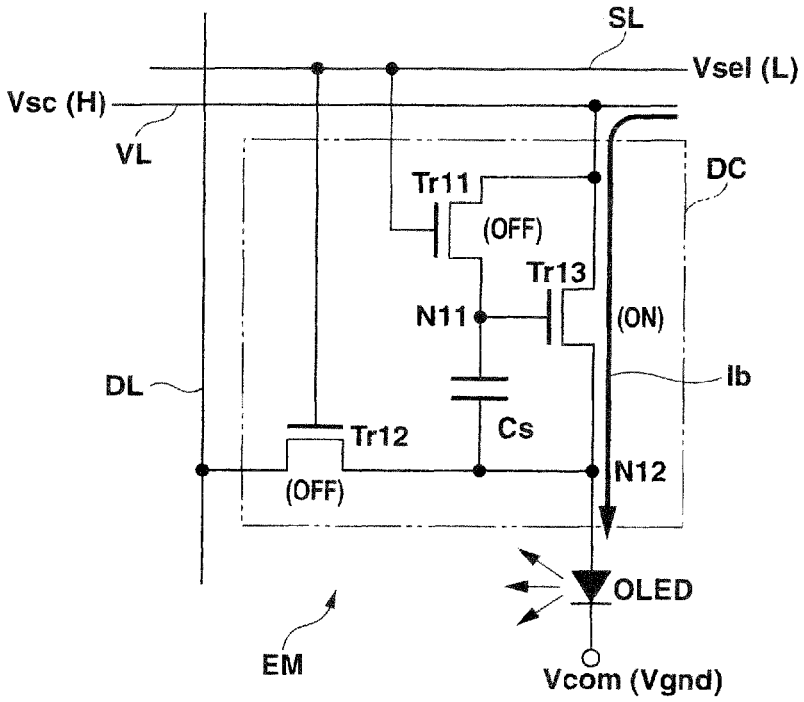
Figure 8:
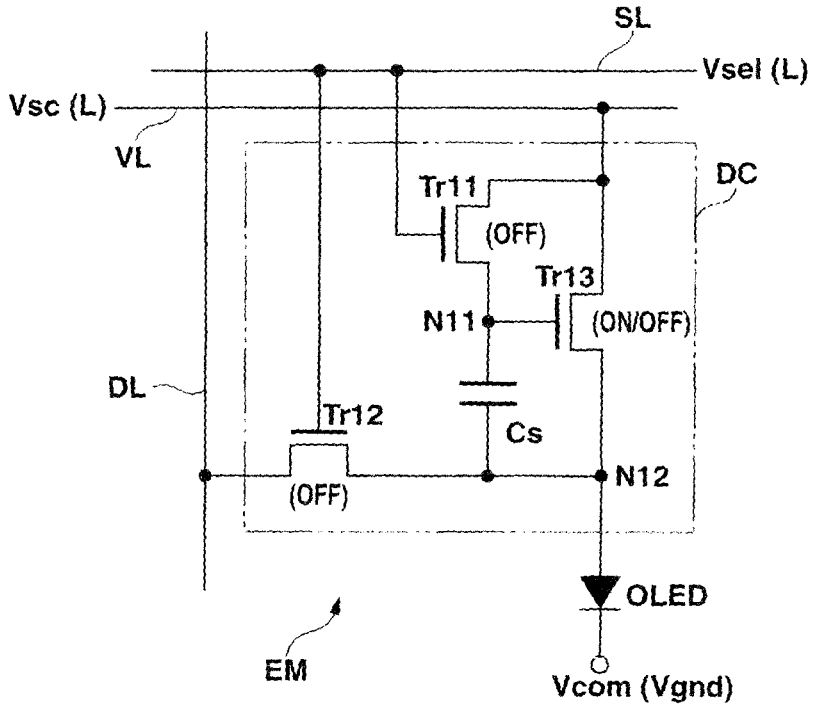
FIG. 8 is a conceptual diagram showing a non-emission operation of a display pixel according to the first embodiment.

FIGS. 6A and 6B are timing charts showing the basic operation of a display pixel applied to the display apparatus 100 according to the present embodiment. With FIGS. 6A and 6B, an operation description will be given with a specific display pixel EM watched among the display pixels EM two-dimensionally arranged (arranged in a matrix composed of n rows by m columns) in the display panel 110. Moreover, FIGS. 7A and 7B are conceptual diagrams showing a writing operation and an emission operation, respectively, of a display pixel according to the present embodiment, and FIG. 8 is a conceptual diagram showing a non-emission operation of the display pixel according to the present embodiment.

As shown in FIG. 6A, the emission drive control of the organic EL element OLED in the display pixel EM (the pixel drive circuit DC) applied to the present embodiment is schematically set to include a writing operation period Twrt and an emission operation period (display operation period) Tem in a predetermined one processing cycle period Tcyc (Tcyc≧Twrt+Tem). In the writing operation period Twrt, the display pixels EM connected to one of the selection lines SL is set to be in the selected state, and the gradation current Idata of a current value in accordance with display data is supplied to make a voltage component in accordance with the display data be held between the gate and source (capacitor Cs) of the transistor Tr13 for an emission drive provided in the pixel drive circuit DC. In the emission operation period Tem, an emission drive current Ib of a current value in accordance with the display data is made to flow through the organic EL element OLED on the basis of the voltage component held between the gate and source of the transistor Tr 13 in the writing operation period Twrt, and an emission operation with a predetermined luminous gradation is performed.

Moreover, in the present embodiment, the display pixels EM in the row (writing line) to which the writing operation is executed are set to be in the non-emission state, in which their organic EL elements OLED are made not to perform their emission operations, during the writing operation period Twrt as shown in FIG. 6A, and also the display pixels EM in a row (designated line) separated from the writing line by the predetermined number of rows are set to be in the non-emission state, in which their organic EL elements OLED are made not to perform their emission operations, during the writing operation period Twrt as shown in FIG. 6B.

Incidentally, the one processing cycle period Tcyc according to the present embodiment is set as, for example, a period required for one of the display pixels EM to display image information for one pixel in the image of one frame (one screen). That is, if the image of one frame is displayed in the display panel 110 including the plurality of display pixels EM two-dimensionally arranged in row directions and column directions, then the one processing cycle period Tcyc is set to be a period required for the display pixels EM for one row to display an image for one row in the image of one frame. The details thereof will be described with regard to a display drive method of the display apparatus, which will be described later.

(Writing Operation)

In a writing operation (writing operation period Twrt) into one of the display pixels EM, as shown in FIG. 6A, the selection driver 120 first applies the selection signal Vsel of the selection level (high level) to one of the selection lines SL to set the display pixel EM to be in its selected state, and the power source driver 130 applies the low level power source voltage Vsc (=Vs) to the power source line VL. Moreover, the data driver 140 supplies the gradation current Idata of the current value in accordance with display data to the corresponding data line DL in synchronization with the selection timing.

Hereby, the transistors Tr11 and Tr12 provided in the corresponding pixel drive circuit DC perform their on-operations. Then, the low level power source voltage Vsc is applied to the gate terminal (node N11; one end side of the capacitor Cs) of the transistor Tr13 through the transistor Tr11, and the source terminal (node N12; the other terminal side of the capacitor Cs) of the transistor Tr13 is electrically connected to the data line DL through the transistor Tr12.

In the present embodiment, the gradation current Idata supplied to the data line DL is set to a current value having a negative polarity or a positive polarity according to the luminous gradation value included in the display data written into each of the display pixels here. If the gradation current Idata is set to the current value of the negative polarity, then the gradation current Idata flows into the direction of the data driver 140 from the display pixel EM through the data line DL as if the gradation current Idata is pulled out (drawn in). On the other hand, if the gradation current Idata is set to the current value of the positive polarity, then the gradation current Idata flows from the data driver 140 to the direction of the display pixel EM through the data line DL as if the gradation current Idata is pushed in (inpoured). In the following description, the case where a current value of the negative polarity is set as the current value of the gradation current Idata and the gradation current Idata is drawn from the display pixel EM into the direction of the data driver 140 through the data line DL will be described as the basic operation of the display pixel EM.

By performing such an operation of supplying the gradation current Idata of the negative polarity current value to the data line DL and drawing the gradation current Idata from the side of the data line DL into the direction of the data driver 140, a voltage level of further lower potential than the low level power source voltage Vsc is applied to the source terminal (the node N12; the side of the other end of the capacitor Cs) of the transistor Tr13.

Consequently, a potential difference is generated between the nodes N11 and N12 (between the gate and source of the transistor Tr13), and then the transistor Tr13 is turned on. As shown in FIG. 7A, a writing current Ia corresponding to the gradation current Idata thus flows from the power source line VL to the direction of the data driver 140 through the transistor Tr13, the node N12, the transistor Tr12, and the data line DL.

At this time, electric charges corresponding to the potential difference generated between the nodes N11 and N12 (between the gate and source of the thin film transistor Tr13) are accumulated in the capacitor Cs, and are held as a voltage component (see the potential difference Vc between both the ends of the capacitor Cs in FIG. 6A). Moreover, the power source voltage Vsc (=Vs) of a voltage level equal to or less than the low potential common voltage Vcom (the ground potential Vgnd) is applied to the power source line VL, and the writing current Ia is controlled to flow into the direction of the data driver 140 through the data line DL. Consequently, the potential applied to the anode terminal (node N12) of the organic EL element OLED becomes lower than the potential (common voltage Vcom) of the cathode terminal thereof, and no currents flow through the organic EL element OLED and no emission operations are performed (non-emission operation).

(Emission Operation)

Next, in the emission operation (emission operation period Tem) after the completion of the writing operation period Twrt, as shown in FIG. 6A, the selection signal Vsel of a non-selection level (low level) is applied from the selection driver 120 to the selection line SL, and the display pixel EM is set to be in its non-selected state. Furthermore, the power source voltage Vsc (=Ve) of the high level is applied from the power source driver 130 to the power source line VL. Moreover, the supply of the gradation current Idata from the data driver 140 is broken in synchronization with the non-selection timing, and the operation of the drawing in the gradation current Idata is stopped.

Hereby, the transistors Tr11 and Tr12 provided in the pixel drive circuit DC are turned off, and the application of the power source voltage Vsc to the gate terminal (node N11; the side of one end of the capacitor Cs) of the transistor Tr13 is broken, and further the application of the voltage level caused by the drawing operation of the gradation current Idata into the source terminal (node N12; the side of the other end of the capacitor Cs) of the transistor Tr13 is broken. Consequently, the electric charges accumulated in the writing operation period Twrt are held in the capacitor Cs.

In this way, the potential difference between the nodes N11 and N12 (between the gate and source of the transistor Tr13; between both ends of the capacitor Cs) is held, and the transistor Tr13 keeps its on-state. Moreover, since the power source voltage Vsc of potential higher than the common voltage Vcom (ground potential Vgnd) is applied to the power source line VL, the potential applied to the anode terminal (node N12) of the organic EL element OLED becomes higher than the potential of the cathode terminal (ground potential).

Consequently, as shown in FIG. 7B, the predetermined emission drive current Ib flows from the power source line VL to the organic EL element OLED through the transistor Tr13 and the node N12 in the forward bias direction, and the organic EL element OLED performs its emission operation. The voltage component (the potential difference Vc between both the ends of the capacitors Cs) held by the capacitor Cs is equal to the potential difference in the case where the writing current Ia corresponding to the gradation current Idata flows through the transistor Tr13, and consequently the emission drive current Ib flowing through the organic EL element OLED has a current value substantially equal to the writing current Ia (Ib ≈Ia) here.

Hereby, the emission drive current Ib continuously flows through the transistor Tr13 during the emission operation period Tem on the basis of the voltage component corresponding to the display data (gradation current Idat) written in the writing operation period Twrt, and then the organic EL element OLED continues the operation of emitting a light with the luminous gradation in accordance with the display data.

(Non-Emitting Operation)

Moreover, in a non-emission operation executed in one of the display pixels EM in a row (designated line) separated by predetermined number of rows from the row (writing line) of the display pixels EM in which the writing operation is executed, as shown in FIG. 6B, the selection signal Vsel of the non-selection level (low level) is applied from the selection driver 120 to the selection line SL, and thereby the display pixel EM is set to be in the non-selected state, and the power source voltage Vsc (=Vs) of the low level is applied from the power source driver 130 shown in FIG. 4 to the power source line VL.

Hereby, the transistors Tr11 and Tr12 provided in the pixel drive circuit DC is turned off, and the application of the power source voltage Vsc to the gate terminal (the node N11; the side of the one end of the capacitor Cs) of the transistor Tr13 is broken, and also the electrical connection between the source terminal (the node N12; the side of the other end of the capacitor Cs) of the transistor Tr13 and the data line DL is broken. If the aforesaid emission operation has been executed just before, then the electric charges accumulated in the writing operation executed prior to the emission operation are held in the capacitor Cs here.

Consequently, the turning on and off of the transistor Tr13 is set on the basis of the potential difference held between the nodes N11 and N12 (between the gate and source of the transistor Tr13; between both the ends of the capacitor Cs), but the power source voltage Vsc (=Vs) of the low level (the ground potential Vgnd or less) is applied to the power source line VL regardless of the operation state of the transistor Tr13. Moreover, since the node N12 is set in the state of being broken from the data line DL, the potential applied to the anode terminal (node N12) of the organic EL element OLED is set to be equal to or less than the potential Vcom (common voltage Vcom; the ground potential Vgnd) of the cathode terminal thereof. Consequently, no currents flow through the organic EL element OLED, and no emission operations are performed (non-emission operation).

<Display Drive Method of Display Apparatus>

Next, the display drive method (the display operation of image information) of the display apparatus 100 according to the present embodiment will be described.

Figure 9:
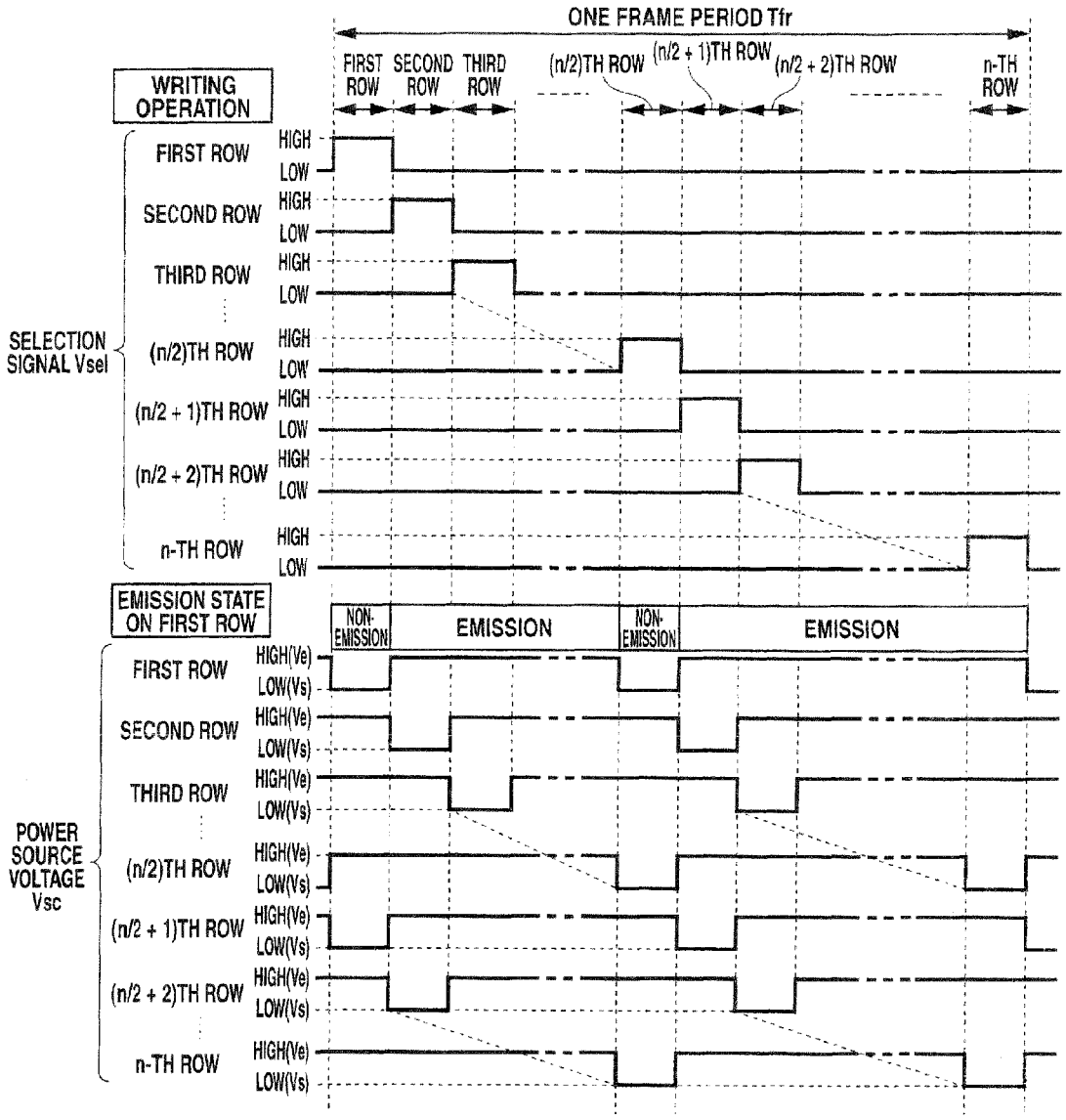
FIG. 9 is a timing chart showing an example of a display drive method of the display apparatus according to the first embodiment.

FIG. 9 is a timing chart showing an example of the display drive method of the display apparatus 100 according to the present embodiment, and FIGS. 10A-10J are operational conceptual diagrams for illustrating the display drive method of the display apparatus according to the present embodiment.

The display drive method of the display apparatus 100 according to the present embodiment sequentially repeats the operation of writing the gradation current Idata in accordance with display data into the display pixels EM (pixel drive circuits DC) in each of the rows arranged in the display panel 110 for all of the rows, and thereby makes the display pixels EM in the row (writing line) to which the writing operation is executed and the row (designated line) separated from the former row by the predetermined number of rows perform their non-emission operations, and makes the display pixels EM in the other rows perform their emission operations with predetermined luminous gradations in accordance with the already written display data (gradation currents Idata). Thereby, the display drive method displays the image information for one screen of the display panel 110.

To put it concretely, as shown in FIG. 9, the display drive method according to the present embodiment applies the selection signal Vsel of the selection level (high level) from the selection driver 120 to the selection line SL of a specific row (for example, i-th row; $1 \leqq i \leqq n$) of the display panel 110 in one scanning period (writing operation period Twrt) in one frame period Tfr as shown in FIG. 6A, and thereby sets the display pixels EM in the i-th row to be in their selected states.

The gradation current Idata of a current value in accordance with display data is supplied from the data driver 140 to each of the data lines DL in synchronization with the selection timing, and thereby the voltage component in accordance with the gradation current Idata is held (electric charges are accumulated) between the gate and source terminals (between both the ends of the capacitor Cs) of the transistor Tr13 provided in the pixel drive circuit DC of each of the display pixels EM in the i-th row.

In the writing operation period Twrt to the display pixels EM in the i-th row, the low level power source voltage Vsc (=Vs) is applied to the power source line VL in the i-th row, to which the writing operation is performed, and the power source line VL in the (n/2+i)th row, separated from the i-th row by the predetermined number of rows (for example, (n/2−1) rows), by the power source driver 130 shown in FIG. 4, as shown in FIGS. 6A and 6B, and thereby no currents flow through the organic EL elements OLED in the display pixels EM in the i-th row and (n/2+i)th row here. Consequently, the organic EL elements OLED are set to be in their non-emission states. Incidentally, at this time, the selection signal Vsel of the non-selection level (low level) is applied to the display pixels EM in the (n/2+i)th row separated from the i-th row, in which the writing operation is executed, by the predetermined number of rows (for example, (n/2−1) rows), and the display pixels EM are set to be in the non-selected state as shown in FIG. 6B.

Next, in the emission operation period Tem after the end of the writing operation period Twrt, as shown in FIG. 6A, the selection signal Vsel of the non-selection level (low level) is applied from the selection driver 120 to the selection line SL in the i-th row, and thereby the respective display pixels EM in the i-th row are set to be in their non-selected states. Moreover, the supply of the gradation current Idata from the data driver 140 to each of the data lines DL is broken.

Then, the high level power source voltage Vsc (=Ve) is applied from the power source driver 130 to the power source line VL in the i-th row in synchronization with this timing, and thereby the emission drive current Ib in accordance with the display data (gradation current Idata) is supplied to the organic EL element OLED on the basis of the voltage component charged in each of the display pixels EM (between the gate and source of the transistor Tr13 for an emission drive) in the i-th row, and an emission operation is performed with a predetermined luminous gradation.

Moreover, at this time, the high level power source voltage Vsc (=Ve) is applied to the power source line VL in the (n/2+i)th row, separated from the i-th row, in which the emission operation is performed, by the predetermined number of rows (for example, (n/2−1) rows) by the power source driver 130 shown in FIG. 4, as shown in FIG. 6B, and thereby the organic EL element OLED performs an emission operation with the luminous gradation in accordance with the display data (gradation current Idata) on the basis of the voltage component charged in each of the display pixels EM (between the gate and source of the transistor Tr13 for an emission drive) if the wiring operation in the (n/2+i)th row has been ended already.

Such an emission operation continues to be executed in the i-th row until the starting timing of the next writing operation or until the starting timing of the non-emission operation executed in synchronization with the writing operation. That is, if n rows of display pixels EM are arranged in the display panel 110, then in one frame period Tfr, for example, the display pixels EM in the first row are set in their non-emission states together with the display pixels EM in the (n/2+1)th row by the application of the low level power source voltage Vsc (=Vs) from the power source driver 130 to the power source lines VL in the first row and the (n/2+1)th row during the writing operation period Twrt into the display pixels EM in the first row and the (n/2+1)th row. In the other periods, the high level power source voltage Vsc (=Ve) is applied from the power source driver 130 to the display pixels EM, and the display pixels EM are set to be in their emission states.

Then, such a display drive operation is sequentially repeatedly executed to all of the rows of the display panel 110, and the writing operations and the emission operations are set so that the writing operations of the display pixels EM in the respective rows may not overlap one another in terms of time and so that the emission operations of the display pixels EM in the respective rows may partially overlap one another in terms of time. Thereby, as shown in the operational conceptual diagrams of FIGS. 10A-10E, the row (writing line) in which the writing operation is executed and the row (designated line) separated from the former row by the predetermined number of rows are set in their non-emission states, and the writing line and designated line, which are set into the non-emission states, are controlled so as to move downward in the display region, which is set to be in its emission state, in the display panel 110 with a fixed interval kept as the writing operations sequentially move to the next rows (see FIGS. 10A-10E). Moreover, when the writing line, into which the writing operation is executed, reaches the n/2th row and the designated line reaches the (n/2+1)th row as shown in FIG. 10E before the execution of the next writing operation, the designated line and the writing line are controlled so that the designated line may move to the first row of the display panel 110 and the writing operation may sequentially move to the next row as shown in FIG. 10F. The designated line thereby moves downward with an interval to the writing line kept (see FIGS. 10F-10J).

According to such a display drive method of a display apparatus, in a period in which a writing operation is executed to the display pixels in a writing line and in a period in which a row is set as the designated line, the display pixels (emission elements) in the writing line and designated line do not perform their emission operations to be set in their non-emission states (non-display states), and consequently a false impulse type display drive control for performing an emission operation with a luminous gradation in accordance with display data only in a certain period of one frame period can be realized.

In particular, by the display drive method according to the present embodiment, if a frame frequency at the time of displaying image information in a display region of the display panel 110 is denoted by, for example, "f," then the frequency by which the non-emission regions set as the writing line and the designated line move in the display region set as the emission state becomes equal to "2f," which is twice as large as the "f." Consequently, even if the frame frequency is set within a range from a high value equal to or higher than 60 Hz, which is general value, to a low value about 30 Hz, the frequency of the changes of light and darkness of the image information displayed in the display region can be substantially high, and consequently an image display in which flickers are hard to recognize even at a low frame frequency can be realized. Moreover, the frame frequency can be set to be lower, and the power consumption of a driver (display drive apparatus) applied to the display apparatus can be reduced. Furthermore, the cost of the driver can be reduced, and the driver can be made to be comparatively small. Thus, the degree of freedom of the specifications of the display panel can be improved.

Incidentally, in the present embodiment, the number of rows of the separation of the designated line from the writing line and the number of rows of the separation of the writing line from the designated line in the column direction are set to be the same n/2−1, and in this case, the frequency of the movement of the non-emission regions, set as the writing line and the designated line, in the display region, set to be in the emission state, is accurately twice as large as the frame frequency, thereby the effect mentioned above can be generated most effectively. However, as long as the number of rows of the separation of the designated line from the writing line and the number of rows of the separation of the writing line from the designated line in the column direction are the ones approximate to n/2−1, a nearly similar effect can be produced even if the numbers of rows are not quite the same ones mutually, and the numbers of rows to be separated may be the ones approximate to n/2−1.

<Second Embodiment>

Next, a second embodiment of the display apparatus according to the present invention will be described.

In regard to the aforesaid first embodiment, the description has been given to the case where, when a writing operation into the display pixels in each row of the display panel is executed, the display pixels in a row (designated line) separated from the row (writing line) into which the writing operation is executed by the predetermined number of rows are set to be in their non-emission states together with the writing line. In the second embodiment, a display panel is grouped every display pixels in a plurality of continuous rows, and the writing operation into each row is executed by the group. Furthermore, the second embodiment controls the display pixels in the group (hereinafter referred to as "designated group" for descriptive purposes) separated from the group (hereinafter referred to as "writing group" for descriptive purposes) including the rows (writing lines) into which the writing operation is executed by the predetermined number of groups so as to set the display pixels to be in their non-emission states together with those of the writing group.

<Display Apparatus>

First, a schematic configuration of a display apparatus according to the present embodiment will be described with reference to the attached drawings.

Figure 11:
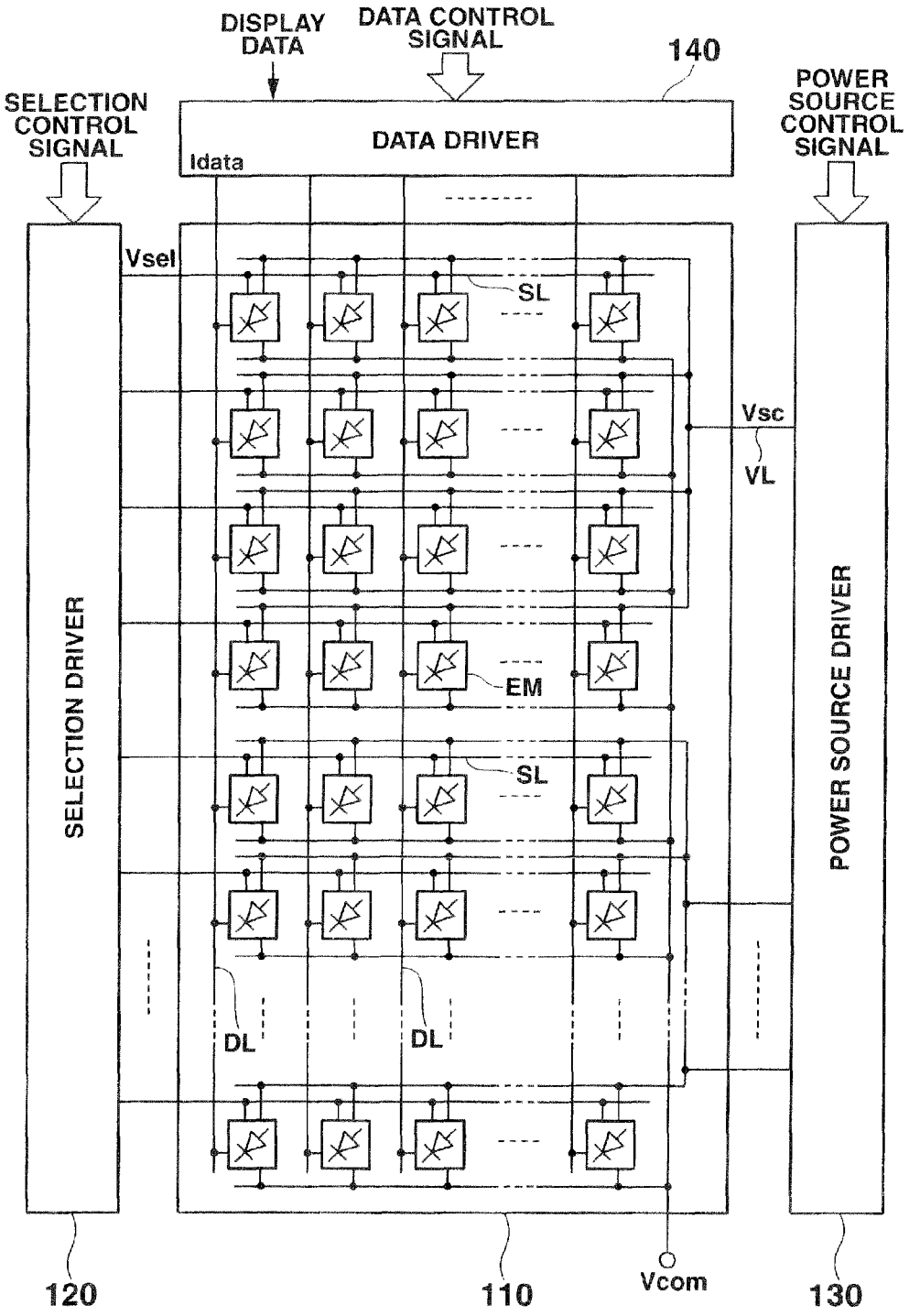
FIG. 11 is a diagram of the configuration of the principal part showing an example of a display panel and peripheral circuitry (a selection driver, a data driver, and a power source driver) applied to a display apparatus according to a second embodiment.

FIG. 11 is a diagram of the configuration of the principal part showing the examples of a display panel and the peripheral circuitry thereof (a selection driver, a data driver, and a power source driver) applied to a display apparatus according to a second embodiment. The components equal to those of the first embodiment mentioned above are denoted by the same marks as those of the first embodiment, and their descriptions are simplified or omitted.

As shown in FIG. 11, in the display apparatus 100 according to the present embodiment, the plurality of display pixels EM arranged in two dimensions in the row direction and column direction of the display panel 110 are grouped every arbitrary plural rows in advance. As shown in a display drive method described below, the display pixels EM in the region (writing region) corresponding to all the rows included in a group (writing group) including a row (writing line) into which the writing operation is executed are controlled to be set to be in their non-display states (non-emission states), and the display pixels EM in the region (designated region) corresponding to all of the rows included in a group (designated group) separated by the predetermined number of groups except the groups adjoining the group including the row into which the writing operation is executed are controlled to be set to be in their non-display states (non-emission states) and the display pixels EM in all of the rows included in the other groups (to which the writing operation has been already ended) are controlled to be set to be in their display states (emission states), in synchronization with the writing operation.

The display states (emission states) or non-display states (non-emission states) of the display pixels EM included in each group are set by switching the power source voltage Vsc supplied to the display pixels EM in all the rows included in each group to a predetermined display level or non-display level, or by performing on (supply) control or off (break) control of the power source voltage Vsc here. Accordingly, in the display panel 110 applied to the present embodiment, in order to group the display pixels EM, for example, every continuous several rows to several tens rows, a single power source line VL is arranged to be branched so as to correspond to all the rows in a group, and the power source voltage Vsc output from the power source driver 130 (output circuit section 132) described below is commonly applied to all the display pixels EM in the group at the same time.

Moreover, the selection driver 120 applied to the present embodiment sequentially applies the selection signal Vsel to the selection line SL of each row in each group and thereby sequentially sets the display pixels EM in each row in the group to be in their selected states to the display pixels EM in every plurality of rows grouped in advance of the display panel 110, and further executes similar operations to each group and thereby sequentially sets all of the display pixels EM arranged in the display panel 110 to be in their selected state every row as a result.

Figure 12:
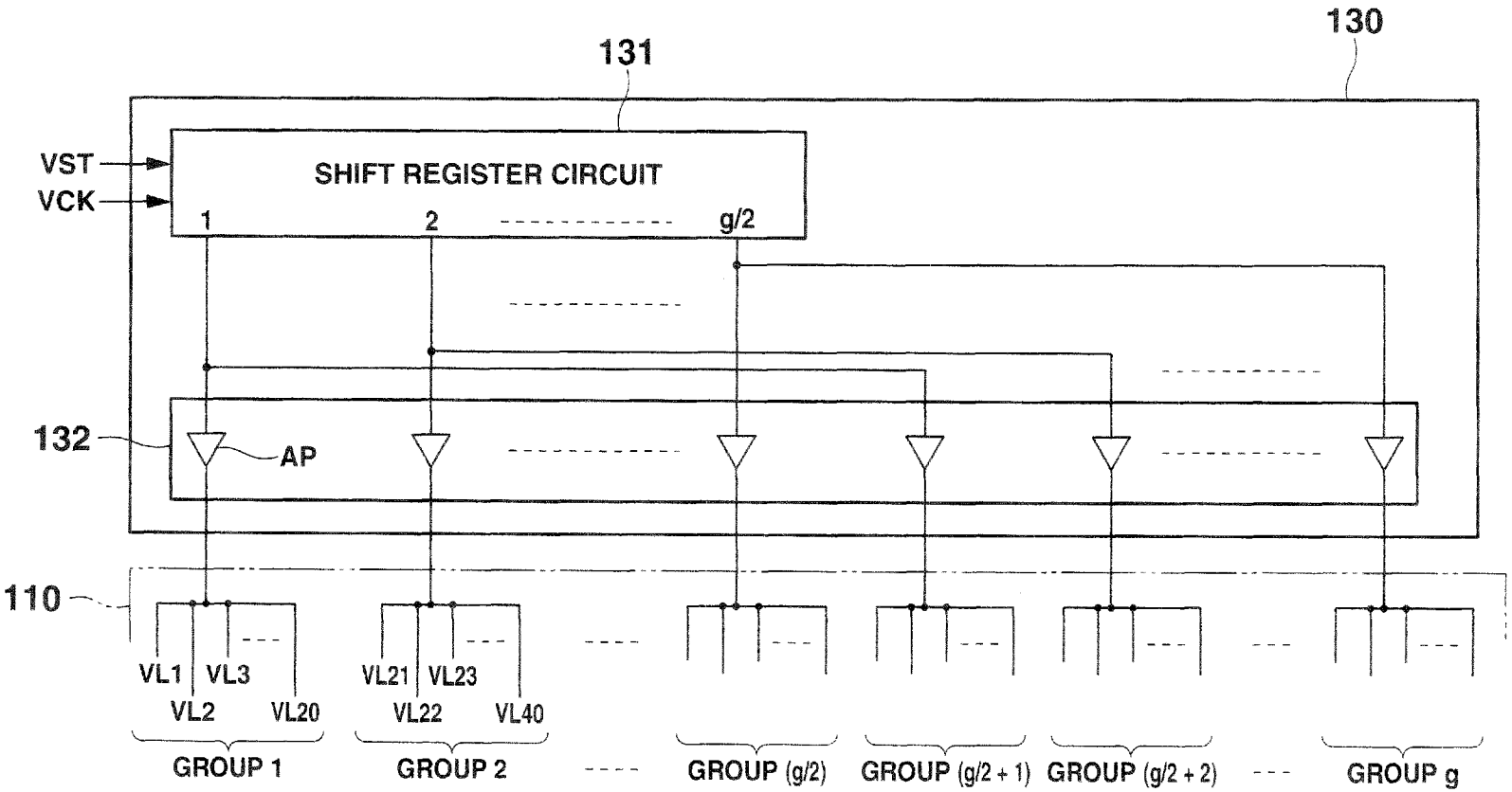
FIG. 12 is a schematic configuration diagram showing an example of a power source driver applied to the display apparatus according to the second embodiment.

FIG. 12 is a schematic configuration diagram showing an example of the power source driver 130 applied to the display apparatus 100 according to the present embodiment. Hereupon, the description will be given to the case where the display pixels EM arranged in the display panel 110 are grouped, for example, every 20 rows and g sets of the groups are set. Here g indicates an integer within a range of $1<g<n$, and it is supposed that each group is branched into at least two or more power source lines VL and that the display panel 110 is divided into two or more groups.

To each group in the display panel 110 the power source driver 130 sequentially executes the operation of simultaneously applying the low level power source voltage Vsc (=Vs) to the display pixels EM in a group (writing group) including the rows set to be in their selected states by the selection driver 120 for the writing operation of display data among the plurality of display pixels EM two-dimensionally arranged in the display panel 110 and the display pixels EM in the group (designated region) separated by the predetermined number of groups other than the groups adjoining the group including the rows into which the writing operation is executed, through the power source lines VL arranged to be branched into each group.

Hereby, the low level power source voltage Vsc (=Vs) is applied to all of the display pixels EM in the group (writing group) including the row into which the writing operation is being executed and all of the display pixels EM included in the separated group other than the groups adjoining the writing group through the each of the power source lines VL arranged to be branched, and the display pixels EM are set to be in their non-emission states (non-display states). The high level power source voltage Vsc (=Ve) is applied to the display pixels EM in the other groups (the writing operation into all of the rows of which has ended) through each of the power source lines VL arranged to be branched correspondingly to each group, and the display pixels EM are set to be in their emission states (gradation display states).

The power source driver 130 includes a shift register circuit 131 and an output circuit section (output buffer) 132 similarly to the aforesaid first embodiment here. In particular, in the present embodiment, in order to simultaneously apply the low level power source voltage Vsc (=Vs) to the display pixels EM in each row included in the same group and the display pixels EM in each row included in the group separated from the group (writing group), the shift register circuit 131 includes, for example, as shown in FIG. 12, a number (g/2) of output terminals of shift signals, which number is equal to a half of the total number (g) of the groups arranged in the display panel 110, and the output circuit section 132 includes g amplifiers AP correspondingly to each group to be configured so that each shift signal output from the shift register circuit 131 may input into the respective amplifiers AP corresponding to a z-th group and a (g/2+z)th group through branched signal lines, and that the input signals may be amplified to predetermined voltage values (may be converted into the voltage levels) to be applied to each of the power source lines VL in the z-th group and the (g/2+z)th group at the same time. The letter z indicates an integer within a range from 1 to g/2 here. Moreover, the output circuit section 132 is provided with switching sections to output the output voltage (power source voltage Vsc) of each of the amplifiers AP to the power source line VL in each group on the basis of the power source control signal (output control signal VOE), although the illustration of the switching sections is omitted.

That is, a first sift signal output from the shift register circuit 131 is input into the amplifiers AP corresponding to first and (g/2+1)th groups; a second shift signal is input into the amplifiers AP corresponding to second and (g/2+2)th groups; a third shift signal is input into the amplifiers AP corresponding to third and (g/2+3)th groups; . . . ; an z-th shift signal is input into the amplifiers AP corresponding to z-th and (n/2+z)th groups; . . . ; and an g/2th shift signal is input into the amplifiers AP corresponding to g/2th and g (=g/2+g/2)th groups.

Incidentally, FIG. 12 shows the configuration of the power source driver 130 in the case where the low level power source voltage Vsc (=Vs) is applied to the display pixels EM in a group (designated group) separated by (g/2−1) groups from the group (writing group) including a row into which a writing operation of display data is executed, but the present invention is not restricted to the configuration. The configuration of applying the low level power source voltage Vsc to the display pixels EM in a group (designated group) separated by the number of groups other than the (g/2−1) may be used as long as the designated group is not the adjoining group (the (z−1)th and (z+1)th groups in the case where the writing group is the z-th group).

Moreover, with reference to FIGS. 11 and 12, the description has been given to the case where the power voltage Vsc generated by the power source driver 130 correspondingly to each of the groups set in the display panel 110 is simultaneously applied to the display pixels EM in all the rows included in each group through the power source lines VL arranged to be branched in the display panel 110, but the present invention is not restricted to this case. The present invention may use the configuration in which the outputs (power source voltage Vsc) of the amplifiers AP provided correspondingly to each group are simultaneously applied to the display pixels EM in all rows included in each group through the signal lines branched correspondingly to each row of the display panel 110 in the power source driver 130 to be connected to the power source line VL of each row.

In the former configuration shown in FIGS. 11 and 12, the display panel 110 and the power source driver 130 can be connected with each other by the group here, and consequently the number of connection terminals of both of them can be greatly reduced. Thereby, the power source driver applicable to a miniaturized and highly-fined display panel can be provided. On the other hand, in the latter configuration mentioned above, the display panel 110 and the power source driver 130 can be connected to each other by the row, and consequently it is unnecessary to change the wiring design and the like in the display panel 110. Thereby, the power source driver applicable to the existing display panel 110 as it is can be provided.

<Display Drive Method of Display Apparatus>

Next, a display drive method (a display operation of image information) of the display apparatus 100 according to the present embodiment will be described.

Figure 13:
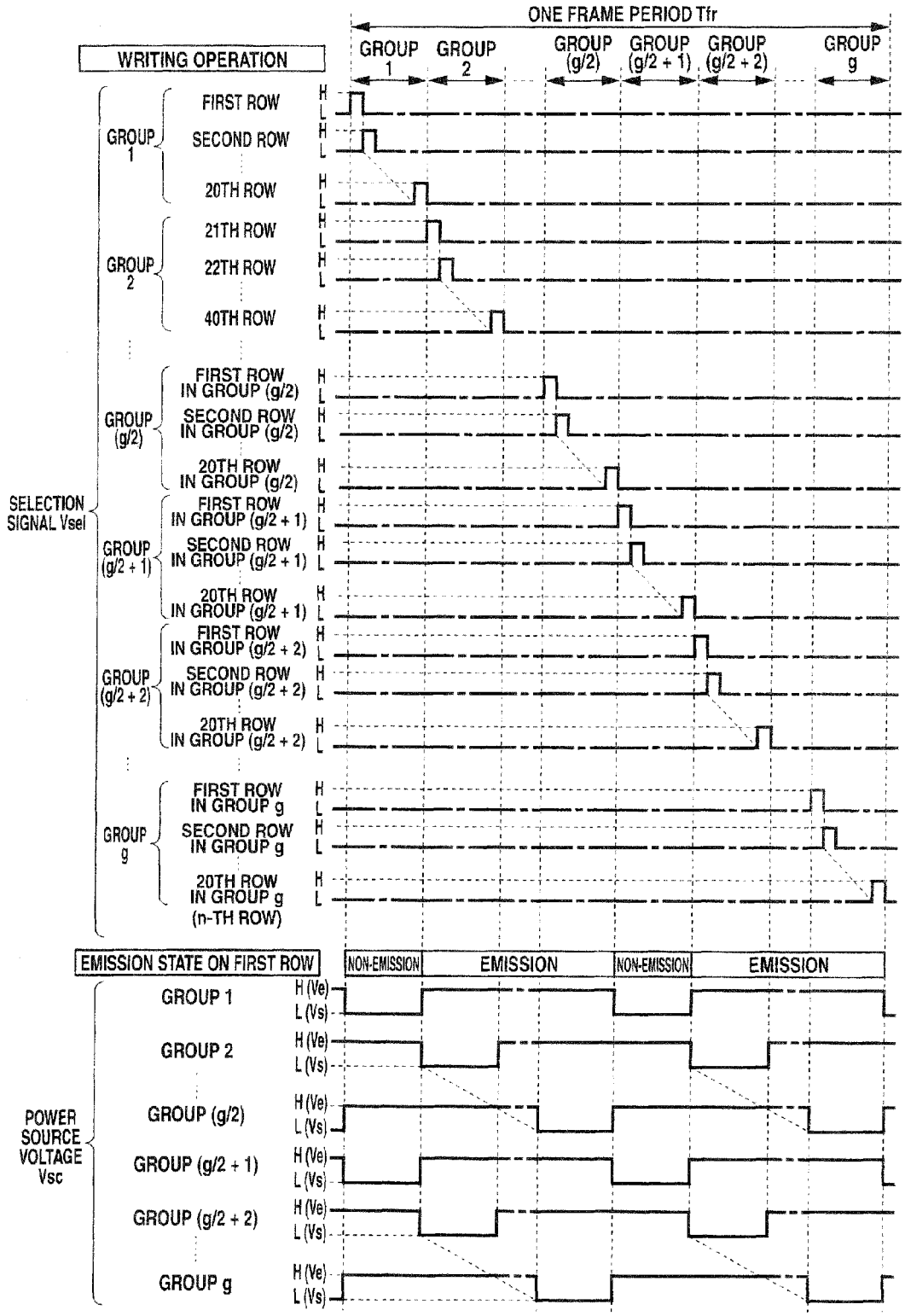
FIG. 13 is a timing chart showing an example of a display drive method of the display apparatus according to the second embodiment.

FIG. 13 is a timing chart showing an example of the display drive method of the display apparatus 100 according to the present embodiment, and FIGS. 14A-14H are operational conceptual diagrams for illustrating the display drive method of the display apparatus 100 according to the present embodiment.

The display drive method of the display apparatus 100 according to the present embodiment sequentially repeats the operation of writing the gradation current Idata in accordance with display data into the display pixels EM (pixel drive circuits DC) in each of the rows arranged in the display panel 110 for all of the rows, and thereby makes the display pixels EM in all of the rows in a group (writing group) including a row to which the writing operation is executed and the separated group (designated group) other than the groups adjoining the writing group perform their non-emission operations, and makes the display pixels EM in the other rows perform their emission operations with predetermined luminous gradations in accordance with the already written display data (gradation currents Idata). Thereby, the display drive method displays the image information for one screen of the display panel 110.

To put it concretely, as shown in FIG. 13, the display drive method according to the present embodiment applies the selection signal Vsel of the selection level (high level) from the selection driver 120 to the selection line SL of a specific row (for example, i-th row; 1≦i≦n) of the display panel 110 in one scanning period (writing operation period Twrt) in one frame period Tfr as shown in FIG. 6A, and thereby sets the display pixels EM in the i-th row to be in their selected states.

The gradation current Idata of a current value in accordance with display data is supplied from the data driver 140 to each of the data lines DL in synchronization with the selection timing, and thereby the voltage component in accordance with the gradation current Idata is held (electric charges are accumulated) between the gate and source terminals (between both the ends of the capacitor Cs) of the transistor Tr13 provided in the pixel drive circuit DC of each of the display pixels EM in the i-th row.

In the writing operation period Twrt to the display pixels EM in the i-th row, the low level power source voltage Vsc (=Vs) is applied to all of the power source lines VL in the group (writing group) including the power source line VL in the i-th row, to which the writing operation is being performed, and all of the power source lines VL in the group (designated group) (g/2+z), separated from the writing group z by the predetermined number of groups (for example, (g/2−1) groups) by the power source driver 130 shown in FIG. 12, and thereby no currents flow through the organic EL elements OLED in the display pixels EM in the group z and group (g/2+z) here. Consequently, the organic EL elements OLED are set to be in their non-emission states. Incidentally, at this time, the selection signal Vsel of the non-selection level (low level) is applied to the display pixels EM in the group (g/2+z) as shown in FIG. 13, and the display pixels EM are set to be in their non-selected states.

Next, in the emission operation period Tem after the end of the writing operation period Twrt, as shown in FIG. 13, the selection signal Vsel of the non-selection level (low level) is applied from the selection driver 120 to the selection line SL in the i-th row, and thereby the respective display pixels EM in the i-th row are set to be in their non-selected states. Moreover, the supply of the gradation current Idata from the data driver 140 to each of the data lines DL is broken. Such a writing operation to the display pixels EM in each row is repeatedly executed to all of the rows in the group (writing group) z in order, and the writing operation to each row is executed not to overlap with each other in terms of time.

Then, the high level power source voltage Vsc (=Ve) is applied from the power source driver 130 shown in FIG. 12 to the power source lines VL in the writing group z and all of the power source lines VL in the designated group (g/2+z) separated from the writing group in synchronization with the timing at which the writing operation has ended to all of the rows in the writing group z, and thereby the emission drive current Ib in accordance with the display data (gradation current Idata) is supplied to the organic EL element OLED on the basis of the voltage component charged in each of the display pixels EM (between the gate and source of the transistor Tr13 for an emission drive) in all of the rows in the writing group z and the designated group (g/2+z), and an emission operation is performed with a predetermined luminous gradation.

Such an emission operation continues to be executed in the group z including the i-th row until the starting timing of the next writing operation or the non-emission operation executed in synchronization with the writing operation. That is, if n rows of display pixels EM are arranged in the display panel 110 and, for example, g groups are set to severally include 20 rows, then in one frame period Tfr, in a period in which the writing operation is being executed into the display pixels EM in any one of the first to twentieth rows in a group 1, the low level power source voltage Vsc (=Vs) is simultaneously applied from the power source driver 130 shown in FIG. 12 to the power source lines VL in the group 1 and the group (g/2+1), and the display pixels EM are set in their non-emission states. In the other periods, the high level power source voltage Vsc (=Ve) is applied from the power source driver 130 to the display pixels EM, and the display pixels EM are set to be in their emission states on the basis of the display data (gradation current Idata) written in each of the display pixels EM.

Figures 14A, 14B, 14C, 14D, 14E, 14F, 14G, 14H:
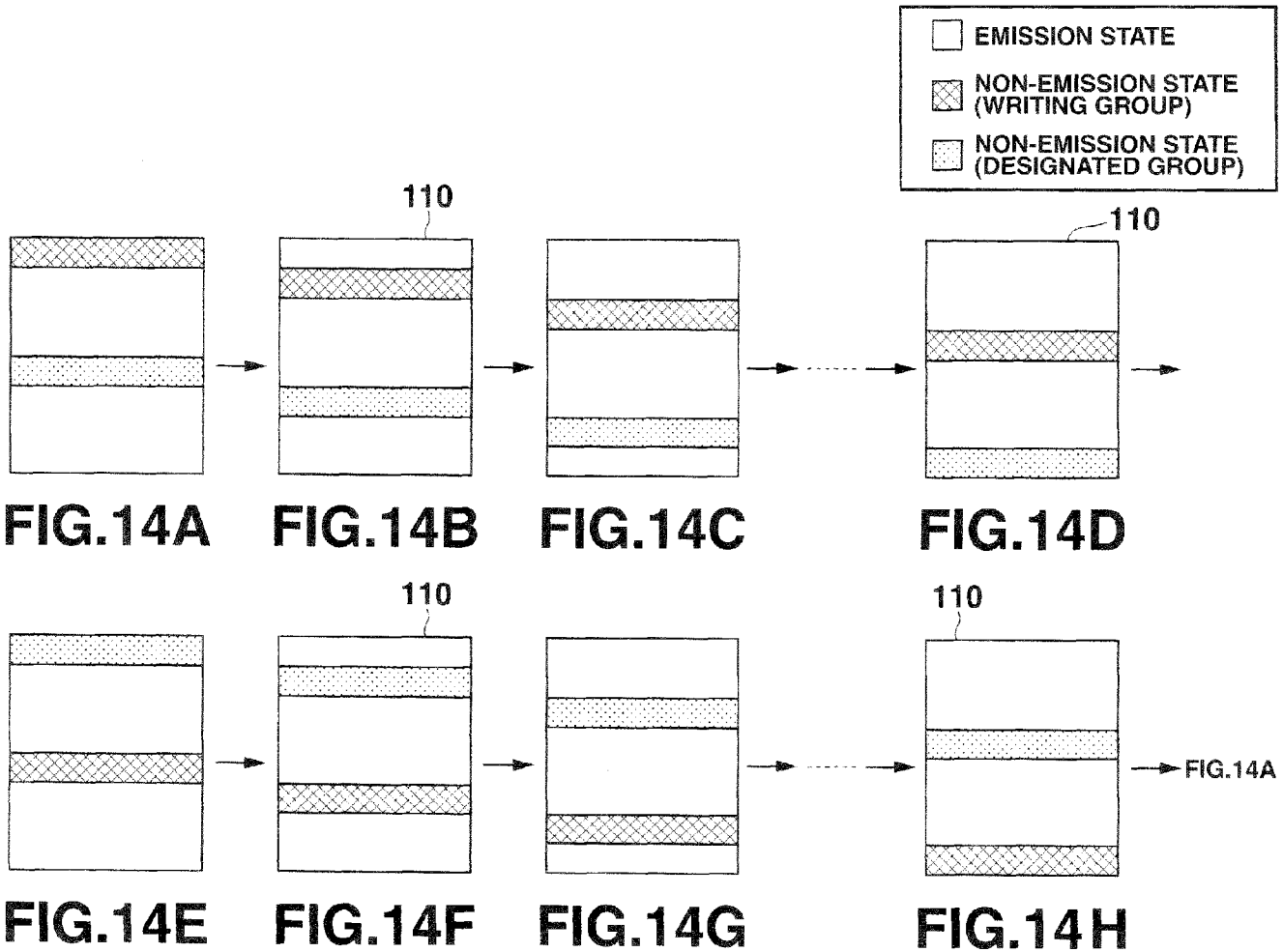
FIGS. 14A, 14B, 14C, 14D, 14E, 14F, 14G, and 14H are operational conceptual diagram for illustrating the display drive method of the display apparatus according to the second embodiment.

Then, such a display drive operation is repeatedly executed to all of the rows of the display panel 110 in order by the previously set group, and the writing operations and the emission operations are set so that the writing operations of the display pixels EM in the respective rows may not overlap one another in terms of time and so that the emission operations of the display pixels EM in the respective rows may partially overlap one another in terms of time. Thereby, as shown in the operational conceptual diagrams of FIGS. 14A-14D, the writing group including a row in which the writing operation is executed and the designated group separated from the writing group by the predetermined number of groups are set in their non-emission states, and the writing group and designated group, which are set into the non-emission states, are controlled so as to move downward in the display region, which is set to be in its emission state, in the display panel 110 with a fixed interval (positional relation) be kept as the writing operation sequentially moves to the next row and the group including the row moves (see FIGS. 14A-14D). Moreover, when the writing operation (writing group) reaches the group g/2 and the designated group reaches the group g as shown in FIG. 14D before the execution of the writing operation into the group (g/2+1), the designated group and the writing group are controlled so that the designated group may move to the group 1 of the display panel 110 and moves downward with the interval from the writing group kept as the writing operation may sequentially move to the next group as shown in FIG. 14E (see FIGS. 14E-14H).

According to such a display drive method of a display apparatus, in a period in which a writing operation is executed to the display pixels EM in each row in a writing group and in a period in which a group is set as the designated group, the display pixels (emission elements) EM included in the writing group and designated group do not perform their emission operations to be set in their non-emission states (non-display states), and consequently a false impulse type display drive control for performing an emission operation with a luminous gradation in accordance with display data only in a certain period of one frame period can be realized.

In particular, by the display drive method according to the present embodiment, even if a frame frequency at the time of displaying image information in the display region of the display panel 110 is set at a comparatively low value, an image display in which flickers are hard to recognize can be realized similarly to the first embodiment mentioned above. To put it concretely, if a display pixel equipped with a pixel drive circuit as shown in the present embodiment (see FIG. 3 and FIGS. 6A-8) is applied, and a plurality of display pixels of a display panel is grouped every plurality of rows, and further a power source voltage applied to a power source line is controlled every group, then each group is set to be in its non-emission state at the time of a writing operation, and is set to be in its emission state in the other periods.

That is, the group (writing group) including a row into which a writing operation is being performed becomes the non-emission region, and the writing operation is sequentially executed into each row. Consequently, a non-emission region having a certain width in accordance with the number of rows included in each group sequentially moves from the top to the bottom of the display panel 110 at predetermined timing. The organic EL element has a high speed response characteristic to the on (high level; Vs) and off (low level; Vs) control of the power source voltage here, and consequently the non-emission region is displayed in a complete black level.

Consequently, if the number of rows included in each group is made to be larger to widen the width of the non-emission region, or if the frame frequency is lowered in order to reduce the production cost or in order to reduce power consumption, then the periodical changes of brightness (flicker) becomes easy to recognize visually in comparison with the case the display drive method in which the writing operation is executed to each row and the writing line is set to be in the non-emission state.

Accordingly, the present embodiment controls the display drive operation so that the low level power source voltage is simultaneously applied to the power source lines arranged in a group (writing group) including a row into which the writing operation is executed and a separated group (designated group) that does not adjoin the writing group so as to set the display pixels EM in the groups into their non-emission states, and so as to perform a scan, for example, from the top to the bottom of the display panel 110 with the positional relation between the groups kept.

At this time, if the frame frequency at the time of displaying image information in the display region of the display panel 110 is set to, for example, "f," then the frequency of the movements of the non-emission regions set as the writing group and the designated group in the display region is equal to "2f," which is twice as large as the frame frequency "f." Accordingly, it is possible to set the frequency of the changes of light and darkness to be substantially high by the insertion of the non-emission region of the designated group into the image information (emission region) displayed in the display region even if the frame frequency is set to a lower value about 30 Hz than a general high value of 60 Hz or more, and consequently an image display in which flickers are difficult to recognize even at a lower frame frequency can be realized. Moreover, hereby, the power consumption of the driver (display drive apparatus) applied to the display apparatus can be reduced, and the cost thereof can be reduced. Moreover, the driver can be made to be comparatively small, and the degree of freedom of the specifications of the display panel can be improved.

<Third Embodiment>

Next, a third embodiment of the display apparatus according to the present invention will be described.

In regard to the aforesaid first embodiment, the description has been given to the case where, when a writing operation into the display pixels in each row of the display panel is executed, the display pixels in a row (designated line) separated from the row (writing line) into which the writing operation is executed by the predetermined number of rows are set to be in their non-emission states together with those in the writing line. In this case, although the description has been given to the case where the rows set to be as the non-emission states are two rows of the writing line and the designated line separated from the writing line by the predetermined number of rows, but the third embodiment controls so as to set a plurality of rows separated from each other by the predetermined number of rows as the designated lines in addition to the row separated from a writing line by the predetermined number of rows.

Figure 15:
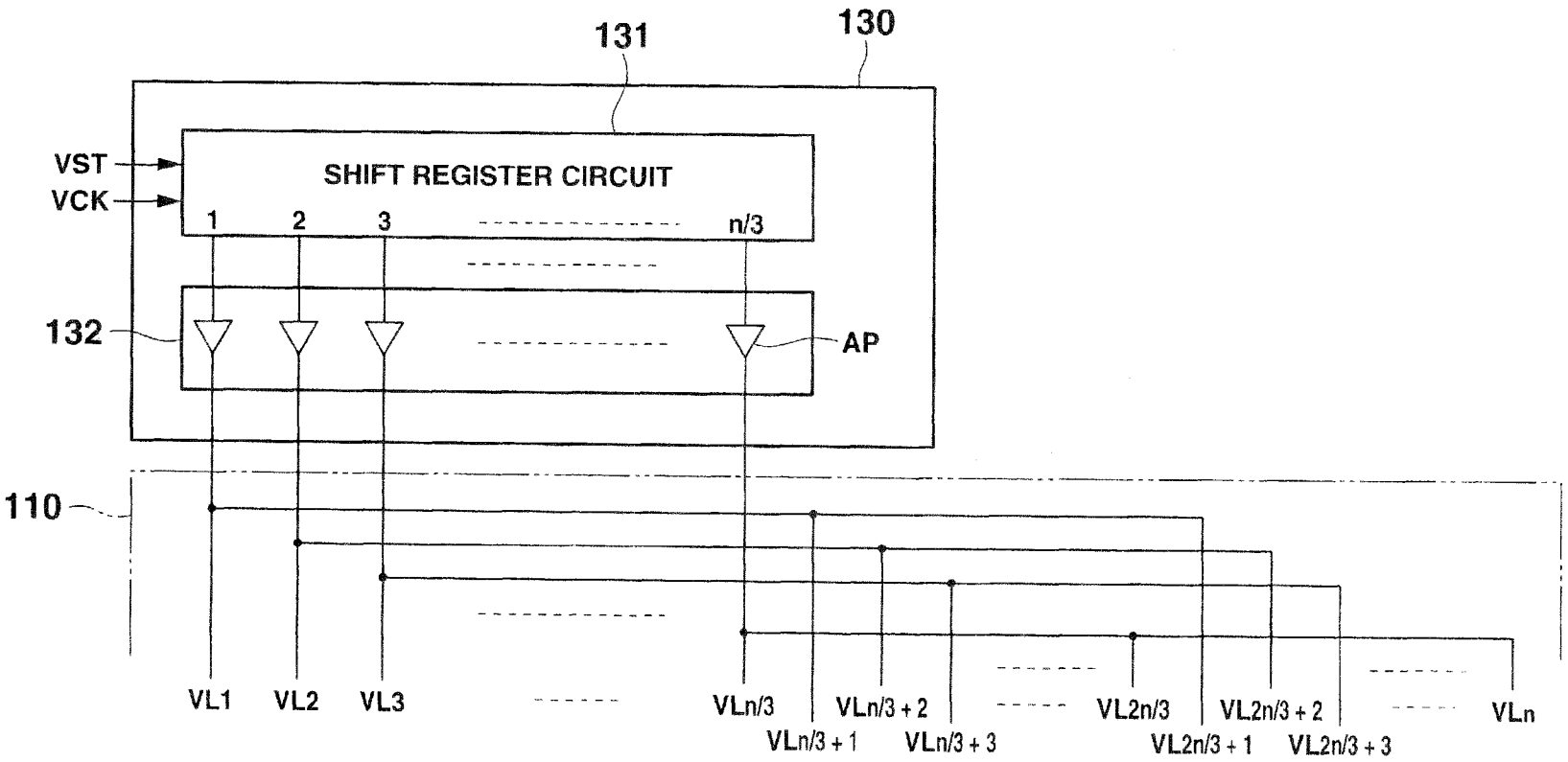
FIG. 15 is a schematic configuration diagram showing an example of a power source driver applied to a display apparatus according to a third embodiment.

FIG. 15 is a schematic configuration diagram showing an example of the power source driver 130 applied to the display apparatus 100 according to the present embodiment. FIGS. 16A-16H are operational conceptual diagrams for illustrating a display drive method of the display apparatus according to the present embodiment. Hereupon, the description will be given to the case of setting a plurality of rows (two rows) separated from the writing line by the predetermined number of rows and separated from each other by the predetermined number of rows as designated lines for the convenience of description. The components equal to those of the first embodiment are denoted by the same marks as those of the first embodiment, and their descriptions are simplified or omitted here. Moreover, the descriptions about the first embodiment will be suitably cited to be referred as the need arises.

The display apparatus according to the present embodiment has a substantially equal configuration to that (see FIG. 2) of the first embodiment except the power source driver 130 described below. The power source driver 130 having the peculiar configuration to the present embodiment includes, as shown in FIG. 15, a shift register circuit 131, and a output circuit section 132. The shift register circuit 131 includes the number of output terminals of shift signals which number is equal to ⅓ (n/3) of the number (equal to the number of rows n) of power source lines VL arranged in the display panel 110. The output circuit section 132 includes n/3 amplifiers AP correspondingly to each output terminal of the shift register circuit 131, and applies the output voltage of each of the amplifiers AP to each of the power source lines VL in an x-th row, an (n/3+x)th row, and a (2×n/3+x)th row, which are separated by (n/3−1) rows, of the display panel 110 through branched signal lines. Here the letter x denotes an integer within a region from 1 to n/3Moreover, the output circuit section 132 is also provided with switching sections outputting the output voltage of each of the amplifiers AP to the power source line VL in each row on the basis of the output control signal VOE, although their illustration is omitted.

That is, a first output voltage output from the shift register circuit 131 through the output circuit section 132 is branched to each of the power source lines VL in a first row, an (n/3+1)th row, and a (2×n/3+2)th row and is output as the power source voltage Vsc severally. A second output voltage is output to each of the power source lines VL of a second row, an (n/3+2)th row; a (2×n/3+2)th row, and a third output voltage is output to each of the power source lines VL in a third row, an (n/3+3)th row, and a (2×n/3+3)th row; . . . an x-th output voltage is output to each of the power source lines VL in an x-th row, an (n/3+x)th row, and a (2×n/3+x)th row; . . . an n/3th output voltage is output to each of the power source lines VL of an n/3th row, a (2×n/3 (=n/3+n/3))th row, and an n-th (=2×n/3+n/3)th row.

Incidentally, FIG. 15 shows the configuration of the power source driver 130 in the case where the low level power source voltage Vsc (=Vs) is applied to the display pixels EM in the two rows ( (n/2+x)th row and (2×n/3+x)th row; designated lines), which are separated from the display pixels EM in a row (for example, x-th row; writing line), into which a writing operation of display data is executed, by (n/3−1) rows and are separated from each other by (n/3−1) rows to set the display pixels EM to be in their non-emission states, but the present invention is not restricted to this configuration. For example, the configuration of applying branched output signals (low level power source voltage Vsc) to the display pixels EM in the designated lines of three rows that are separated from a writing line by (n/4−1) rows and are separated from one another by (n/4−1) rows, or the display pixel EM in the designated lines of four rows that are separated from a writing line by (n/5−1) rows and are separated from one another by (n/5−1) rows. If the total number of the writing line and the designated line is supposed to be q, then the designated lines are set to be separated from the writing line by (n/q−1 ) rows and to be separated from one another by (n/q−1) rows. In this case, the number of the output terminals of the shift register circuit 131 and the number of the amplifiers AP provided in the output circuit section 132 are severally determined to be n/q (q denotes an integer satisfying, for example, the relation of 1<q<n) according to the total number q of the writing line and a plurality of designated lines to which the power source voltage Vsc is simultaneously applied.

Moreover, although the power source driver 130 shown in FIG. 15 is described as the case where an output signal output from each of the amplifiers AP in the output circuit section 132 of the power source driver 130 is branched (distributed) in the display panel 110 to be simultaneously applied to the display pixels EM in each row as the power source voltage Vsc through the plurality of power source lines VL (writing line and the plurality of designated lines), the present invention is not restricted to this case. The present invention may be configured so that the output signal from each of the amplifiers AP is branched correspondingly to each row of the display panel 110 in the power source driver 130 to be simultaneously applied to the display pixels EM in each row as the power source voltage Vsc through each of the power source lines VL.

Since the display panel 110 and the power source driver 130 can be connected to each other with the number (n/q) of connection terminals, which number corresponds to the total number q of the writing line and the plurality of designated lines in the former configuration shown in FIG. 15 here, the number of the mutual connection terminals can be further reduced in comparison with those of the first and second embodiments, and consequently the miniaturization and cost reducing of the power source driver 130 can be achieved. On the other hand, since the display panel 110 and the power source driver 130 can be connected to each other by the row in the latter configuration, the wiring design and the like in the display panel 110 is not needed to be changed similarly to the case of the second embodiment, and the power source driver applicable to the existing display panel 110 as it is can be provided.

The display drive method of the display apparatus 100 provided with the power source driver 130 having the configuration described above sequentially repeats the operation of writing the gradation current Idata in accordance with display data into the display pixels EM (pixel drive circuits DC) in each of the rows arranged in the display panel 110 for all of the rows, and makes the display pixels EM in a row (writing line) to which the writing operation is executed and a plurality of rows (designated lines) separated from the writing row by the predetermined number of rows and separated from one another by the predetermined number of rows perform their non-emission operations, and further makes the display pixels EM in the other rows perform their emission operations with predetermined luminous gradations in accordance with the already written display data (gradation currents Idata). Thereby, the display drive method displays the image information for one screen of the display panel 110.

Figures 16A, 16B, 16C, 16D, 16E, 16F, 16G, 16H:
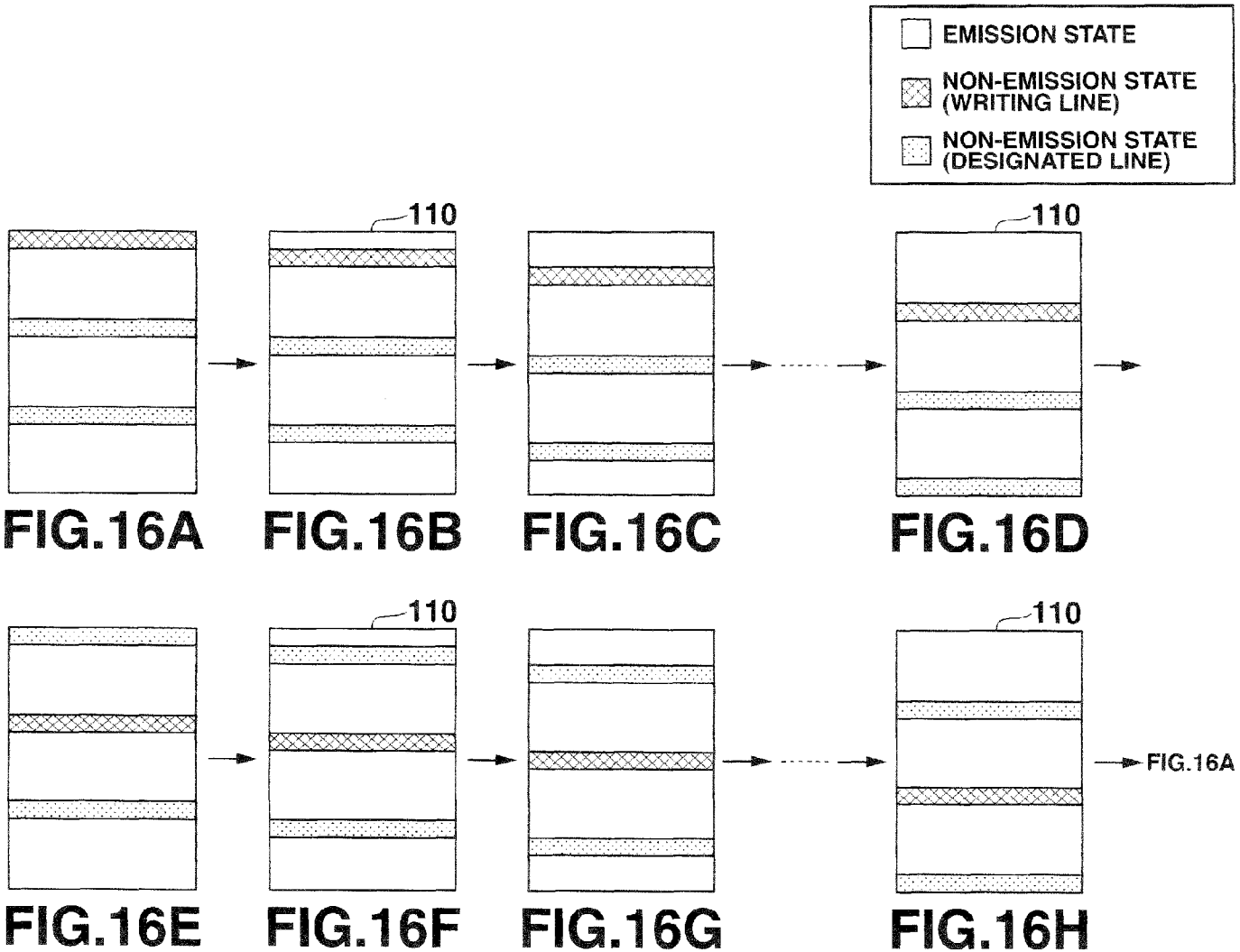
FIGS. 16A, 16B, 16C, 16D, 16E, 16F, 16G, and 16H are operational conceptual diagrams for illustrating a display drive method of the display apparatus according to the third embodiment.

That is, as shown in the operational conceptual diagrams of FIGS. 16A-16D, the x-th row (writing line) in which a writing operation is executed and a plurality (two) of designated lines in the (n/3+x)th row and (2×n/3+x)th row, which are separated from the writing line by (n/3−1) rows and separated from each other by the predetermined number of rows (n/3−1) rows, are set in the non-emission states, and the writing line and the plurality of designated lines, which are set into the non-emission states, are controlled so as to move downward in the display region, which is set to be in the emission state, in the display panel 110 with a fixed interval (positional relation) kept as the writing operation sequentially moves to the next row (see FIGS. 16A-16D). Then, when the writing operation (writing line) reaches the group (n/3)th row and each of the designated lines reaches the (2×n/3)th row as shown in FIG. 16D before the execution of the writing operation into the (n/3+1)th row, each of the designated lines is controlled to move to the (2×n/3+1)th row and first row of the display panel 110 and to moves downward with the interval from the writing line kept as the writing operation may sequentially move to the next row as shown in FIG. 16E (see FIGS. 16E-16H).

According to such a display drive method of a display apparatus, in a period in which a writing operation is executed to the display pixels EM in a writing line and in a period in which a row is set as the designated line, the display pixels (emission elements) EM in the writing line and the plurality of designated lines do not perform their emission operations to be set in their non-emission states (non-display states), and consequently a false impulse type display drive control for performing an emission operation with a luminous gradation in accordance with display data only in a certain period of one frame period can be realized similarly to the first embodiment.

In particular, by the present embodiment, if the selection period of the display pixels in each row in the display panel 110 is constant, then the periods of the movements of black lines on the screen can be apparently shortened as the number of rows that is set to be in the non-emission states (non-display states) is increased. Accordingly, by setting the apparent black line movement period to a fixed period in which no flickers can be seen, the selection period can be more lengthened (to retard the frequency) as the number of rows to be set in the non-emission states (that is, the number of rows of the designated lines) is increased, and the power consumption of the driver applied to the display apparatus 100 can be further reduced in comparison with the case of the first embodiment mentioned above. Then, the cost of the display apparatus 100 can be further reduced, and the driver can be further miniaturized. Thus, the degree of freedom of the specifications of the display panel 110 can be further improved. Moreover, according to the present embodiment, since the non-emission regions are prescribed by each of the rows similarly to the first embodiment mentioned above, the width of the non-emission region can be narrowed (thinned), and the present embodiment has the feature of the difficulty of sighting the non-emission region.

Incidentally, in the present embodiment, if the total number of the writing line and the designated lines is supposed to be q, then the numbers of rows by which the writing line is separated from each of the designated lines respectively are set to be equal by setting the designated lines to be separated from the writing line by (n/q−1) rows and bys setting the designated lines to be separated from one another by (n/q−1) rows. In this case, the aforesaid effect can be most effectively produced. However, as long as the numbers of rows by which the writing line is separated from each of the designated lines are approximate to (n/q−1) rows, a nearly similar effect can be produced even if the numbers of rows are not mutually quite the same numbers of rows, and the number of rows to be separated may be the number of rows approximate to (n/q−1) rows.

<Fourth Embodiment>

Next, a fourth embodiment of the display apparatus according to the present invention will be described.

In the aforesaid second embodiment, the description has been given to the case of setting the display pixels EM in a designated group separated from a writing group including a row (writing line) into which a writing operation is executed by the predetermined number of groups into their non-emission states together with the display pixels EM in the writing group at the time of the writing operation into the display panel 110 in which the grouping of the display pixels EM has been performed every plurality of rows of display pixels EM in advance. In the fourth embodiment, control is performed so as to set a plurality of groups separated from each other by the predetermined number of groups into their non-emission states as the designated groups in addition to the predetermined number of groups separated from a writing group by the predetermined number of groups.

Figure 17:
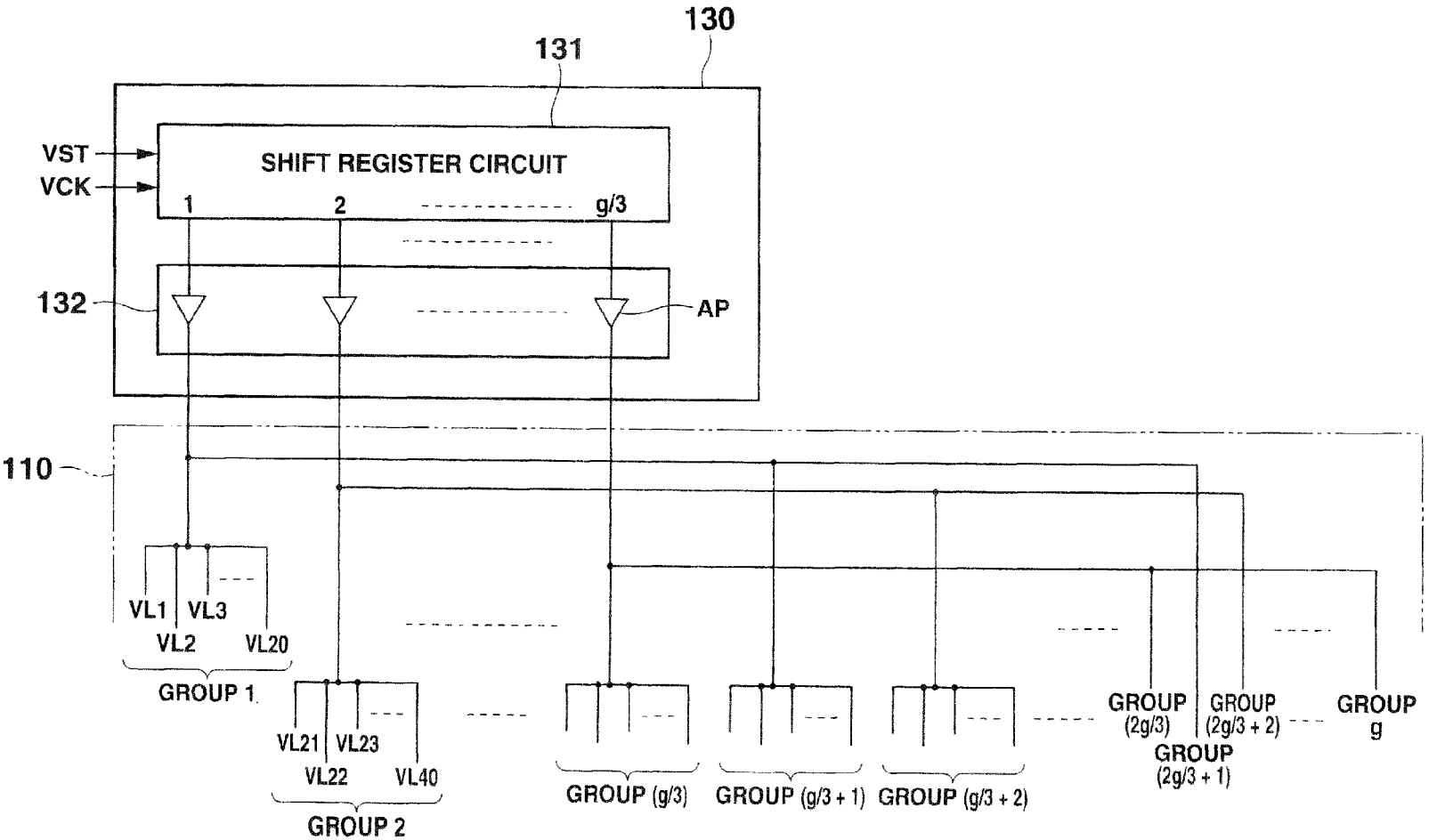
FIG. 17 is a schematic configuration diagram showing an example of a power source driver applied to a display apparatus according to a fourth embodiment.

FIG. 17 is a schematic configuration diagram showing an example of the power source driver 130 applied to the display apparatus 100 according to the present embodiment. FIGS. 18A-18H are operational conceptual diagrams for illustrating a display drive method of the display apparatus according to the present embodiment. Hereupon, the description will be given to the case of setting a plurality of groups (two groups) separated from the writing group by the predetermined number of groups and separated from each other by the predetermined number of groups as the designated groups for the convenience of description. The components equal to those of the second or third embodiment are denoted by the same marks as those of the second or third embodiment, and their descriptions are simplified or omitted here. Moreover, the descriptions about the second or third embodiment will be suitably cited to be referred as the need arises.

The display apparatus according to the present embodiment has a substantially equal configuration to that (see FIG. 11) of the second embodiment except the power source driver 130 described below. The power source driver 130 having the peculiar configuration to the present embodiment includes, as shown in FIG. 17, a shift register circuit 131, and an output circuit section 132. The shift register circuit 131 includes the number of output terminals of shift signals which number is equal to ⅓ (g/3) of the total number (g) of the groups set in the display panel 110. The output circuit section 132 includes g/3 amplifiers AP correspondingly to each output terminal of the shift register circuit 131, and applies the output voltage of each of the amplifiers AP to all of the power source lines VL included in each of a z-th group, a (g/3+z)th group, and a (2×g/3+z)th group of the display panel 110 through branched signal lines. Here the letter z denotes an integer within a region from 1 to g/3.

That is, a first output voltage output from the shift register circuit 131 through the output circuit section 132 is branched to all of the power source lines VL included in each of a first group, a (g/3+1)th group, and a (2×n/3+1)th group and is output as the power source voltage Vsc severally. A second output voltage is output to all of the power source lines VL included in each of a second group, a (g/3+2)th group, a (2×g/3+2)th group; and a third output voltage is output to all of the power source lines VL included in each of a third group, a (g/3+3)th group, and a (2×g/3+3)th group; . . . a z-th output voltage is output to all of the power source lines VL included in each of a z-th group, an (g/3+z)th group, and a (2×g/3+z)th group; . . . a g/3th output voltage is output to all of the power source lines VL included in each of a g/3th group, a (2×g/3 (=g/3+g/3))th group, and a g-th (=2×g/3+g/3)th group.

Incidentally, FIG. 17 shows the configuration of the power source driver 130 in the case of applying the low level power source voltage Vsc (=Vs) to the display pixels EM in the two groups ((g/2+z)th group and (2×g/3+z)th group; designated groups), which are separated from the display pixels EM in a group (for example, z-th group; writing group) including a row, into which a writing operation of display data is executed, by (g/3−1) groups and are separated from each other by (g/3−1) groups to set the display pixels EM to be in their non-emission states, but the present invention is not restricted to this configuration. For example, the configuration of applying branched output signals (low level power source voltages Vsc) to the display pixels EM included in the three designated groups that are separated from a writing group by (g/4−1) groups and are separated from one another by (g/4−1) groups, or to the display pixels EM included in the four designated groups that are separated from a writing group by (g/5−1) groups and are separated from one another by (g/5−1) groups. In this case, the number of the output terminals of the shift register circuit 131 and the number of the amplifiers AP provided in the output circuit section 132 are severally determined to be g/r (the letter r denotes an integer satisfying, for example, the relation of 1<r<g) according to the total number r of the writing group and the plurality of designated groups to which the power source voltage Vsc is simultaneously applied.

Moreover, although the power source driver 130 shown in FIG. 17 is described as the case where an output signal output from each of the amplifiers AP in the output circuit section 132 of the power source driver 130 is branched (distributed) in the display panel 110 to be simultaneously applied to the display pixels EM in each row as the power source voltage Vsc through the power source lines VL included in the plurality of groups (writing group and the plurality of designated groups), the present invention is not restricted to this case. The present invention may be configured so that the output signal of each of the amplifiers AP is branched in the power source driver 130 correspondingly to each group or each row of the display panel 110 to be simultaneously applied to the display pixels EM in each row as the power source voltage Vsc through each of the power source lines VL.

Since the display panel 110 and the power source driver 130 can be connected to each other with the number (g/r) of connection terminals, which number corresponds to the total number r of the writing group and the plurality of designated groups, to both of which the power source voltage Vsc is simultaneously applied, in the former configuration shown in FIG. 17 here, the number of the mutual connection terminals can be further reduced in comparison with those of the first to third embodiments, and consequently the further miniaturization and cost reducing of the power source driver 130 can be achieved.

The display drive method of the display apparatus 100 provided with the power source driver 130 having the configuration described above sequentially repeats the operation of writing the gradation current Idata in accordance with display data into the display pixels EM (pixel drive circuits DC) in each of the rows arranged in the display panel 110 for all of the rows, and makes the display pixels EM in all of the rows included in a writing group including a row to which the writing operation is executed and in a plurality of designated groups separated from the writing group by the predetermined number of groups and separated from one another by the predetermined number of groups perform their non-emission operations, and further makes the display pixels EM in the other groups perform their emission operations with predetermined luminous gradations in accordance with the already written display data (gradation currents Idata). Thereby, the display drive method displays the image information for one screen of the display panel 110.

Figures 18A, 18B, 18C, 18D, 18E, 18F, 18G, 18H:
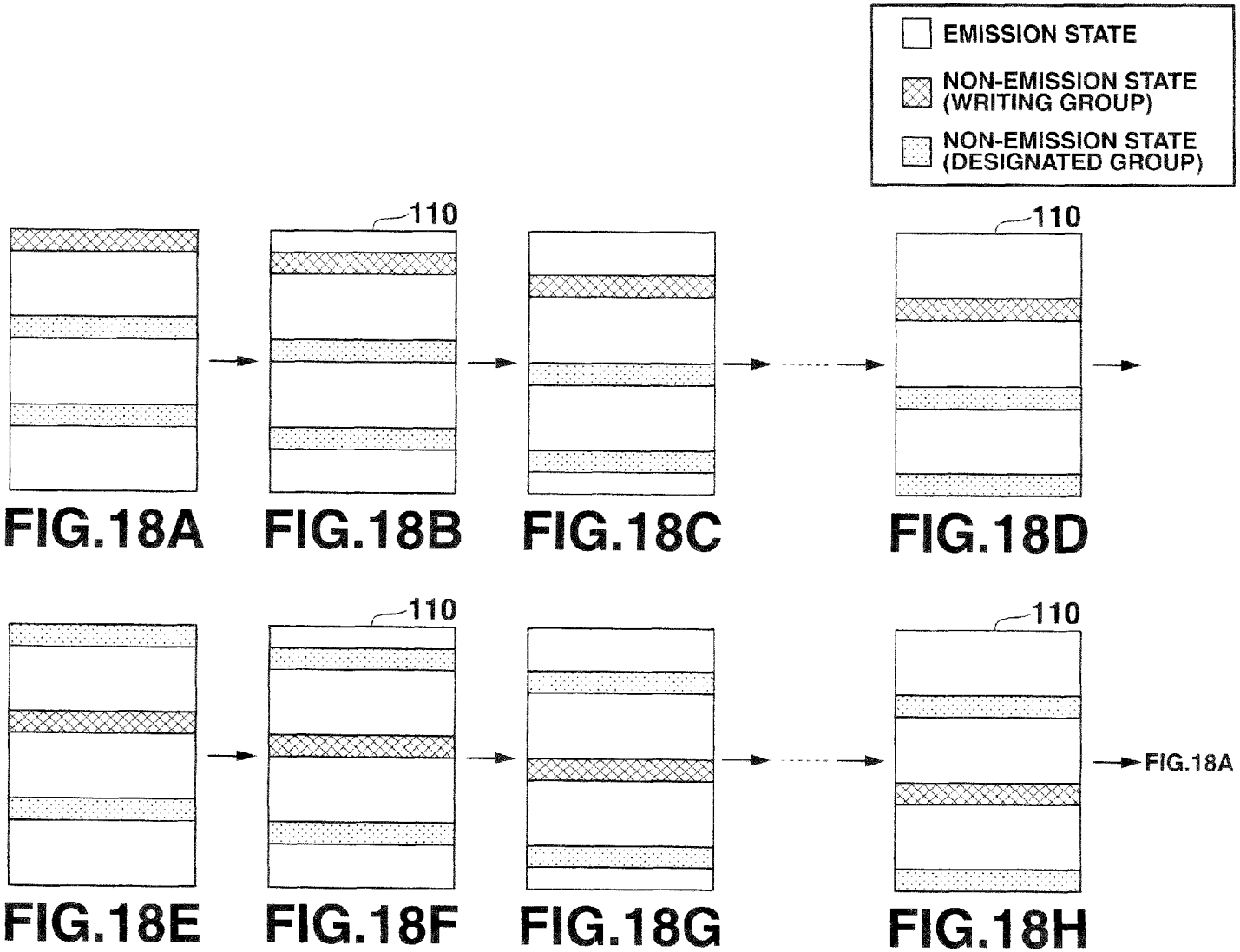
FIGS. 18A, 18B, 18C, 18D, 18E, 18F, 18G, and 18H are operational conceptual diagrams for illustrating a display drive method of the display apparatus according to the fourth embodiment.

That is, as shown in the operational conceptual diagrams of FIGS. 18A-18D, the z-th writing group into which a writing operation is executed and a plurality (two) of designated groups in the (g/3+z)th group and (2×g/3+z)th group, which are separated from the writing group by the predetermined number of groups (g/3−1) and separated from each other by the predetermined number of groups (g/3−1), are set in the non-emission states, and the writing group and the plurality of designated groups, which are set into the non-emission states, are controlled so as to move downward in the display region, which is set to be in the emission state, in the display panel 110 with a fixed interval (positional relation) kept as the writing operation sequentially moves to the next row (see FIGS. 18A-18D). Then, when the writing operation (writing group) reaches the group (g/3)th group and each of the designated groups reaches the (2×g/3)th group and g-th group as shown in FIG. 18D before the execution of the writing operation into the (g/3+1)th group, each of the designated groups is controlled to move to the (2×g/3+1)th group and first group of the display panel 110 and to move downward with the interval from the writing group kept as the writing operation sequentially moves to the next row as shown in FIG. 18E (see FIGS. 18E-18H).

According to such a display drive method of a display apparatus, in a period in which a writing operation is executed to the display pixels EM in each row in a writing group and in a period in which a group is set as the designated group, the display pixels (emission elements) EM included in the writing group and the plurality of designated groups do not perform their emission operations to be set in their non-emission states (non-display states), and consequently the false impulse type display drive control for performing an emission operation with a luminous gradation in accordance with display data only in a certain period of one frame period can be realized similarly to the second embodiment.

In particular, by the present embodiment, if the selection period of the display pixels in each row in the display panel 110 is constant, then the periods of the movements of black lines on the screen can be apparently shortened as the number of groups that is set to be in the non-emission states (non-display states) is increased. Accordingly, by setting the apparent black line movement period to a fixed period in which no flickers can be seen, the selection period can be more lengthened (to retard the frequency) as the number of groups to be set in the non-emission states (that is, the number of the designated groups) is increased, and the power consumption of the driver applied to the display apparatus 100 can be further reduced in comparison with the case of the second embodiment mentioned above. Then, the cost of the display apparatus 100 can be further reduced, and the driver can be further miniaturized. Thus, the degree of freedom of the specifications of the display panel 110 can be further improved.

<Fifth Embodiment>

<Display Apparatus>

A schematic configuration of a display apparatus according to the present invention will be described with reference to the attached drawings.

Figure 19:
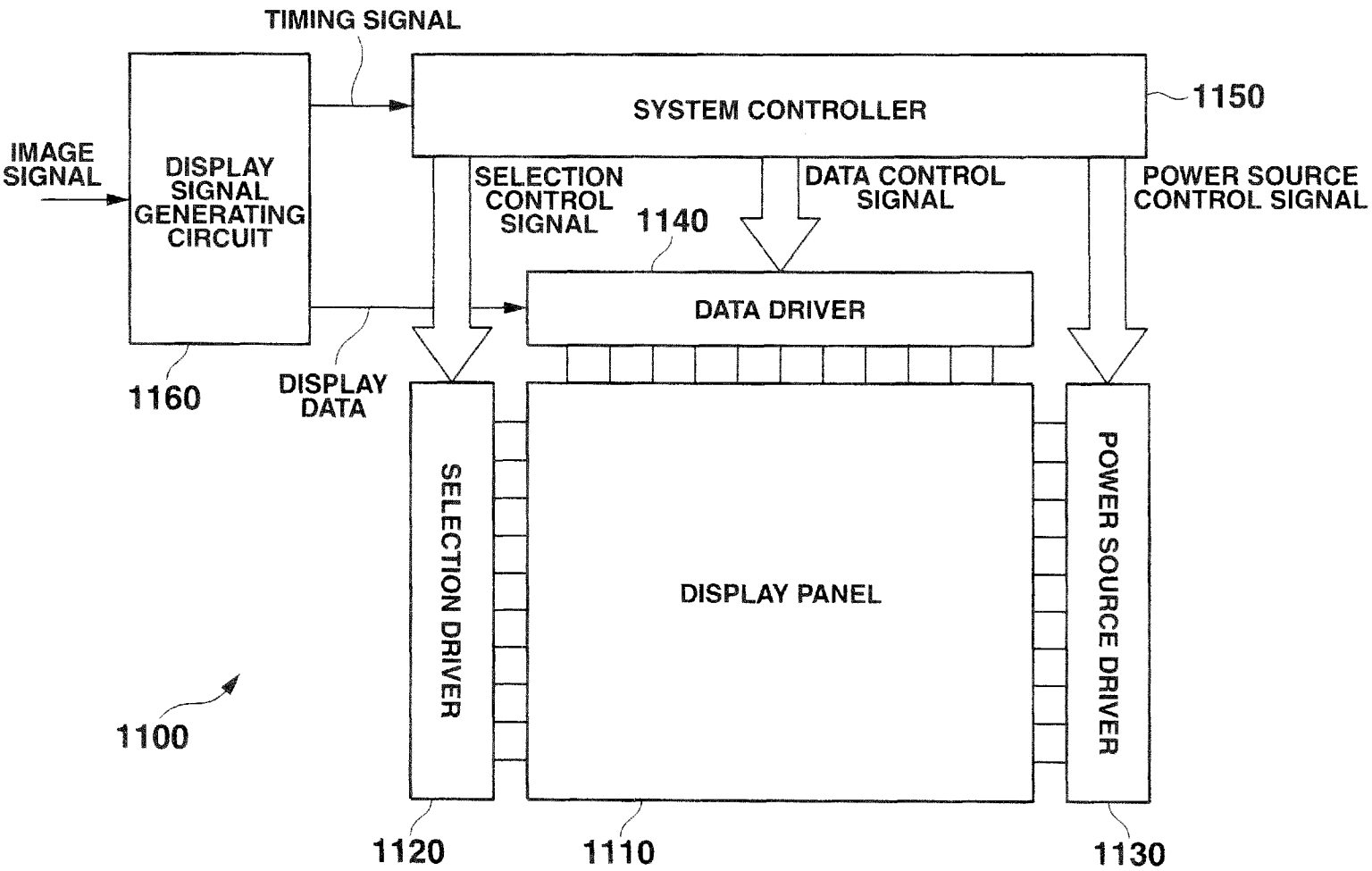
FIG. 19 is a schematic block diagram showing an example of the whole configuration of a display apparatus according to a fifth embodiment of the present invention.
Figure 20:
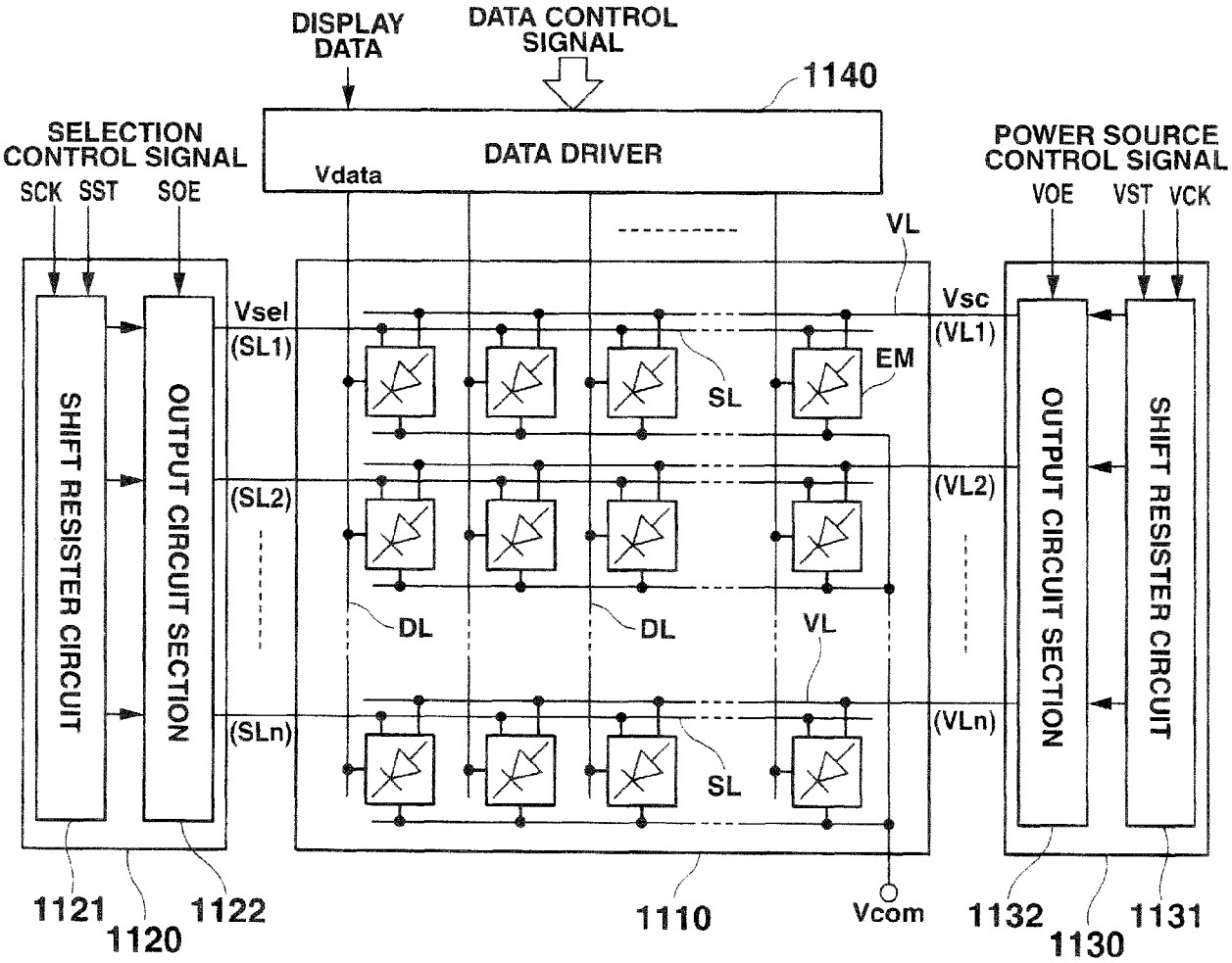
FIG. 20 is a diagram of the configuration of the principal part showing an example of a display panel and peripheral circuitry thereof applied to the display apparatus according to the fifth embodiment.

FIG. 19 is a schematic block diagram showing an example of the whole configuration of a display apparatus according to the present invention, and FIG. 20 is a diagram of the configuration of the principal part showing the examples of a display panel and the peripheral circuitry thereof (a selection driver, a data driver, and a power source driver) applied to a display apparatus according to a fifth embodiment.

Incidentally, an emission element type display apparatus will be described in the embodiments shown in the following. Each of the emission element type display apparatus has a configuration in which a plurality of display pixels is two-dimensionally arranged as a display panel. Each display pixel includes an emission element, and each display pixel performs an emission operation of a luminous gradation according to display data (image data). Thereby the display apparatus displays image information. But, the present invention is not limited to such an emission element type display apparatus, but may be a display apparatus that performs a gradation display (display operation) of desired image information by means of a transmitted light or a reflected light. In such a display apparatus, each display pixel is subjected to gradation control (set into a gradation state) according to display data as in a liquid crystal display device.

As shown in FIGS. 19 and 20, a display apparatus 1100 according to the present embodiment schematically includes a display panel 1110, a selection driver (selection drive section) 1120, a power source driver (power source drive section) 1130, a data driver (data drive section) 1140, a system controller 1150, and a display signal generating circuit 1160. The display panel 1110 includes a plurality of selection lines SL (SL1-SLn) and a plurality of data lines DL, which are arranged so as to be perpendicular to each other in row and column directions, a plurality of display pixels EM arranged in the neighborhood of each intersection point of each of the section lines SL and each of the data lines DL, and a plurality of power source lines VL (VL1-VLn) arranged in parallel to the selection lines SL in the respective rows. Each of the display pixels EM is equipped with a pixel drive circuit DC and an emission element (organic EL element OLED), which will be described later. The selection driver 1120 is connected to the respective selection lines SL of the display panel 1110, and sequentially applies a selection signal Vsel of the selection level (high level) to each of the selection lines SL at predetermined timing, thereby setting the display pixels EM in each row in their selected states in order. The power source driver 1130 is connected to each of the power source lines VL in the display panel 1110, and applies a power source voltage Vsc to each of the power source lines VL at predetermined timing. The data driver 1140 is connected to each of the data lines DL of the display panel 1110, and supplies a gradation signal (a gradation voltage Vdata and a drive signal) according to display data to the display pixels EM through each of the data lines DL. The system controller 1150 generates a selection control signal, a power source control signal, and a data control signal for controlling the operation states of at least the selection driver 1120, the power source driver 1130, and the data driver 1140 on the basis of timing signals supplied from the display signal generating circuit 1160, which will be described later, to execute a predetermined display drive control of the display panel 1110, and the system controller 1150 outputs the generated signals. The display signal generating circuit 1160 generates display data (luminous gradation data) on the basis of, for example, an image signal supplied from the outside of the display apparatus 1100 and supplies the generated display data to the data driver 1140. The display signal generating circuit 1160 further extracts or generates a timing signal (system clock and the like) for displaying predetermined image information on the display panel 1110 on the basis of the display data and supplies the extracted or generated timing signal to the system controller 1150.

In the following, each of the components mentioned above will be concretely described.

(Display Panel and Display Pixel)

Figure 21:
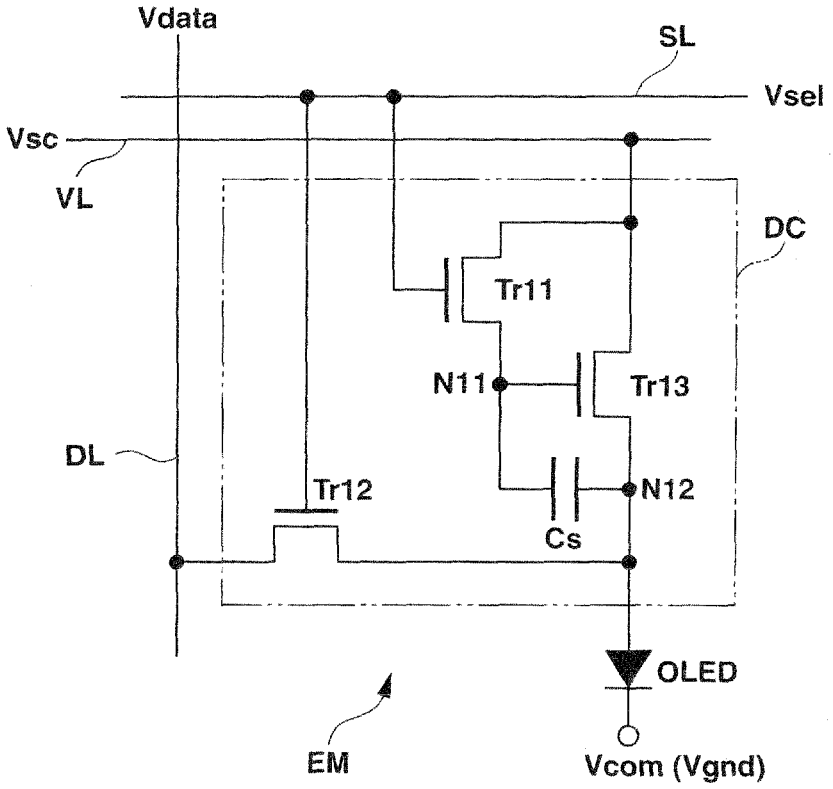
FIG. 21 is a circuit configuration diagram showing an embodiment of a display pixel applied to the display apparatus according to the fifth embodiment.

FIG. 21 is a circuit configuration diagram showing an embodiment of a display pixel (including a pixel drive circuit and an emission element) applied to the display apparatus 1100 according to the present embodiment. Incidentally, although a description will be given to a case of using a voltage designating type gradation control system of applying a gradation voltage Vdata of a voltage value in accordance with display data to each of the data lines DL to make an emission drive current in accordance with the display data flow through the emission element provided in each of the display pixels EM for making the emission element perform an emission operation (display operation) with a desired luminous gradation in the present embodiment, the present invention is not restricted to this case. The present invention may use, for example, a current designating type gradation control system of applying a gradation current of a current value according to display data to each of the data lines DL to make an emission drive current of a current value in accordance with the display data flow through the emission element in each of the display pixels EM for making the emission element perform an emission operation with a desired luminous gradation.

The display panel 1110 applied to the display apparatus 1100 according to the present embodiment is controlled so that the plurality of display pixels EM, which are two-dimensionally arranged in row and column directions (n rows×m columns where n and m are positive integers), may be driven in a display region as shown in a display drive method, which will be described later. That is, a writing operation of display data is sequentially executed to the display pixels EM in each row set in a selected state in a non-display operation state (non-emission operation state), and the following operations are performed in synchronization with the writing operation: the display pixels EM in rows (hereinafter referred to as "designated lines" for descriptive purposes: designated rows) adjoining a row (hereinafter referred to as a "writing line" for descriptive purposes: writing row) to which the writing operation is executed are set to be in intermediate display states (intermediate emission operation states), in which the luminance of the display pixels EM is made to be relatively lower than that of the display pixels EM in the adjacent rows in the display state (emission operation state), and the display pixels EM in the other rows (to which the writing operation has been already completed) are set to be in their display states (emission operation states). The display states (emission operation states), the intermediate display states (intermediate emission operation states), and non-display states (non-emission operation states) of the display pixels EM are set by switching the power source voltage Vsc supplied to the display pixels EM in each row suitably here. The details thereof will be described later.

Moreover, for example, a configuration schematically equipped with the pixel drive circuit DC and a well-known organic EL element (current control type emission element) OLED as shown in FIG. 21 can be applied to each of the display pixels EM arranged in the display panel 1110 according to the present embodiment. The pixel drive circuit DC sets the display pixel EM in its selected state on the basis of the selection signal Vsel applied from the selection driver 1120, and takes in a writing current Ia flowing according to the gradation voltage Vdata, which writing current Ia is supplied from the data driver 1140, in the selected state to generate an emission drive current in accordance with the gradation signal. The organic EL element OLED performs an emission operation with a predetermined luminous gradation on the basis of the emission drive current supplied from the pixel drive circuit DC.

The pixel drive circuit DC according to the present embodiment includes, for example, transistors Tr11, Tr12, and Tr13, and a capacitor Cs as shown in FIG. 21. The gate terminal, drain terminal, and source terminal of the transistor Tr11 are connected to a selection line SL, a power source line VL, and a node N11, respectively. The gate terminal, source terminal, and drain terminal of the transistor Tr12 are connected to the selection line SL, the data line DL, and a node N12, respectively. The gate terminal, the drain terminal, and the source terminal of the transistor (drive control element) Tr13 are connected to the node N11, the power source voltage line (power source line) VL, and the node N12, respectively. The capacitor Cs is connected between the nodes N11 and N12 (between the gate and source of the transistor Tr13).

The anode terminal (anode electrode) of the organic EL element OLED is connected to the node N12 of the pixel drive circuit DC, and the common voltage Vcom of the predetermined low potential is applied to the cathode terminal (cathode electrode) thereof. The common voltage Vcom is set to the potential equal to the power source voltage Vsc (=Vlow: first power source voltage, the power source voltage for a non-display operation), which is set to be the low level, or potential higher than the power source voltage Vsc in a writing operation period, in which a gradation signal (gradation voltage Vdata) in accordance with display data is supplied to one of the display pixels EM (pixel drive circuits DC), here. The common voltage Vcom is set to an arbitrary piece of potential (for example, the ground potential Vgnd) lower than the power source voltage Vsc (=Vhigh: third power source voltage, the power source voltage for a display operation) set to the high level (Vlow≦Vcom<Vhigh) in period of an emission operation period in which the emission drive current is supplied to the organic EL element (emission element) OLED and the organic EL element OLED performs its emission operation with a predetermined emission gradation. Moreover, the common voltage Vcom is applied to the plurality of display pixels EM arranged in the display panel 1110 in a matrix in common.

Incidentally, although the transistors Tr11-Tr13 are not especially restricted in FIG. 21, for example, field-effect type transistors of a well-known thin film transistor structure, each having the same channel type, can be applied as the transistors Tr11-Tr13. The transistors Tr11-Tr13 may be either amorphous silicon thin film transistors or polysilicon thin film transistors.

As shown in FIG. 21, by configuring the transistors Tr11-Tr13 of n-channel type amorphous silicon thin film transistors, already established amorphous silicon manufacturing techniques can be applied to manufacture a pixel drive circuit composed of transistors having uniform and stable operating characteristics (electron mobility and the like) by a comparatively simple manufacturing process here. Moreover, the capacitor Cs may be parasitic capacitance formed between the gate and source of the drive control transistor Tr13, or may be the capacitor element composed of a capacitor element additionally connected between the nodes N11 and N12 in addition to the parasitic capacitance.

Moreover, although the circuit configuration including three transistors Tr11-Tr13 has been shown as the pixel drive circuit DC in the display pixel EM described above, the present invention is not restricted to the embodiment, but may be the one including other circuit configurations including two or more transistors. Moreover, although the case where the organic EL element OLED is applied as the emission element luminously driven by the pixel drive circuit DC has been shown, but the present invention is not restricted to such a case. Any current control type emission element, for example, other emission elements, such as a light emitting diode, may be used. Furthermore, although the case where the current control type emission element is luminously driven by the pixel drive circuit DC has been described in the present embodiment, the configuration of generating a voltage component in accordance with display data to luminously drive a voltage control type emission element or the configuration of having the circuit configuration of changing the oriented states of liquid crystal molecules may be used.

(Selection Driver)

The selection driver 1120 applies one of the selection signals Vsel of the selection level (the high level in the display pixels EM mentioned above) to each of the selection lines SL on the basis of a selection control signal supplied from the system controller 1150 to set the display pixels EM in each row in their selected state. To put it concretely, the selection driver 1120 sequentially executes the operation of applying the selection signal Vsel to the selection line SL in each row at predetermined, thereby setting the display pixels EM in each row arranged in the display panel 1110 to be in their selected state sequentially.

The selection driver 1120 includes a well-known shift register 1121 and an output circuit section (output buffer) 1122, for example, as shown in FIG. 20, here. The shift register 1121 sequentially outputs shift signals corresponding to the selection lines SL of the respective rows on the basis of a scanning clock signal SCK and a scanning starting signal SST, both supplied from the system controller 1150, described below, as selection control signals. The output circuit section 1122 converts the shift signals output from the shift register 1121 into the signals having predetermined signal levels (selection levels), and outputs the converted signals to the respective selection lines SL as the selection signals Vsel on the basis of an output control signal SOE supplied from the system controller 1150 as the selection control signal.

(Power Source Driver)

FIGS. 22A-22C are schematic configuration diagrams showing an example of the power source driver 1130 applied to the display apparatus 1100 according to the present embodiment. The power source driver 1130 applies the high level power source voltage Vsc (=Vhig: third power source voltage, the power source voltage for a display operation) to the power source lines VL of the display pixels EM in the respective rows on the basis of the power source control signal supplied from the system controller 1150 at the time of an emission operation (at the time of a display operation), and applies the low level power source voltage Vsc (=Vlow: first power source voltage, the power source voltage for a non-display operation) to the power source lines VL at the time of a non-emission operation (at the time of a non-display operation) and further applies the intermediate level power source voltage Vsc (=Vmid: second power source voltage, the power source voltage for a designated region) of a voltage value between the high level power source voltage Vhigh and the low level power source voltage Vlow to the power source lines VL in the rows at the time of an intermediate emission operation (at the time of an intermediate display operation). As described below in detail, the high level power source voltage Vhigh is set at a voltage level at which the drive control transistor Tr13 in the pixel drive circuit DC of each pixel operates in its saturated region, and the intermediate level power source voltage Vmid is set to a voltage level at which the drive control transistor Tr13 operates in its linear region here.

That is, the display apparatus according to the present embodiment sequentially executes the following operations to all of the rows of the display panel 1110: the operation of applying the low level power source voltage Vsc (=Vlow) to the display pixels EM in the region (writing region) corresponding to a row (writing line) set to be in the selected state by the selection driver 1120 for a writing operation of display data among the plurality of display pixels EM two-dimensionally arranged in the display panel 110 through the power source line VL of the row, and the operation of applying the intermediate level power source voltage Vsc (=Vmid) to the display pixels EM in the regions (designated regions) corresponding to the rows adjoining the writing line through the power source line VL of the row. Hereby, the display pixels EM in the writing line, into which the writing operation of the display data is executed, are set to be in their non-emission operation states (non-display operation states) during the period of the execution of the writing operation of the display data, and the display pixels EM in the rows adjoining the writing line are set to be in their intermediate emission operation states (intermediate display operation states) during the writing operation period. The high level power source voltage Vsc (=Vhigh) is applied to the display pixels EM in all the other rows (the writing operation to which has been completed) through the power source lines VL of the respective rows, thereby setting the display pixels EM in all the other rows in their emission states (gradation display operation states).

As shown in FIG. 22A, the power source driver 1130 includes a well-known shift register circuit 1131 and an output circuit section 1132. The shift register circuit 1131 sequentially outputs sift signals corresponding to the power source lines VL in each row on the basis of a clock signal VCK and a start signal VST, both supplied from the system controller 1150 as power source control signals. The output circuit section 1132 outputs the signals of predetermined voltage levels (voltage values Vhigh, vmid, and Vlow) to the respective power source lines VL as the power source voltages Vsc according to the shift signals on the basis of an output control signal VOE supplied from the system controller 1150 as the power source control signal.

The shift register circuit 1131 in the power source driver 1130 of the present embodiment is configured to have n stages equal to the number of the power source lines VL (equal to the number of rows n) arranged in the display panel 1110, and outputs n shift signals. Moreover, the output circuit section 1132 includes n arithmetic circuits 1133 and n amplifiers AP. The shift signals are applied to the n arithmetic circuits 1133 as input signals A, B, and C, and the arithmetic circuits 1133 output the voltage of any of voltage values Vhigh, Vmid, and Vlow as an output signal Vout according to the input signal thereinto. The n amplifiers AP are buffer circuits provided correspondingly to the respective arithmetic circuits 1133. Each of the amplifiers AP amplifies the output signal Vout to output an output voltage to each of the power source lines VL1-VLn as the power source voltage Vsc in response to the output control signal VOE. Moreover, as shown in FIG. 22A, a first shift signal output from the shift register circuit 1131 is applied to a first arithmetic circuit 1133 as the input signal B, and is simultaneously applied to a second arithmetic circuit 1133 as the input signal A. A second shift signal output from the shift register circuit 1131 is applied to the second arithmetic circuit 1133 as the input signal B, and is simultaneously applied to the first arithmetic circuit 1133 and a third arithmetic circuit 1133 as the input signals C and B, respectively. A third shift signal output from the shift register circuit 1131 is applied to the third arithmetic circuits 1133 as the input signal B, and are simultaneously applied to the second and 4th arithmetic circuits 1133 as the input signals B and A, respectively. In the following, the same configuration is repeated. Moreover, the last n-th shift signal output from the shift register circuit 1131 is applied into an n-th arithmetic circuit 1133 as the input signal B, and is applied to an (n−1)th arithmetic circuit 1133 as the input signal C. Incidentally, although not show, the output circuit section 1132 is provided with a switching section outputting the output voltage of each of the amplifiers AP to the power source line VL in each row on the basis of the output control signal VOE.

FIG. 22B shows an example of the concrete configuration of each of the arithmetic circuits 1133, and FIG. 22C is a table showing the relations between the input signals and the output signals of the arithmetic circuits 1133. That is, each of the arithmetic circuits 1133 is composed of, for example, an OR circuit 1134, a NOR circuit 1135, and switching transistors Tr5, Tr6, and Tr7. The input signal A is applied to a first input terminal of the OR circuit 1134, and the input signal C is applied to a second input terminal of the OR circuit 1134. The output of the OR circuit 1134 is applied to the control terminal of the switching transistor Tr5. The input signal B is applied to a first input terminal of the NOR circuit 1135, and the input signal A is applied to a second input terminal of the NOR circuit 1135, and further the input signal C is applied to a third input terminal of the NOR circuit 1135. The output of the NOR circuit 1135 is applied to the control terminal of the switching transistor Tr7. Moreover, the input signal B is applied to the control terminal of the switching transistor Tr6. Then, the intermediate level power source voltage Vmid is applied to the drain terminal of the switching transistor Tr5;

the low level power source voltage Vlow is applied to the drain terminal of the switching transistor Tr6; the high level power source voltage Vhigh is applied to the drain terminal of the switching transistor Tr7; and the source terminals of the switching transistors Tr5, Tr6, and Tr7 are commonly connected to be connected to the output terminal of the arithmetic circuit 1133.

As shown in FIG. 22C, in each of the arithmetic circuits 1133, when the input signal A is the high level and the input signals B and C are the low levels, and when the input signal C is the high level and the input signals A and B are low levels, the output of the OR circuit 1134 takes the high level, the output of the NOR circuit 1135 takes the low level. Moreover, the transistor Tr5 takes its on-state, and the transistors Tr6 and Tr7 takes their off-states. Consequently, the intermediate level power source voltage Vmid is output as the output signal Vout. Moreover, when the input signal B is the high level and the input signals A and C are the low level, the outputs of the OR circuit 1134 and NOR circuit 1135 become the low level, and the transistor Tr6 becomes its on-state, and further the transistors Tr5 and Tr7 become their off-states. Then, the low level power source voltage Vlow is output as the output signal Vout. Moreover, when the input signal C is the high level and the input signals A and B are the low level, the output of the OR circuit 1134 becomes the low level, and the output of the NOR circuit 1135 becomes the high level. Then the intermediate level power source voltage Vmid is output as the output signal Vout.

Incidentally, although the configuration of the power source driver 1130 shown in FIG. 22A is the one in which both of the rows adjoining a writing line on the upper and lower sides thereof are used as designated lines and the intermediate level power source voltage Vmid is applied to the power source lines VL of the display pixels EM in the regions (designated regions) corresponding to the rows to set the display pixels EM in their intermediate emission operation states, the present invention is not restricted to this configuration, but the configuration in which two or more rows adjoining the writing line are set as the designated lines and the intermediate level power source voltage Vmid is applied to the power source lines VL of the display pixels EM in the regions corresponding to the rows to set the display pixels EM as the intermediate emission operation state may be used. Thereby, it becomes possible to make the writing line to be set in the non-display operation state difficult to sight.

(Data Driver)

Figure 23:
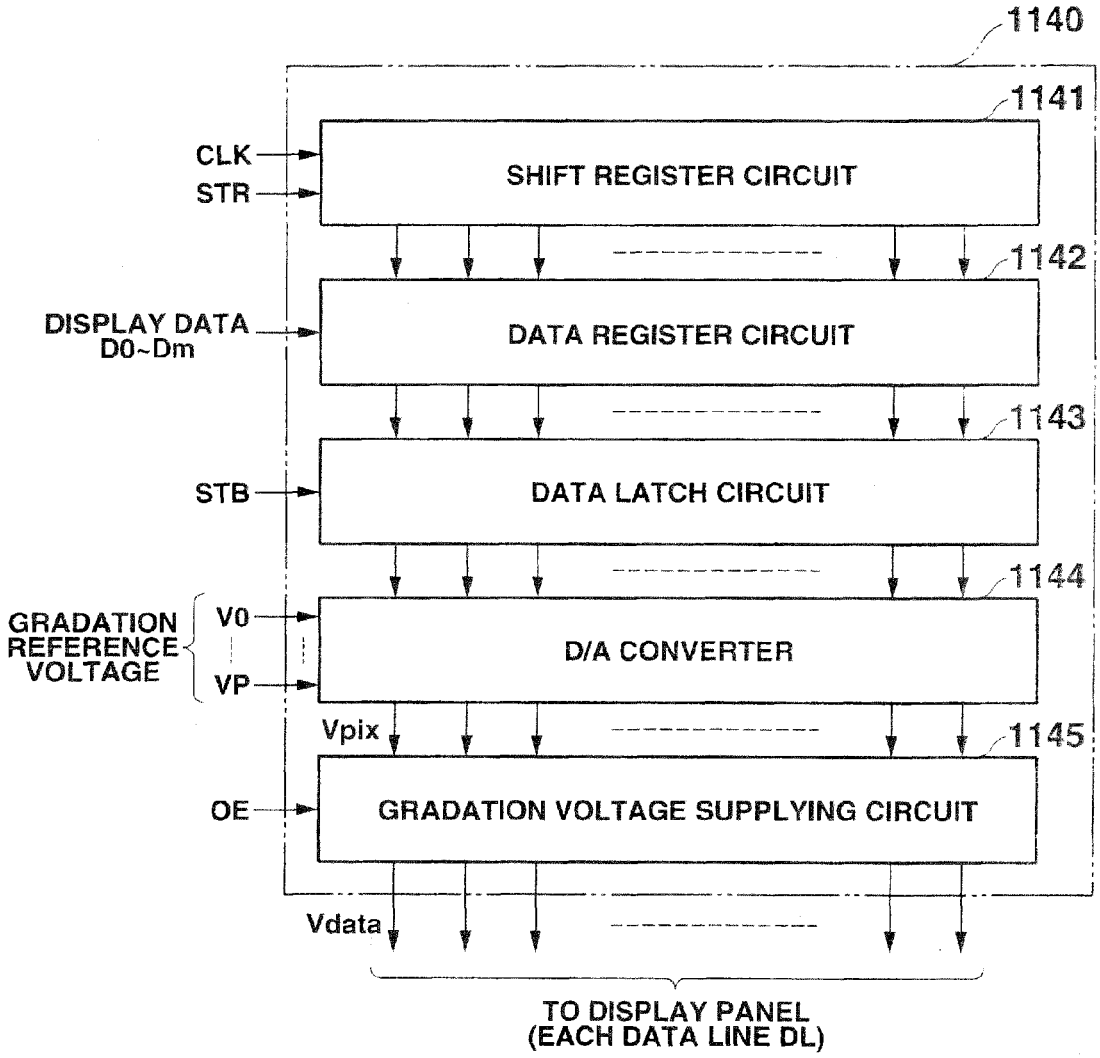
FIG. 23 is a schematic block diagram showing an example of a data driver applicable to the display apparatus according to the fifth embodiment.

FIG. 23 is a schematic block diagram showing an example of the data driver 1140 applicable to the display apparatus 1100 according to the present embodiment. Incidentally, the internal configuration of the data driver 1140 shown in FIG. 23 shows only an example capable of generating a gradation voltage of a voltage value in accordance with display data, and the present invention is not restricted to the internal configuration.

As shown in FIGS. 19 and 20, schematically, the data driver 1140 sequentially takes in display data (luminous gradation data) composed of a digital signal, which is supplied from the display signal generating circuit 1160, described below, for every row at predetermined timing on the basis of a data control signal supplied from the system controller 1150 to hold the taken display data therein, and generates the gradation voltage Vdata of a voltage value corresponding to the gradation value of the display data to simultaneously supply the generated gradation voltage Vdata to the display pixels EM in the row set to be in the selected state in a writing operation period through the data lines DL of respective columns.

For example, as shown in FIG. 23, the data driver 1140 includes a shift register circuit 1141, a data register circuit 1142, a data latch circuit 1143, a D/A converter 1144, and a gradation voltage supplying circuit 1145. The shift register circuit 1141 sequentially outputs shift signals on the basis of data control signals (shift clock signal CLK and sampling starting signal STR) supplied from the system controller 1150. The data register circuit 1142 sequentially takes in display data D0-Dm for a row, which display data D0-Dm is supplied from the display signal generating circuit 1160 on the basis of the input timing of the shift signals. The data latch circuit 1143 holds the display data D0-Dm for a row, which display data D-Dm has been taken in by the data register circuit 1142, on the basis of the data control signal (data latching signal STB). The D/A converter 1144 converts the held display data D0-Dm into predetermined analog signal voltages Vpix on the basis of gradation reference voltages V0-VP supplied from a not-shown power supplying section. The gradation voltage supplying circuit 1145 includes buffer circuits and simultaneously outputs the analog signal voltages Vpix to the data lines DL of the columns corresponding to the display data as the gradation voltage Vdata at the timing based on a data control signal (output enabling signal OE) supplied from the system controller 1150.

(System Controller)

The system controller 1150 generates and outputs at least a selection control signal, a power source control signal, and a data control signal to the selection driver 1120, the power source driver 1130, and the data driver 1140, respectively, as timing control signals for controlling their operation states. The system controller 1150 thereby operates each driver at predetermined timing to make each driver generate and output the selection signal Vsel and the power source voltage Vsc, both having predetermined voltage levels, and the gradation voltage Vdata in accordance with display data. The system controller 1150 then makes each driver execute the drive control operations to each of the display pixels EM (pixel drive circuits DC), and the system control 1150 thereby perform the control to make the display panel 1110 display predetermined image information based on an image signal.

(Display Signal Generating Circuit)

The display signal generating circuit 1160 extracts a luminous gradation signal component from, for example, an image signal supplied from the outside of the display apparatus 1100, and supplies the extracted luminous gradation signal component to the data register circuit 1142 of the data driver 1140 as display data (luminous gradation data) composed of a digital signal for every row of the display panel 1110. If the image signal includes a timing signal component prescribing the display timing of image information like a television broadcasting signal (composite image signal), then the display signal generating circuit 1160 may be the one including the function of extracting the timing signal component to supply the extracted timing signal component to the system controller 1150 in addition to the function of extracting the luminous gradation signal component here. In this case, the system controller 1150 generates each control signal to be individually supplied to the selection driver 1120, the power source driver 1130, and the data driver 1140 on the basis of the timing signals supplied from the display signal generating circuit 1160.

<Drive Method of Display Pixel>

Next, the basic operation of a display pixel (see FIG. 21) to be applied to the aforesaid display panel 1110 in the present embodiment will be described.

Figure 24A:
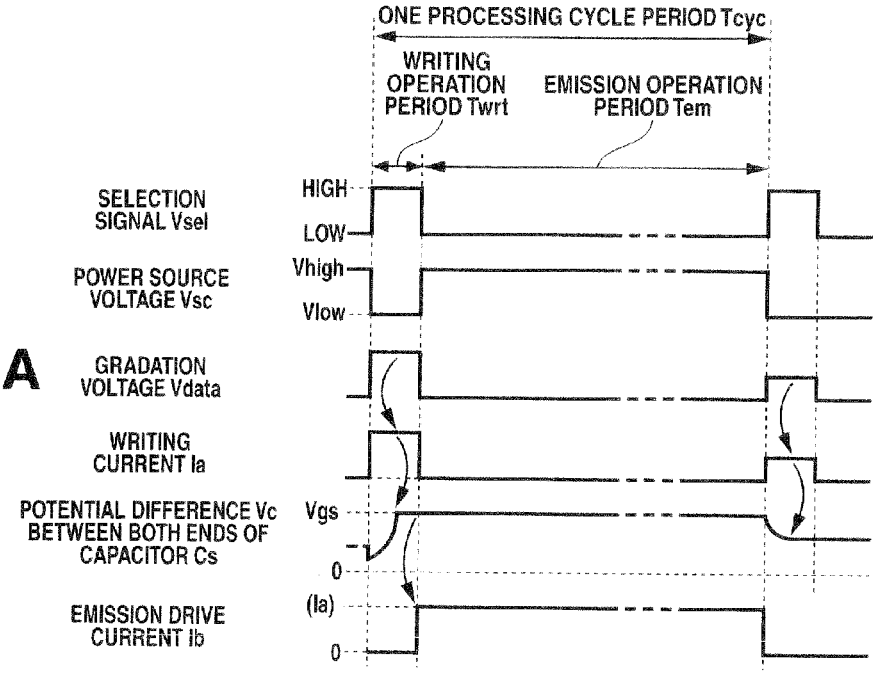
FIGS. 24A and 24B are timing charts showing a writing operation, an emission operation, and an intermediate emission operation of a display pixel applied to the display apparatus according to the fifth embodiment.
Figure 24B:
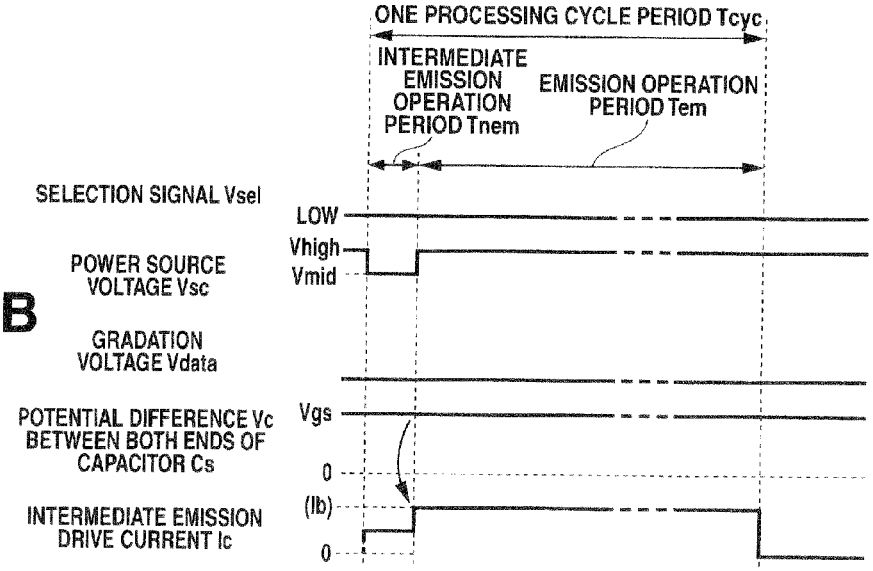
Figure 25A:
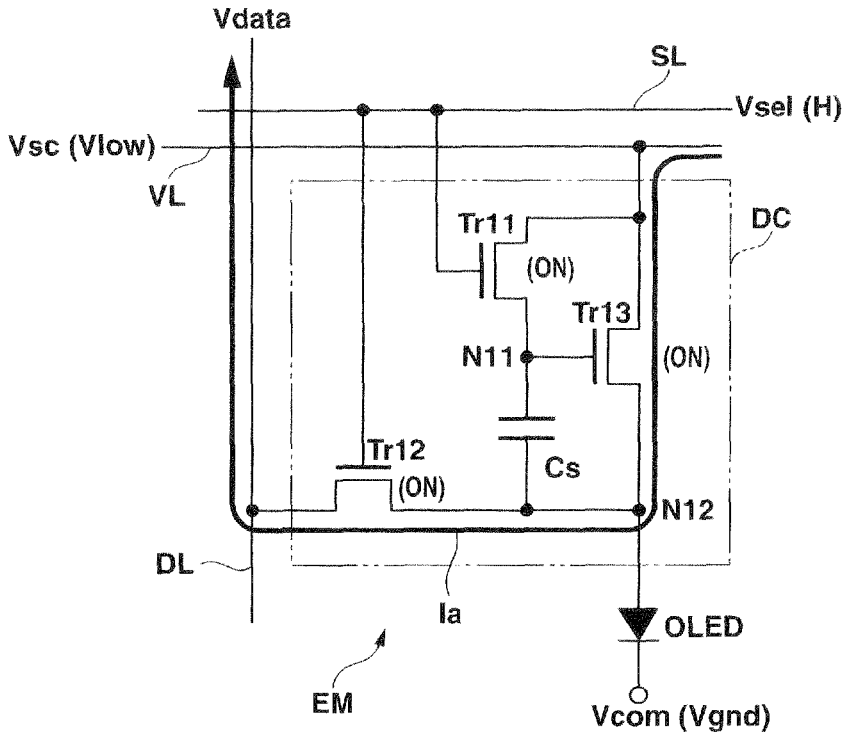
FIGS. 25A and 25B are conceptual diagrams showing a writing operation and an emission operation, respectively, of a display pixel according to the fifth embodiment.
Figure 25B:
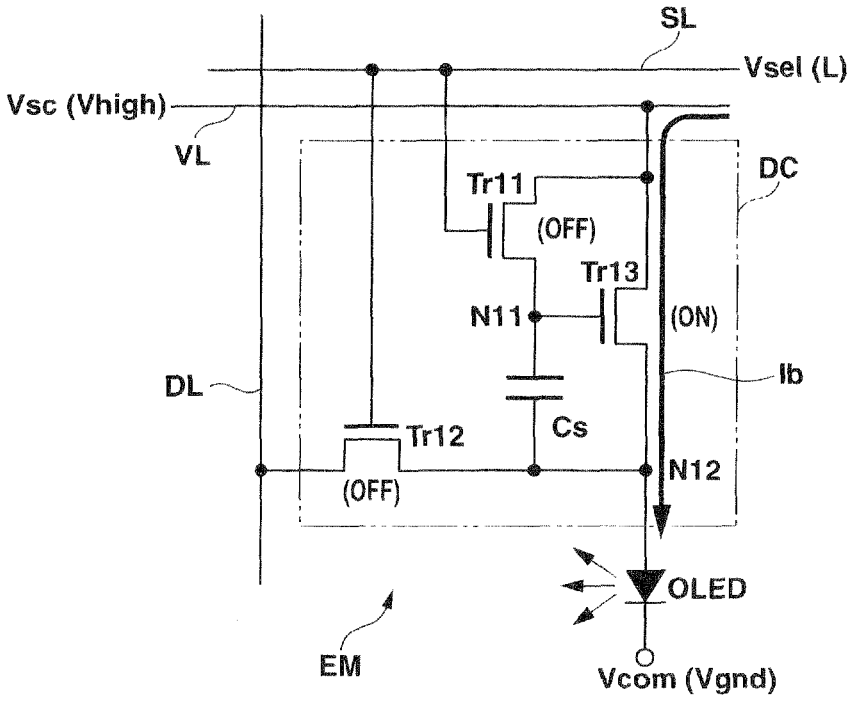
Figure 26:
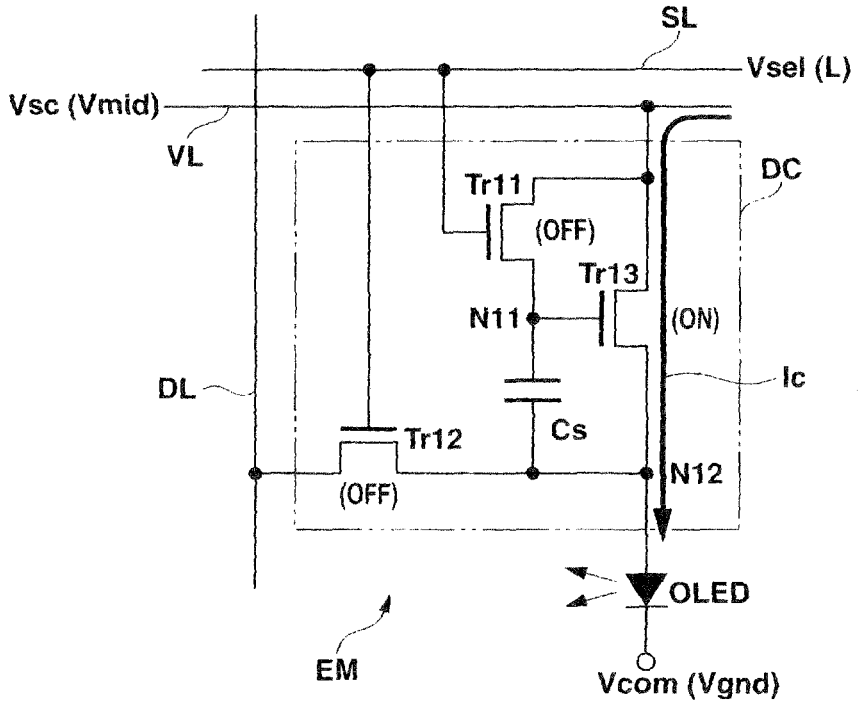
FIG. 26 is a conceptual diagram showing an intermediate emission operation of a display pixel according to the fifth embodiment.
Figure 27:
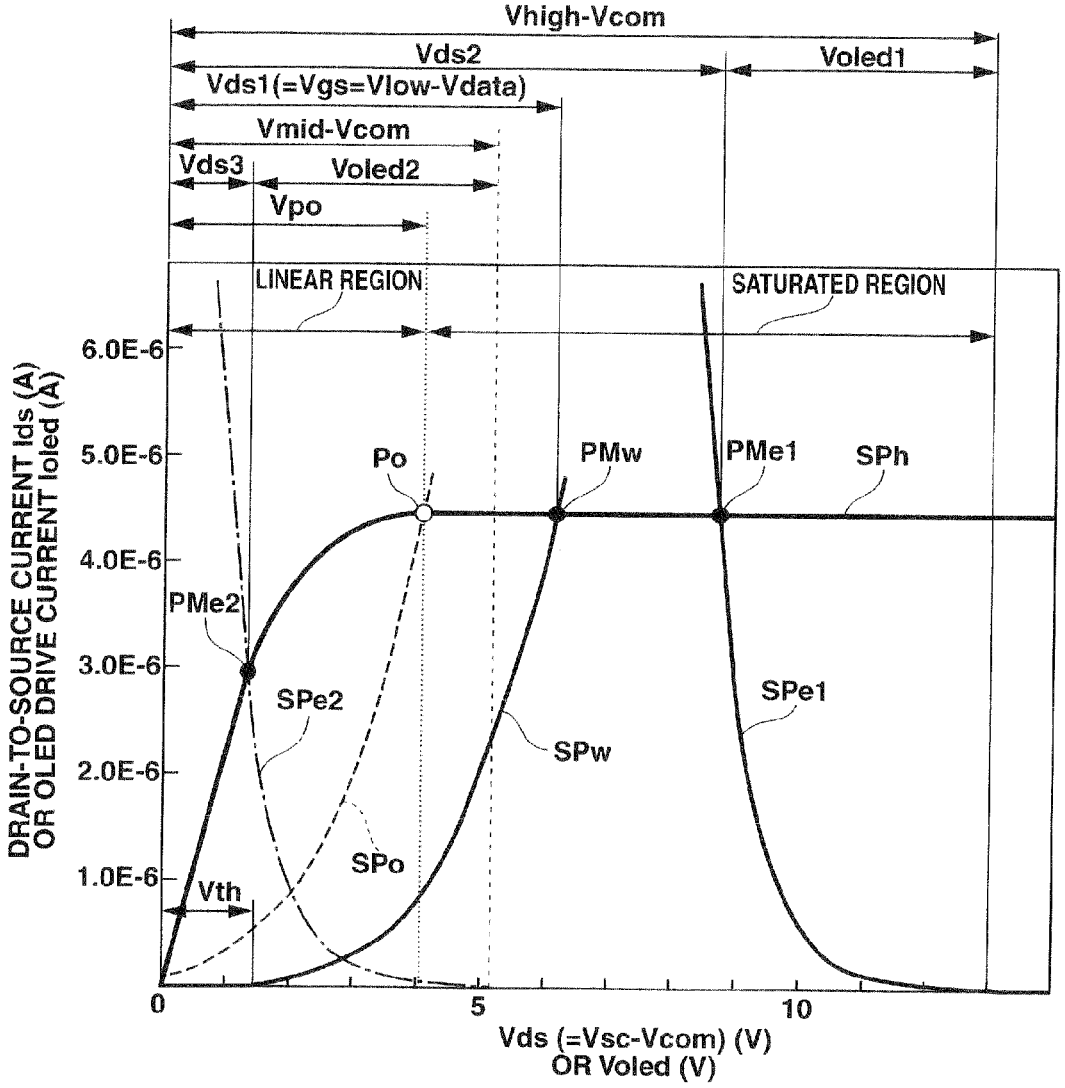
FIG. 27 is a diagram showing operating characteristics of a drive control transistor and load characteristics of an organic EL element at the time of an emission operation and an intermediate emission operation of a display pixel.

FIGS. 24A and 24B are timing charts showing a writing operation, an emission operation, and an intermediate emission operation in a display pixel applied to the display apparatus 1100 according to the present embodiment. FIGS. 24A and 24B show an operation in a specific display pixel EM among the display pixels EM two-dimensionally arranged (arranged in a matrix composed of n rows by m columns) in the display panel 1110. Moreover, FIGS. 25A and 25B are conceptual diagrams showing a writing operation and an emission operation of a display pixel according to the present embodiment, and FIG. 26 is a conceptual diagram showing an intermediate emission operation of the display pixel according to the present embodiment. FIG. 27 is a diagram showing the operating characteristics of a drive control transistor and a load characteristic of an organic EL element at the time of an emission operation and intermediate emission operation of a display pixel.

As shown in FIG. 24A, the emission drive control of the organic EL element OLED in the display pixel EM (the pixel drive circuit DC) applied to the present embodiment is schematically set to include a writing operation period Twrt and an emission operation period (display operation period) Tem in a predetermined one processing cycle period Tcyc (Tcyc≧Twrt+Tem). In the writing operation period Twrt, the display pixels EM connected to one of the selection lines SL are set to be in their selected state, and the gradation voltage Vdata of a voltage value in accordance with display data is supplied to make a voltage component in accordance with the display data be held between the gate and source (capacitor Cs) of the transistor Tr13 provided in the pixel drive circuit DC. In the emission operation period Tem, an emission drive current Ib of a current value in accordance with the display data is made to flow through the organic EL element OLED on the basis of the voltage component held between the gate and source of the drive control transistor Tr13 in the writing operation period Twrt, and an emission operation with a predetermined luminous gradation is performed.

Moreover, in the present embodiment, the display pixels EM in the row (writing line) to which the writing operation is executed are set to be in their non-emission states, in which their organic EL elements OLED are made not to perform their emission operations, during the writing operation period Twrt as shown in FIG. 24A. Incidentally, when a screen of image is displayed in one frame period on the display panel 1110 including a plurality of display pixels EM two-dimensionally arranged in the row directions and the column directions, the one processing cycle period Tcyc is set as one frame period. The details thereof will be described with regard to a display drive method of the display apparatus 1100, described below.

(Writing Operation)

In a writing operation (writing operation period Twrt) into one of the display pixels EM, as shown in FIG. 24A, the selection driver 1120 first applies the selection signal Vsel of the selection level (high level) to one of the selection lines SL to set the display pixel EM to be in its selected state, and the power source driver 1130 applies the low level power source voltage Vsc (=Vlow) to the power source line VL. Moreover, the data driver 1140 supplies the gradation voltage Vdata of the voltage value in accordance with display data to one of the data lines DL in synchronization with the selection timing.

Hereby, the transistors Tr11 and Tr12 provided in the corresponding pixel drive circuit DC perform their on-operations, and the low level power source voltage Vlow is applied to the gate terminal (node N11; one end side of the capacitor Cs) of the drive control transistor Tr13 through the transistor Tr11 and the source terminal (node N12; the other terminal side of the capacitor Cs) of the drive control transistor Tr13 is electrically connected to the data line DL through the transistor Tr12.

At this time, since the transistor Tr11 performs its on-operation, the drain terminal and gate terminal of the drive control transistor Tr13 are connected with each other, and the drive control transistor Tr13 is in the state of being in a diode connection. A voltage Vds1 (=Vlow−Vdata) is applied to the drain and source of the drive control transistor Tr13. A solid line SPw shown in FIG. 27 is a characteristic line of a drain-to-source current Ids to a drain-to-source voltage Vds in the case where an n-channel type thin film transistor is applied as the drive control transistor Tr13 to connect it in its diode connection, and the drive control transistor Tr13 has a threshold voltage Vth. When the drain-to-source voltage Vds exceeds the threshold voltage Vth, the drain-to-source current Ids non-linearly increases as the drain-to-source voltage Vds increases. Then, a point PMw on the characteristic line SPw where the drain-to-source voltage Vds becomes the voltage Vds1 is an operation point of the drive control transistor Tr13.

In the present embodiment, the gradation voltage Vdata supplied to the data line DL is set to a piece of potential lower than the low level power source voltage Vlow applied to the power source line VL here, and, as shown in FIG. 25A, a writing current Ia corresponding to the gradation voltage Vdata flows into the direction of the data driver 1140 from the power source line VL through the drive control transistor Tr13, the node N12, the transistor Tr12, and the data line DL as if the writing current Ia is pulled out.

As described above, by performing the operation of drawing the writing current Ia from the side of the data line DL into the data driver 1140, a voltage level of further lower potential than the low level power source voltage Vlow is applied to the source terminal (the node N12; the side of the other end of the capacitor Cs) of the drive control transistor Tr13 is applied. At this time, electric charges corresponding to the potential difference generated between the nodes N11 and N12 (between the gate and source of the drive control transistor Tr13) are accumulated in the capacitor Cs, and are held as a voltage component. Moreover, the potential applied to the anode terminal (node N12) of the organic EL element OLED becomes lower than the potential (common voltage Vcom) of the cathode terminal thereof, and no currents flow through the organic EL element OLED and no emission operations are performed.

(Emission Operation)

Next, in the emission operation (emission operation period Tem) after the completion of the writing operation period Twrt, as shown in FIG. 24A, the selection signal Vsel of a non-selection level (low level) is applied from the selection driver 1120 to the selection line SL, and the display pixel EM is set to be in its non-selected state. Furthermore, the high level power source voltage Vsc (=Vhig) is applied from the power source driver 1130 to the power source line VL. Moreover, the supply of the gradation voltage Vdata from the data driver 1140 is broken in synchronization with the non-selection timing, and the operation of the drawing in the writing current Ia is stopped.

Hereby, the transistors Tr11 and Tr12 provided in the pixel drive circuit DC are turned off, and the application of the power source voltage Vsc to the gate terminal (node N11; the side of one end of the capacitor Cs) of the drive control transistor Tr13 is broken, and the electric charges accumulated in the writing operation period Twrt are held in the capacitor Cs.

In this way, the potential difference between the nodes N11 and N12 (between the gate and source of the transistor Tr13;

between both ends of the capacitor Cs) is held, and the drive control transistor Tr13 keeps its on-state. Moreover, since the high level power source voltage Vhigh of a piece of potential higher than the common voltage Vcom (ground potential Vgnd) is applied to the power source line VL, the potential applied to the anode terminal (node N12) of the organic EL element OLED becomes higher than the potential of the cathode terminal (ground potential).

Consequently, as shown in FIG. 25B, the predetermined emission drive current Ib flows from the power source line VL to the organic EL element OLED through the drive control transistor Tr13 and the node N12 in the forward bias direction, and the organic EL element OLED performs its emission operation. The voltage component (the potential difference Vc between both the ends of the capacitors Cs) held by the capacitor Cs is equal to the potential difference in the case where the writing current Ia corresponding to the gradation voltage Vdata flows through the drive control transistor Tr13, the emission drive current Ib flowing through the organic EL element OLED has a current value substantially equal to the writing current Ia (Ib≈Ia) here.

Hereby, the emission drive current Ib continuously flows through the drive control transistor Tr13 during the emission operation period Tem on the basis of the voltage component corresponding to the display data (gradation voltage Vdata) written in the writing operation period Twrt, and then the organic EL element OLED continues the operation of emitting a light with the luminous gradation in accordance with the display data.

A solid line SPh shown in FIG. 27 is a characteristic line of the drive control transistor Tr13 showing the drain-to-source current Ids to the drain-to-source voltage Vds when the gate-to-source voltage Vgs is fixed to a certain voltage. Moreover, a solid line SPe1 shows a load line of the organic EL element OLED when the high level power source voltage Vhigh is applied to the power source line VL, and plots an inverted OLED drive current Ioled characteristic to a drive voltage Voled of the organic EL element OLED on the basis of the potential difference between the power source line VL and the cathode terminal of the organic EL element OLED, that is, the difference value of the voltage Vhigh−Vcom. Incidentally, a dotted line SPo shown in FIG. 27 is introduced as (characteristic line SPw)−(threshold voltage Vth), and the intersection point Po of the dotted line SPo and the characteristic line SPh indicates a pinch-off voltage Vpo. As shown in FIG. 27, the region of the characteristic line SPh from 0 here of the drain-to-source voltage Vds to the pinch-off voltage Vpo thereof is a linear region, and the region of the pinch-off voltage Vpo or more of the drain-to-source voltage Vds is a saturated region here.

The operation point of the drive control transistor Tr13 at the time of an emission operation moves from the point PMw at the writing operation to an intersection point PMe1 of the characteristic line SPh of the drive control transistor Tr13 and the load line SPe1 of the organic EL element OLED. As shown in FIG. 27, at the operation point PMe1, the voltage Vhigh−Vcom, which is applied between the power source line VL and the cathode terminal of the organic EL element OLED is distributed between the source and drain of the drive control transistor Tr13 and between the anode and cathode of the organic EL element OLED, and the voltage Vds1 is applied between the source and drain of the drive transistor Tr13 here. A drive voltage Voled1 is applied between the anode and cathode of the organic EL element OLED. In order that the writing current Ia flowing between the drain and source of the drive control transistor Tr13 at the time of a writing operation and the emission drive current Ib supplied to the organic EL element OLED at the time of an emission operation may not change, the operation point PMe must be kept in the saturated region on the characteristic line here.

(Intermediate Emission Operation)

In an intermediate emission operation (intermediate emission operation period Tmem) executed in one of the display pixels EM in one of the rows (designated lines) adjoining the row (writing line) of the display pixels EM in which the writing operation is executed, as shown in FIG. 24B, the selection signal Vsel of the non-selection level (low level) is applied from the selection driver 1120 to the selection line SL, and thereby the display pixel EM is set to be in the non-selected state, and the power source voltage Vsc (=Vmid) of the intermediate level is applied from the power source driver 1130 to the power source line VL.

Hereby, the transistors Tr11 and Tr12 provided in the pixel drive circuit DC are turned off, and the application of the power source voltage Vsc to the gate terminal (the node N11; the side of the one end of the capacitor Cs) of the drive control transistor Tr13 is broken and also the electrical connection between the source terminal (the node N12; the side of the other end of the capacitor Cs) of the drive control transistor Tr13 and the data line DL is broken. If the aforesaid emission operation has been executed just before, then the electric charges accumulated in the writing operation executed prior to the emission operation are held in the capacitor Cs here.

As described above, the potential difference between the nodes N11 and N12 (between the gate and source of the drive control transistor Tr13; between both the ends of the capacitor Cs) is held, and the drive control transistor Tr13 keeps its on-state. On the other hand, the intermediate level power source voltage Vmid, which is the potential higher than the common voltage Vcom (ground potential Vgnd) and the potential lower than the high level power source voltage Vhigh, is applied to the power source line VL, and the potential applied to the anode terminal (node N12) of the organic EL element OLED is higher than the potential (ground potential) of the cathode terminal. Consequently, as shown in FIG. 26, a predetermined intermediate emission drive current Ic flows from the power source line VL to the organic EL element OLED through the drive control transistor Tr13 and the node N12 in the forward bias direction, and the organic EL element OLED performs its intermediate emission operation. The intermediate level power source voltage Vmid is applied to the power source line VL, and the drive control transistor Tr13 is set to operate in the linear region, as described below. Thereby, the current value of the intermediate emission drive current Ic is set to be a value smaller than the current value of the emission drive current Ib. Hereby, the luminance of the organic EL element OLED at the time of the intermediate emission operation becomes lower than the luminance corresponding to the gradation voltage Vdata written in the display pixels EM during the writing operation period Twrt, that is, the luminance at an emission operation.

Since the luminance of the organic EL element OLED in each of the display pixels EM at the time of the emission operation is set in accordance with display data, the luminance of each of the display pixels EM is not uniform here. However, since it is rare that the luminance is greatly different between adjoining rows, in almost all cases, the luminance of the display pixels EM in a designated line set to perform an intermediate emission operation becomes lower than the luminance of the display pixels EM in an adjoining row to be set to be in the emission operation state, and becomes darker than that in the adjoining row in the display operation state.

A solid line SPe2 shown in FIG. 27 shows a load line of the organic EL element OLED when the intermediate level power source voltage Vmid is applied to the power source line VL, and plots an inverted OLED drive current Ioled characteristic to the drive voltage Voled of the organic EL element OLED on the basis of the potential difference between the power source line VL and the cathode terminal of the organic EL element OLED, that is, the difference value of the voltage Vmid-Vcom. The operation point of the drive control transistor Tr13 at the time of the intermediate emission operation is an intersection point PMe2 of the characteristic line SPh of the drive control transistor Tr13 and the load line SPe2 of the organic EL element OLED. At this time, as shown in FIG. 27, at the operation point PMe2, a voltage Vds2 smaller than the voltage Vds applied between the source and drain of the drive control transistor Tr13 at the time of the emission operation, and a drive voltage Voled2 is applied between the anode and cathode of the organic EL element OLED. The operation point PMe is set to exist in the linear region on the characteristic line here. Consequently, the current Ids flows through between the drain and source of the drive control transistor Tr13 at this time becomes smaller than the current flowing at the time of the emission operation, and the current value of a drive current Ic supplied to the organic EL element OLED at the time of the intermediate emission operation becomes smaller than the current value of the drive current Ib supplied at the time of the emission operation. Hereby, the luminance of the organic EL element OLED at the time of the intermediate emission operation becomes lower than the luminance corresponding to the gradation voltage Vdata written in the display pixel EM.

<Display Drive Method of Display Apparatus>

Next, the display drive method (the display operation of image information) of the display apparatus 100 according to the present embodiment will be described.

Figure 28:
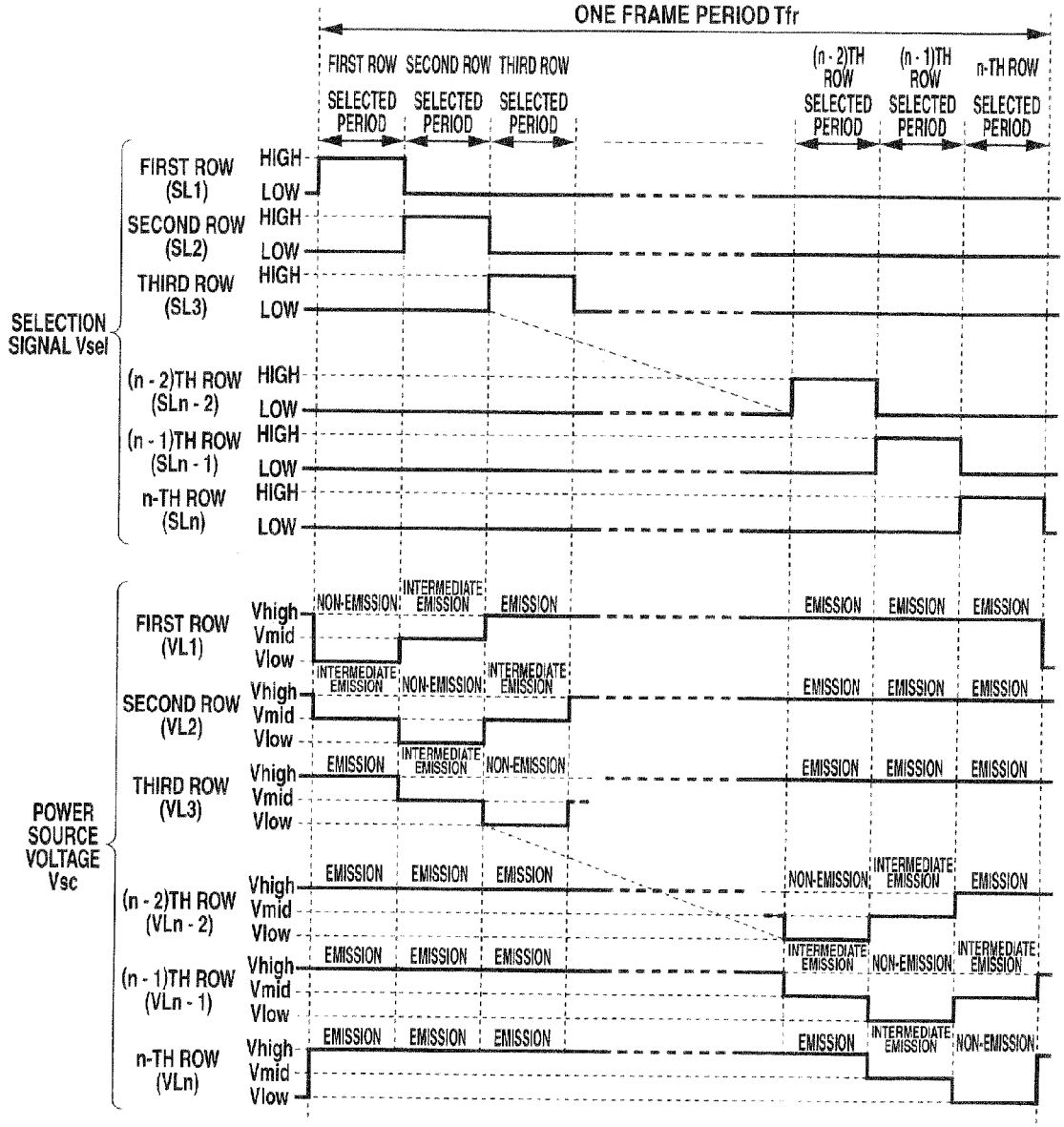
FIG. 28 is a timing chart showing an example of a display drive method of the display apparatus according to the fifth embodiment.

FIG. 28 is a timing chart showing an example of the display drive method of the display apparatus 100 according to the present embodiment, and FIGS. 29A-29L are operational conceptual diagrams for illustrating the display drive method of the display apparatus according to the present embodiment.

The display drive method of the display apparatus 100 according to the present embodiment sequentially repeats the operation of sequentially making the display pixels EM (pixel drive circuits DC) in each of the rows arranged in the display panel 1110 be in their selected state to write the gradation voltage Vdata in accordance with display data into the display pixels EM for all of the rows, and thereby makes the display pixels EM in the row (writing line) to which the writing operation is executed be in their non-emission operation states, and makes the display pixels EM in the rows (designated rows) adjoining the writing line in their intermediate emission operation states, and further makes the display pixels EM in the other rows be in their emission operation states emitting lights of predetermined luminous gradations in accordance with the already written display data (gradation voltages Vdata). Thereby, the display drive method displays the image information for one screen of the display panel 1110.

To put it concretely, as shown in FIG. 28, the display drive method according to the present embodiment applies the selection signal Vsel of the selection level (high level) from the selection driver 1120 to the selection line SL of a specific row (for example, i-th row; $1 \leqq i \leqq n$) of the display panel 1110 in one scanning period (=writing operation period Twrt) in one frame period Tfr, and thereby sets the display pixels EM in the i-th row to be in their selected states. Then, as shown in FIG. 24A, in synchronization with the timing of being set as the selected states, the gradation voltage Vdata of a voltage value in accordance with display data is supplied from the data driver 1140 to each of the data lines DL, and thereby the voltage component corresponding to the writing current Ia in accordance with the gradation voltage Vdata is held (electric charges are accumulated) between the gate and source terminals (between both the ends of the capacitor Cs) of the drive control transistor Tr13 provided in the pixel drive circuit DC of each of the display pixels EM in the i-th row. Moreover, in the writing operation period Twrt to the display pixels EM in the i-th row, the low level power source voltage Vsc (=Vlow) is applied to the power source line VLi in the i-th row, to which the writing operation is performed, by the power source driver 1130, and the organic EL elements OLED in the display pixels EM in the i-th row are set to be in their non-emission operation states.

Moreover, as shown in FIG. 28, in the selected period, each of the display pixels EM in the (i−1)th row and the (i+1)th row, both adjoining the i-th row in which a writing operation is executed, (when i=1, the second row and the n-th row; and when I=n, the first row and (n−1)th row) is set to be in the intermediate emission operation period Tmem shown in FIG. 24B, and the selection signal Vsel of the non-selection level (low level) is applied to each of the display pixels EM, which is set to be in its non-selected state thereby. Thus, the application of the gradation voltage Vdata from the data driver 1140 to each of the data lines DL is broken. Then, the intermediate level power source voltage Vsc (=Vmid) is applied to the power source lines VLi−1 and VLi+1 in the corresponding rows by the power source driver 1130, and the organic EL element OLED in each of display pixels EM in the rows is set to be in the intermediate emission operation state in which luminance is set to be lower than the luminance corresponding to the gradation voltage Vdata.

Next, as shown in FIG. 28, the periods after the elapse of an intermediate emission operation period Tmem after the end of a writing operation period Twrt is set as the emission operation periods Tem shown in FIGS. 24A and 24B. By applying the selection signal Vsel of the non-selection level (low level) from the selection driver 1120 to the selection line SLi in the i-th row, the display pixels EM in the i-th row are set to be in their non-selected states, and the application of the gradation voltage Vdata from the data driver 1140 to each of the data lines DL is broken.

Then, the high level power source voltage Vsc (=Vhigh) is applied from the power source driver 1130 to the power source line VL in the i-th row in the emission operation periods Tem, and thereby the emission drive current Ib in accordance with the display data (gradation voltage Vdata) is supplied to the organic EL element OLED on the basis of the voltage component charged in each of the display pixels EM (between the gate and source of the drive control transistor Tr13) in the i-th row, and an emission operation is performed with a luminous gradation corresponding to the gradation voltage Vdata. Such an emission operation is continuously executed until the next writing operation of the i-th row or the starting timing of the intermediate emission operation.

Figures 29A, 29B, 29C, 29D, 29E, 29F, 29G, 29H, 29I, 29J, 29K, 29L:
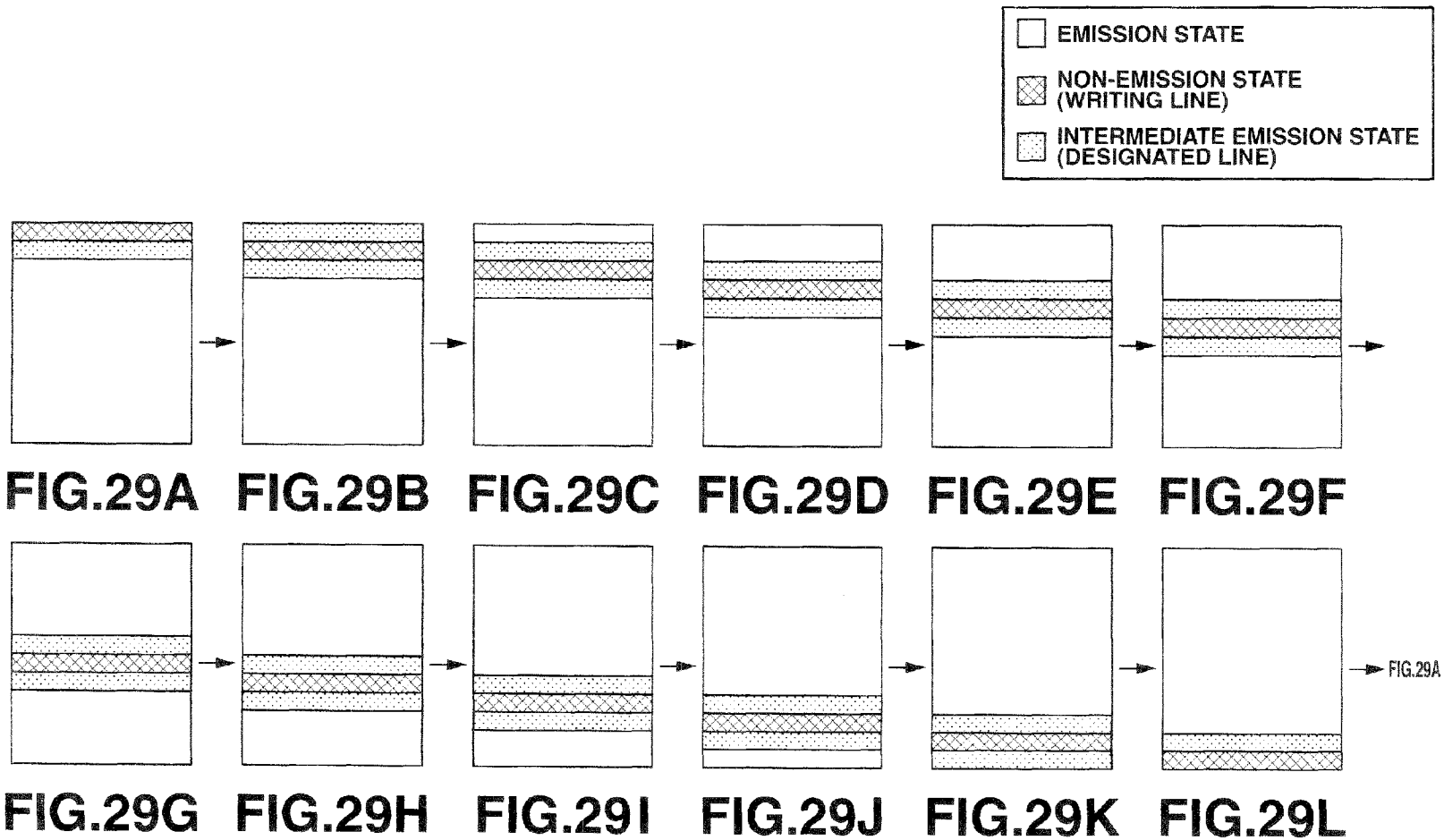
FIGS. 29A, 29B, 29C, 29D, 29E, 29F, 29G, 29H, 29I, 29J, 29K, and 29L are operational conceptual diagrams for illustrating the display drive method of the display apparatus according to the fifth embodiment.

Then, the display drive operation mentioned above is repeatedly executed to all the rows of the display panel 1110 in order, and the emission operation is set to partially overlap with each of the display pixels EM in each of the rows in terms of time. Thereby, as shown in the operational conceptual diagrams shown in FIGS. 29A-29L, the row (writing line) in which the writing operation is executed is set to be in the non-emission operation state, and the adjacent rows (designated lines) on the upper and lower sides of the row are set to be in the intermediate emission operation state. As the writing operation sequentially moves to the next row, the writing line to be set in the non-emission operation state and the designated lines to be set in the intermediate emission operation state are controlled so as to sequentially move downward in the display region of the display panel 1110 set in the emission operation state (see FIGS. 29B-29K). Moreover, if the writing line to which the writing operation is executed is the first row of the uppermost row in the display region, as shown in FIG. 29A, the designated line is set only in the second row. If the writing line to which the writing operation is executed is the n-th row of the lowermost row in the display region, as shown in FIG. 28I, the designated line is controlled to be in only the (n−1)th row.

According to the display drive method of a display apparatus of the present embodiment, by setting a writing line to be in the non-emission operation state (non-display operation state), the false impulse type display drive control for executing the emission operation with the luminous gradation in accordance with display data only in a certain period in one frame period can be realized. A designated line to be set to the intermediate emission state (intermediate display operation state) is provided between a writing line to be set to the non-emission operation state and a region set to be the emission operation state (display operation state), and since the designated lines set in the intermediated emission operation state are set to have luminance lower than the luminance of the adjacent row set to be in the emission operation state in almost all cases, the writing line set in the non-emission operation state can be hard to be conspicuous and to sight.

Consequently, an image display hard to sight the writing line set to be in the non-emission operation state can be realized. For example, even if the frame frequency thereof is set to a low value of about 30 Hz from a general high value of 60 Hz or more, the wiring line set to be in the non-emission state is hard to sight, and consequently the deterioration of the display quality can be suppressed. Consequently, the frame frequency can be set to be comparatively lower, and the power consumption of a driver (display drive apparatus) applied to the display apparatus can be reduced. Furthermore, the cost of the driver can be reduced, and the driver can be made to be comparatively small. Thus, the degree of freedom of the specifications of the display panel can be improved.

<Sixth Embodiment>

Next, a sixth embodiment of the display apparatus according to the present invention will be described.

In regard to the aforesaid fifth embodiment, the description has been given to the case where, when a writing operation into the display pixels in each row of the display panel is executed, the row (writing line) into which the writing operation is executed is set to be in the non-emission operation state, and the display pixels in the rows (designated lines) adjoining the writing line are set to be in the intermediate emission state. In the sixth embodiment, a display panel including a plurality of rows is grouped every display pixels in a continuous predetermined number of rows, and a group (hereinafter referred to as "writing group" for descriptive purposes) including the row (writing line) into which the writing operation is executed is set to be in its non-emission operation state. Furthermore, the sixth embodiment controls the display pixels in a group (hereinafter referred to as "designated group" for descriptive purposes) adjoining the writing group to be set in their intermediate emission operation states.

<Display Apparatus>

First, a schematic configuration of a display apparatus according to the present embodiment will be described with reference to the attached drawings.

Figure 30:
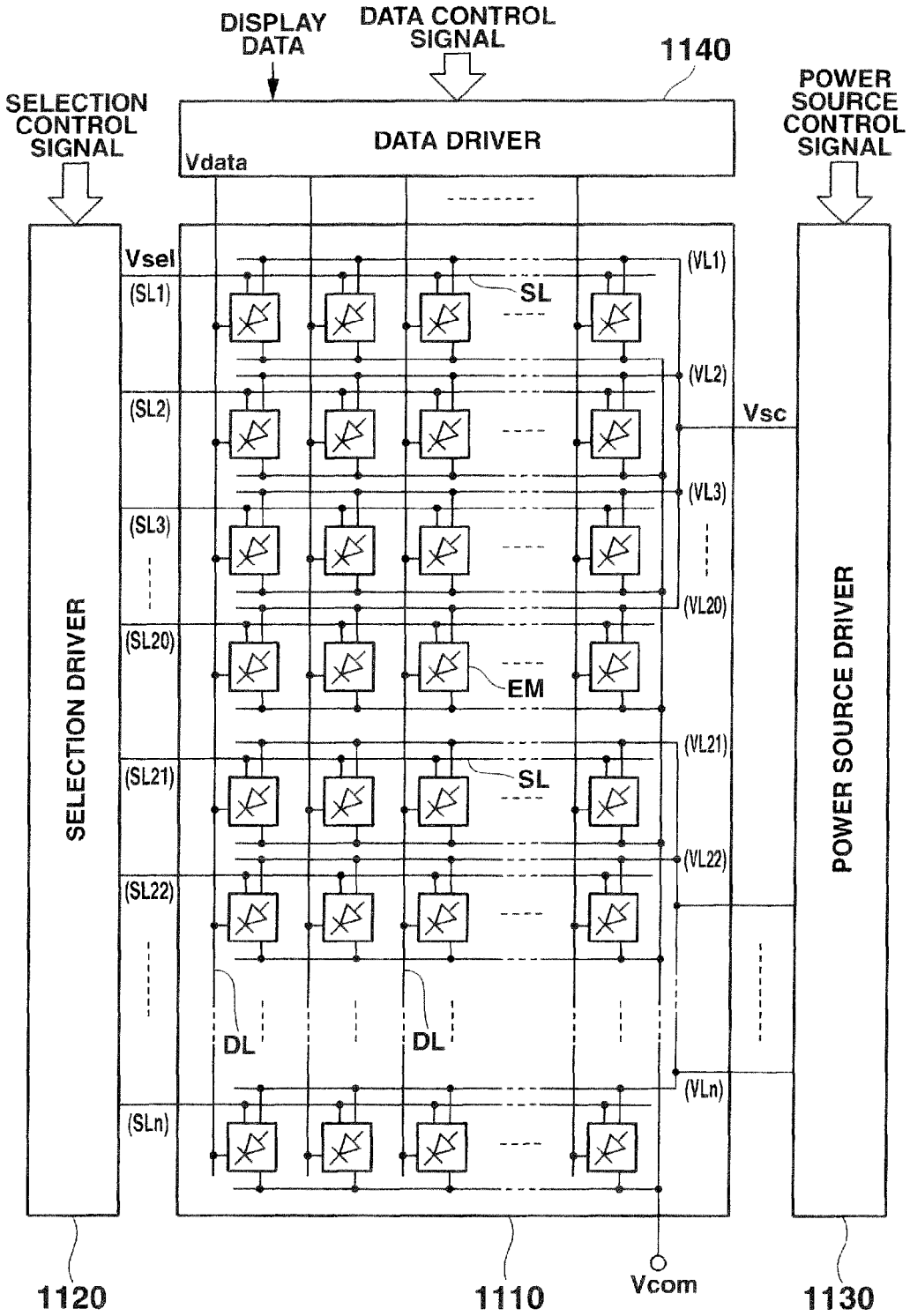
FIG. 30 is a diagram of the configuration of the principal part of the examples of a display panel and peripheral circuitry thereof applied to a display apparatus according to a sixth embodiment.

FIG. 30 is a diagram of the configuration of the principal part showing examples of a display panel and the peripheral circuitry thereof (a selection driver, a data driver, and a power source driver) applied to a display apparatus according to a sixth embodiment. The components equal to those of the fifth embodiment mentioned above are denoted by the same marks as those of the fifth embodiment, and their descriptions are simplified or omitted.

As shown in FIG. 30, in the display apparatus 1100 according to the present embodiment, the plurality of display pixels EM arranged in two dimensions in the row direction and column direction of the display panel 1110 is grouped every arbitrary rows (supposed to be 20 rows in the present embodiment). As shown in a display drive method described below, the display apparatus 1100 is controlled so that the display pixels Em in the region (writing region) corresponding to all the rows included in a group (writing group) including a row (writing line) into which the writing operation is executed may be set to be in their non-display operation states (non-emission operation states), and that, in synchronization with the writing operation, the display pixels EM in the region (designated region) corresponding to all of the rows included in the groups (designated groups) adjoining the writing group may be set to be in their intermediate display operation states (intermediate emission operation states) and the display pixels EM in all of the rows included in the other groups (to which the writing operation has been already ended) may be set to be in their display operation states (emission operation states).

The display operation states (emission operation states), intermediate display operation states (intermediate emission operation states), or non-display operation states (non-emission operation states) of the display pixels EM included in each group are set by switching the power source voltage Vsc supplied to the display pixels EM in all the rows included in each group to the high level power source voltage Vhigh, the intermediate level power source voltage Vmid, or the low level power source voltage Vlow, respectively, here. Accordingly, in the display panel 1110 applied to the present embodiment, a single power source line (power source line) VL is arranged by being branched to the power source lines (for example, power source lines VL1-VL20) corresponding to all of the rows in one group, and the power source voltage Vsc output from the power source driver 1130 (output circuit section 1132), described below, is applied to all of the display pixels in the group in common as the same time.

Moreover, the selection driver 1120 applied to the present embodiment has the equal configuration to that of the selection driver 1120 in the fifth embodiment, and sequentially applies the selection signal Vsel to the selection line SL of each row of the display panel 1110 and thereby sequentially sets the display pixels EM in each row of the display panel 1110 to be in their selected states.

Figure 31:
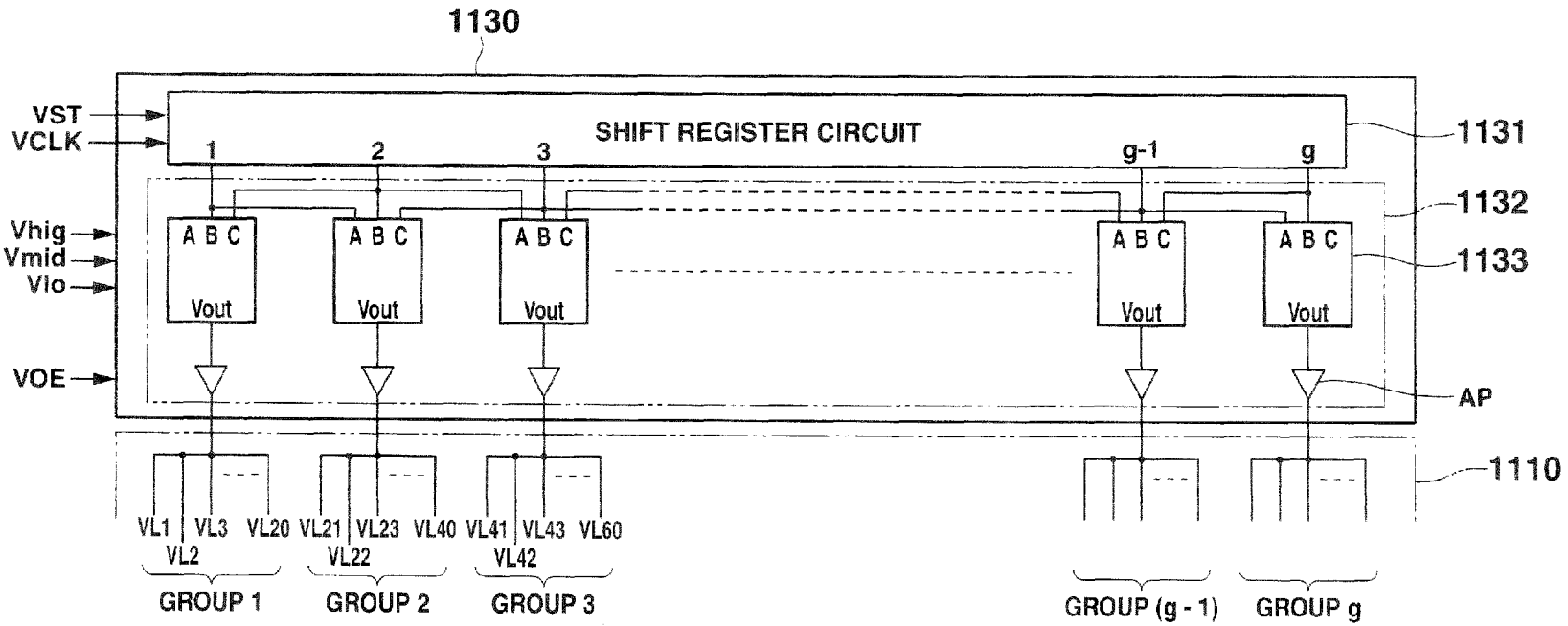
FIG. 31 is a schematic configuration diagram showing an example of a power source driver applied to the display apparatus according to the sixth embodiment.

FIG. 31 is a schematic configuration diagram showing an example of the power source driver 1130 applied to the display apparatus 1100 according to the present embodiment. Hereupon, the description will be given to the case where the display pixels EM arranged in the display panel 1110 are divided into a plurality of groups, for example, every 20 rows and g sets of the groups are set. Here g indicates an integer within a range of $1<g<n$, and it is supposed that each group is branched into at least two or more power source lines VL.

To each group in the display panel 1110 the power source driver 130 sequentially executes the operations of: applying the low level power source voltage Vsc (=Vlow) to the display pixels EM in a writing group including the rows set to be in their selected states by the selection driver 1120 through the power source lines VL (for example the power source lines VL1-VL20) arranged in each of the groups among the plurality of display pixels EM two-dimensionally arranged in the display panel 110; applying the intermediate level power source voltage Vsc (=Vmid) to the display pixels EM in the designated groups adjoining the writing group through the power source lines VL arranged by being branched to each of the groups; and applying the high level power source voltage Vsc (=Vhigh) to the display pixels EM in the other groups through the power source lines VL arranged by being branched to each of the groups.

Hereby, the low level power source voltage Vsc (=Vlow) is applied to all of the display pixels EM in the writing group through each of the power source lines VL arranged by being branched to the group, and the display pixels EM are set to be in their non-emission operation states (non-display operation states). The intermediate level power source voltage Vsc (=Vmid) is applied to the display pixels EM in the designated groups adjoining the writing group through each of the power source lines VL arranged by being branched to the designated groups to set the display pixels EM to be in their intermediate emission operation states (intermediate display operation states). The high level power source voltage Vsc (=Vhigh) is applied to the display pixels EM in the other groups (the writing operation into all of the rows of which has ended) through each of the power source lines VL arranged by being branched correspondingly to each group, and the display pixels EM are set to be in their emission operation states (gradation display operation states).

The power source driver 1130 has the configuration equal to that of the fifth embodiment mentioned above and includes the shift register circuit 1131 and the output circuit section 1132 here. The shift register circuit 1131 is configured to include g steps, as shown in FIG. 31, equal to the number (g) of groups set in the display panel 1110, and outputs g shift signals. Moreover, the output circuit section 1132 includes g arithmetic circuits 1133 and amplifiers AP correspondingly to each group. Shift signals are applied to the output circuit section 1132 as input signals A, B, and C, and the output circuit section 1132 outputs any voltage of the voltages Vhigh, Vmid, and Vlow according to an input signal as the output signal Vout. The amplifiers AP amplifies the output signal Vout, and outputs the amplified output signal Vout to each of the power source lines VL1-VLn according to the output control signal VOE. As shown in FIG. 31, a first sift signal output from the shift register circuit 1131 is applied to the first arithmetic circuit 1133 as the input signal B, and to the second arithmetic circuit 1133 as the input signal A. A second shift signal output from the shift register circuit 1131 is applied to the second arithmetic circuit 1133 as the input signal B, and to the first arithmetic as shown in FIG. 22A, and further to a third arithmetic circuit 1133 as the input signals B. Moreover, the last n-th shift signal output from the shift register circuit 1131 is applied into an n-th arithmetic circuit 1133 as the input signal B, and is applied to an (n−1)th arithmetic circuit 1133 as the input signal C.

Incidentally, FIG. 31 shows the configuration in which both of the groups adjoining a writing group on the upper and lower sides thereof are used as the designated groups and the intermediate level power source voltage Vsc (=Vmid) is applied to the display pixels EM in the corresponding regions to set the display pixels EM in their intermediate emission operation states, but the present invention is not restricted to this configuration. The configuration in which two or more groups adjoining the writing group are set as the designated groups and the intermediate level power source voltage Vsc (=Vmid) is applied to the display pixels EM in the corresponding regions to set the display pixels EM to the intermediate emission operation state may be used.

Moreover, with reference to FIG. 31, the description has been given to the case where the power voltage Vsc generated by the power source driver 1130 correspondingly to each of the groups set in the display panel 1110 is simultaneously applied to the display pixels EM in all the rows included in each group through the power source lines VL arranged by being branched in the display panel 1110, but the present invention is not restricted to this case. The present invention may use the configuration in which the outputs (power source voltage Vsc) of the amplifiers AP provided correspondingly to each group are branched correspondingly to each row of the display panel 1110 in the power source driver 1130 to be connected to the power source line VL of each row of the display panel 1110.

Incidentally, in the configuration shown in FIG. 31, since the display panel 1110 and the power source driver 1130 can be connected with each other by the group, the number of connection terminals of both of them can be greatly reduced. Thereby, the power source driver applicable to a miniaturized and highly-fined display panel can be provided. On the other hand, in the latter configuration mentioned above, the display panel 1110 and the power source driver 1130 can be connected to each other by the row, and consequently it is unnecessary to change the wiring design and the like in the display panel 1110. Thereby, the power source driver applicable to the existing display panel 1110 as it is can be provided.

<Display Drive Method of Display Apparatus>

Next, a display drive method (a display operation of image information) of the display apparatus 1100 according to the present embodiment will be described.

Figure 32:
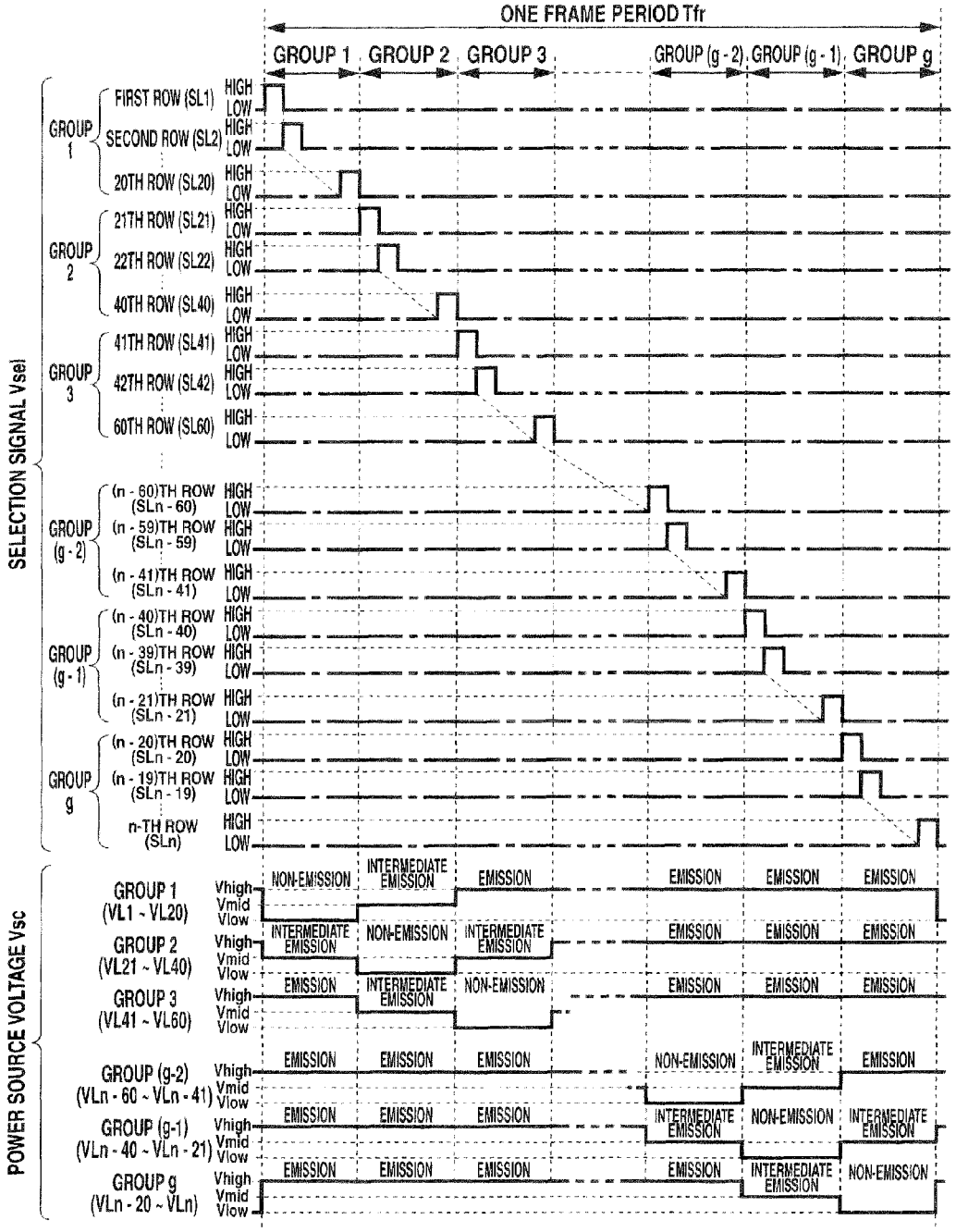
FIG. 32 is a timing chart showing an example of a display drive method of the display apparatus according to the sixth embodiment.

FIG. 32 is a timing chart showing an example of the display drive method of the display apparatus 1100 according to the present embodiment, and FIGS. 33A-33F are operational conceptual diagrams for illustrating the display drive method of the display apparatus 1100 according to the present embodiment.

The display drive method of the display apparatus 1100 according to the present embodiment sequentially repeats the operation of writing the gradation voltage Vdata in accordance with display data into the display pixels EM (pixel drive circuits DC) in each of the rows arranged in the display panel 1110 for all of the rows, and thereby sets the display pixels EM in all of the rows included in a group (writing group) including a row to which the writing operation is executed to be their non-emission operation states, and sets the display pixels EM in all of the rows included in the groups adjoining the writing group in their intermediate emission operation states, and further makes the display pixels EM in the other groups perform their emission operations with predetermined luminous gradations in accordance with the already written display data (gradation voltages Vdata). Thereby, the display drive method displays the image information for one screen of the display panel 1110.

To put it concretely, as shown in FIG. 32, the display drive method according to the present embodiment applies the selection signal Vsel of the selection level (high level) from the selection driver 1120 to the selection line SLi of, for example, an i-th specific row ($1 \leqq i \leqq n$) of the display panel 1110 in one scanning period (=writing operation period Twrt) in one frame period Tfr, and thereby sets the display pixels EM in the i-th row to be in their selected states. The gradation voltage Vdata of a voltage value in accordance with display data is supplied from the data driver 1140 to each of the data lines DL in synchronization with the timing at which the display pixels EM are made to be in the selected states, and thereby the voltage component in accordance with the gradation current Idata in accordance with the gradation voltage Vdata is held (electric charges are accumulated) between the gate and source terminals (between both the ends of the capacitor Cs) of the drive control transistor Tr13 provided in the pixel drive circuit DC of each of the display pixels EM in the i-th row. After the end of the writing operation period Twrt to the display pixels EM in the i-th row, the selection signal Vsel of the non-selection level (low level) is applied from the selection driver 1120 to the selection lines SL in the i-th row, and thereby each of the display pixels EM in the i-th row is set to be in its non-selected state. Thus, the supply of the gradation voltage Vdata from the data driver 1140 to each of the data lines DL is broken. Such a writing operation to the display pixels EM in each row is repeatedly executed to all of the rows in the writing group in order.

As shown in FIG. 32, if a writing group including the i-th row, in which the writing operation is being executed, is supposed to be denoted by a writing group m, then, in a period until the writing operation to all of the rows included in the writing group m ends, the low level power source voltage Vsc (=Vlow) is applied from the power source driver 1130 to all of the power source lines VL in the writing group m, and the display pixels EM in the writing group m are set to be in their non-emission states. Moreover, the selection signal Vsel of the non-selection level (low level) is applied to the display pixels EM in the groups (m−1) and (m+1) adjoining the writing group m, and the display pixels EM are set to be in their non-selected states. The power source voltage Vsc (=Vmid) of the intermediate level is applied to all of the power source lines VL corresponding to the groups, and thereby the display pixels EM in the groups (m−1) and (m+1) are set to be in the intermediate emission operation state.

Next, in a period after the end of the period in which the writing operation into all of the rows in the writing group m has ended and the display pixels EM in the writing group m has been set to be in the intermediate emission operation state, the high level power source voltage Vsc (=Vhigh) is applied from the power source driver 1130 to all of the power source lines VL in the writing group m, and thereby an emission drive current Ib in accordance with display data (gradation voltage Vdata) is supplied to the organic EL elements OLED on the basis of the voltage component charged in each of the display pixels EM (between the gate and source of each of the drive control transistors Tr13) in all of the rows in the writing group m. Thus the emission operation with a predetermined luminous gradation is performed. Such an emission operation is continuously executed until the starting time of the next writing operation or the intermediate emission operation in the group m including the i-th row.

Figures 33A, 33B, 33C, 33D, 33E, 33F:
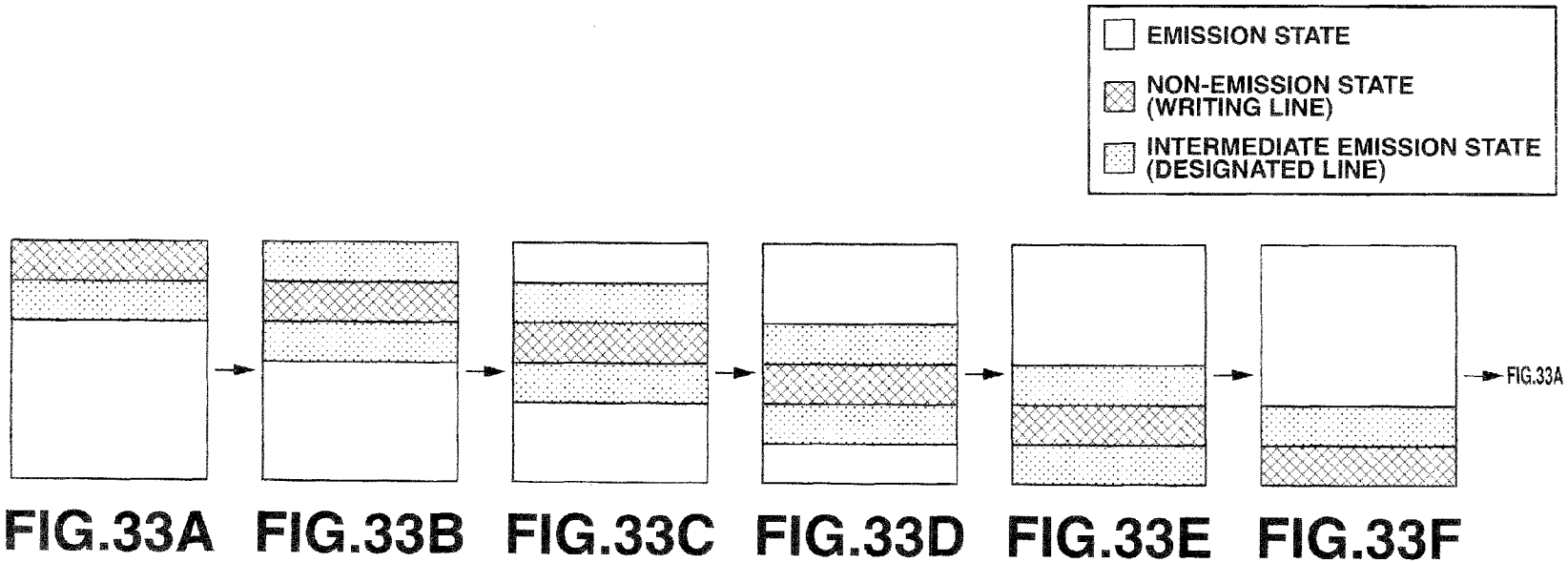
FIGS. 33A, 33B, 33C, 33D, 33E and 33F are operational conceptual diagram for illustrating the display drive method of the display apparatus according to the sixth embodiment.

Then, such a display drive operation is repeatedly executed to all of the rows of the display panel 1110 in order by the previously set group. By setting the emission operations to overlap with one another between display pixels EM in each group, as the operation conceptual diagram shown in FIGS. 33A-33F, the writing group including a row into which a writing operation is executed is set to be in the non-emission operation state, and the designated groups adjoining the writing group are set to be in the intermediate emission operation state. As the writing operation sequentially moves to the next row and the group including the row moves, the writing group set in the non-emission operation state and the designated groups set in the intermediate emission operation state are controlled so as to move downward in the display region, which is set to be in its emission state, in the display panel 1110 sequentially (see FIGS. 33B-33E). Moreover, when the writing group is the first group at the uppermost part in the display region, as shown in FIG. 33A, the designated group is controlled to be set only in a second group 2. When the writing group is a group g at the lowermost part of the display region, as shown in FIG. 32F, the designated group is controlled to be set only in a first group 1.

According to the display drive method of a display apparatus 1100 in the present embodiment, in a period in which a writing operation is being executed to the display pixels EM in each row in a writing group, the display pixels (emission elements) EM included in the writing group are set in their non-emission operation states (non-display operation states), and thereby a false impulse type display drive control for performing an emission operation with a luminous gradation in accordance with display data only in a certain period of one frame period can be realized. In comparison with the configuration of the fifth embodiment, the region to be set to the non-emission operation states can be comparatively made larger, and the display quality of a moving image can be improved.

Furthermore, in the display drive method according to the present embodiment, a designated group to be set in the intermediate emission operation state (intermediate display operation state) is provided between a writing group set to be in the non-emission operation state and a region set to be in the emission operation state (display operation state), and the designated group set in the intermediate emission operation state is set at lower luminance than that of the adjoining rows in the emission operation states in almost all cases. Consequently, even if a human visual line quickly moves, the writing group set to be in the non-emission operation state is hard to be conspicuous and to be sighted.

Consequently, also in the present embodiment, an image display hard to sight any writing groups set in the non-emission operation state can be realized, and, for example, even if the frame frequency is set to a low value about 30 Hz from the general high value of 60 Hz or more, the writing group set in the non-emission operation state is hard to sight, and consequently the deterioration of a display quality can be suppressed. Then, by setting the frame frequency to be comparatively low, the power consumption of a driver (display drive apparatus) applied to the display apparatus can be reduced, and the cost of the driver can be reduced. Moreover, the driver can be made to be comparatively small, and the degree of freedom of the specifications of the display panel can be improved.

What is claimed is:

1. A display drive apparatus performing a display drive of a display panel based on display data, the display panel including a plurality of display pixels arranged along a plurality of rows and a plurality of columns, the plurality of rows being grouped in a plurality of groups, and each of the plurality of groups including a same number of adjacent rows, the apparatus comprising:

a selection drive section for sequentially applying a selection signal to each of the display pixels arranged in each of the rows to sequentially set each of the display pixels in each of the rows into a selected state;

a data drive section for generating a drive signal based on the display data to supply the generated drive signal to each of the display pixels in each of the rows set to be in the selected state so as to perform a writing operation of the drive signal into each of the display pixels; and a power source drive section for (i) setting a specific group including a row which is set to be in the selected state by the selection drive section and on which the writing operation is performed by the data drive section among the plurality of groups as a writing region during a period in which the writing operation is performed on each of the display pixels included in the specific group and releasing the setting of the specific group as the writing region when the writing operation of each of the display pixels included in the specific group is completed, (ii) setting a second group which is apart from a first group in one direction having a constant number of groups, the constant number of groups being one or a plurality of groups, between the first group and the second group as a designated region at a first timing in one frame period when the first group among the plurality of groups is set as the specific group and setting a fourth group which is apart from a third group which is different from the first group in the one direction having the constant number of groups between the third group and the fourth group as the designated region at a second timing which is different from the first timing in the one frame period when the third group among the plurality of groups is set as the specific group, and (iii) supplying a first power source voltage for setting each of the display pixels in a non-display operation to each of the display pixels in the writing region and each of the display pixels in the designated region at a same time and supplying a second power source voltage for setting each of the display pixels in a display operation to each of the display pixels other than the display pixels in the writing region and the designated region;

wherein the power source drive section sets a fifth group which is apart from the second group in the one direction having the constant number of groups between the second group and the fifth group as the designated region at the first timing and sets a sixth group which is apart from the fourth group in the one direction having the constant number of groups between the fourth group and the sixth group as the designated region at the second timing.

2. The display drive apparatus according to claim 1, wherein the power source drive section includes:

a shift register circuit for sequentially outputting shift signals, a number of the shift signals being less than a number of the rows of display pixels arranged in the display panel; and an output circuit for converting the shift signals into voltage levels according to the first power source voltage to simultaneously apply the converted voltage levels to respective display pixels corresponding to the rows in the writing region and the designated region in synchronization with an application timing of the selection signal.

3. A display apparatus including a display panel in which a plurality of display pixels are arranged along a plurality of rows and a plurality of columns, the plurality of rows being grouped in a plurality of groups and each of the plurality of groups including a same number of adjacent rows, and the display apparatus displaying image information based on display data in the display panel, the apparatus comprising:

a selection drive section for sequentially applying a selection signal to each of the display pixels arranged in each of the rows in the display panel to sequentially set each of the display pixels in each of the rows into a selected state;

a data drive section for generating a drive signal based on the display data to supply the generated drive signal to each of the display pixels in each of the rows set to be in the selected state so as to perform a writing operation of the drive signal into each of the display pixels; and a power source drive section for (i) setting a specific group including a row which is set to be in the selected state by the selection drive section and on which the writing operation is performed by the data drive section among the plurality of groups as a writing region during a period in which the writing operation is performed on each of the display pixels included in the specific group and releasing the setting of the specific group as the writing region when the writing operation of each of the display pixels included in the specific group is completed, (ii) setting a second group which is apart from a first group in one direction having a constant number of groups, the constant number of groups being one or more groups, between the first group and the second group as a designated region at a first timing in one frame period when the first group among the plurality of groups is set as the specific group and setting a fourth group which is apart from a third group which is different from the first group in the one direction having the constant number of groups between the third group and the fourth group as the designated region at a second timing which is different from the first timing in the one frame period when the third group among the plurality of groups is set as the specific group, and (iii) supplying a first power source voltage for setting each of the display pixels in a non-display operation to each of the display pixels in the writing region and each of the display pixels in the designated region at a same time and supplying a second power source voltage for setting each of the display pixels in a display operation to each of the display pixels other than the display pixels in the writing region and the designated region;

wherein the power source drive section sets a fifth group which is apart from the second group in the one direction having the constant number of groups between the second group and the fifth group as the designated region at the first timing and sets a sixth group which is apart from the fourth group in the one direction having the constant number of groups between the fourth group and the sixth group as the designated region at the second timing.

4. The display apparatus according to claim 3, wherein:

each of the display pixels in the display panel includes an emission element and a drive circuit for controlling an emission operation of the emission element, and the drive circuit includes an emission control element to generate an emission drive current of a predetermined current value based on the drive signal supplied from the data drive section and to supply the generated emission drive current to the emission element, the emission control element being connected between a power source line through which the power source voltage is applied at least from the power source drive section and the emission element.

5. A display drive method of a display apparatus including a display panel in which a plurality of display pixels are arranged along a plurality of rows and a plurality of columns, the plurality of rows being grouped in a plurality of groups and each of the plurality of groups including a same number of adjacent rows, and the display apparatus displaying image information based on display data in the display panel, the method comprising:

applying a selection signal to each of the display pixels arranged in each of the rows in the display panel sequentially, to set each of the display pixels in each of the rows into a selected state sequentially;

supplying a drive signal based on the display data to each of the display pixels in each of the rows set to be in the selected state so as to perform a writing operation of the drive signal into each of the display pixels;

setting a specific group including a row which is set to be in the selected state and on which the writing operation is performed among the plurality of groups as a writing region during a period in which the writing operation is performed on each of the display pixels included in the specific group and releasing the setting of the specific group as the writing region when the writing operation of each of the display pixels included in the specific group is completed;

setting a second group which is apart from a first group in one direction having a constant number of groups, the constant number of groups being one or a plurality of groups, between the first group and the second group as a designated region at a first timing in one frame period when the first group is set as the specific group and setting a fourth group which is apart from a third group which is different from the first group in the one direction having the constant number of groups between the third group and the fourth group as the designated region at a second timing which is different from the first timing in the one frame period when the third group is set as the specific group; and supplying a first power source voltage for setting each of the display pixels in a non-display operation to each of the display pixels in the writing region and each of the display pixels in the designated region at a same time and supplying a second power source voltage for setting each of the display pixels in a display operation to each of the display pixels other than the display pixels in the writing region and the designated region;

wherein the setting of the designated region comprises setting a fifth group which is apart from the second group in the one direction having the constant number of groups between the second group and the fifth group as the designated region at the first timing and setting a sixth group which is apart from the fourth group in the one direction having the constant number of groups between the fourth group and the sixth group as the designated region at the second timing.

* * * * *